US005968725A

United States Patent [19]

Katoh et al.

[11] Patent Number: 5,968,725

[45] Date of Patent: Oct. 19, 1999

[54] PHOTOTHERMOGRAPHIC PHOTOSENSITIVE MATERIAL

[75] Inventors: Kazunobu Katoh; Minoru Sakai, both of Kanagawa, Japan

[73] Assignee: Fuji Photo Film Co., Ltd., Kanagawa, Japan

[21] Appl. No.: 08/845,371

[22] Filed: Apr. 24, 1997

[30] Foreign Application Priority Data

Apr. 26, 1996 [JP] Japan ..... 8-130849
May 17, 1996 [JP] Japan ..... 8-148114

[51] Int. Cl.[6] ..... G03C 1/498

[52] U.S. Cl. ..... 430/619; 430/264; 430/603; 430/611; 430/613

[58] Field of Search ..... 430/619, 264, 430/603, 611, 613

[56] References Cited

U.S. PATENT DOCUMENTS 4,166,742 9/1979 Mifune et al. .
4,987,052 1/1991 Hirano et al. ..... 430/264
5,242,791 9/1993 Hirano et al. ..... 430/611
5,464,738 11/1995 Lynch et al. .
5,496,695 3/1996 Simpson et al. .
5,677,121 10/1997 Tsuzuki .

*Primary Examiner*—Thorl Chea
*Attorney, Agent, or Firm*—Birch, Stewart, Kolasch & Birch, LLP

[57] ABSTRACT

A photothermographic material comprising a photosensitive silver halide, an organic silver salt, a reducing agent, and an ultrahigh contrast promoting agent, typically a hydrazine derivative. In one embodiment, a compound having a group for promoting adsorption to the silver halide is contained for suppressing occurrence of pepper fog. In another embodiment, a 5- or 6-membered heterocyclic mercapto compound having at least two nitrogen atoms or a tetraazaindene compound is contained for suppressing a change of photographic properties, typically image enlargement with a variation of developing conditions. In either case, the photothermographic material can form super-high contrast images of quality.

20 Claims, No Drawings

PHOTOTHERMOGRAPHIC PHOTOSENSITIVE MATERIAL

BACKGROUND OF THE INVENTION

1. Field of the Invention

This invention relates to a photothermographic photosensitive material, especially suited for the manufacture of printing plates.

2. Prior Art

Photothermographic photosensitive materials which are processed by a photothermographic process to form photographic images are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

These photothermographic photosensitive materials generally contain a reducible silver source (e.g., organic silver salt), a catalytic amount of a photocatalyst (e.g., silver halide), a toner for controlling the tonality of silver, and a reducing agent, typically dispersed in a binder matrix. They are generally known as dry silver. Photothermographic photosensitive materials are stable at room temperature. When they are heated at an elevated temperature (e.g., 80° C. or higher) after exposure, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, eventually forming an image.

Such photothermographic photosensitive materials have been used as microphotographic and radiographic photosensitive materials. However, only a few have been used as a graphic printing photosensitive material because the image quality is poor for the printing purpose as demonstrated by low maximum density (Dmax) and soft gradation.

With the recent advance of lasers and light-emitting diodes, scanners and image setters having an oscillation wavelength of 600 to 800 nm find widespread use. There is a strong desire to have a high contrast photosensitive material which has so high sensitivity and Dmax that it may comply with such output devices. Also a need for easy and dry processing is increasing.

U.S. Pat. No. 5,464,738 describes that high contrast images are obtainable using sulfonyl hydrazide as a reducing agent for dry silver. U.S. Pat. No. 5,496,695 describes that high contrast images are obtainable using hindered phenol and formylhydrazine or tritylhydrazine as a reducing agent for dry silver.

These image forming processes are characterized by heat development at a high temperature of 120° C. or higher and suffer from several problems associated with formation of high contrast images. One problem is noise known as pepper fog occurring when hydrazines are used. While black pepper is a phenomenon well known for conventional wet development using hydrazines, pepper fog occurring in a dry photothermographic system is considerably different from black pepper of the wet development system in that the occurrence of pepper fog largely depends on heat development temperature and becomes more frequent at higher temperature. In the wet development system wherein black pepper largely depends on the pH of developer, the occurrence of black spots or black pepper can be suppressed by containing an acidic compound or acidic polymer in a photosensitive emulsion layer of photosensitive material. The photothermographic system, on the other hand, has a fully acidic atmosphere because the photosensitive material contains large amounts of an organic fatty acid and an aromatic carboxylic acid (e.g., phthalic acid derivatives) and a bisphenol derivative as a reducing agent. Despite the acidic atmosphere, pepper fog occurs upon heat development at high temperature.

SUMMARY OF THE INVENTION

An object of the present invention is to provide a photothermographic material capable of forming images having high contrast and high Dmax. Another object of the present invention is to provide a photothermographic material for use in the manufacture of printing plates and capable of forming images of quality while minimizing pepper fog.

A further object of the present invention is to provide a photothermographic material for use in the manufacture of printing plates and capable of forming images having high contrast and minimal image enlargement.

In a first aspect, the present invention provides a photothermographic photosensitive material comprising an organic silver salt, a photosensitive silver halide, a reducing agent, an ultrahigh contrast promoting agent, and a compound of the following general formula (II):

$$C—L—D \qquad (II)$$

wherein C is a group for promoting adsorption to the silver halide, D is an acid group, and L is a divalent linking group, said compound having substantially no absorption maximum in the visible region.

In a second aspect, the present invention provides a photothermographic photosensitive material comprising at least one silver halide photosensitive layer on a support, said photosensitive material containing an organic silver salt, a reducing agent, an ultrahigh contrast promoting agent, and at least one member selected from compounds of the general formulae (1) and (2) in said photosensitive layer or a layer adjacent thereto, general formula (1)

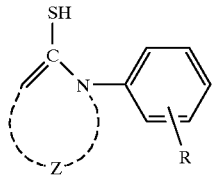

general fromula (2)

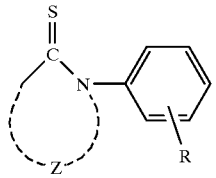

wherein Z is a group of atoms necessary to complete a 5- or 6-membered hetero-aromatic ring containing at least two nitrogen atoms, and R is selected from the group consisting of hydrogen, alkyl, aralkyl, alkoxy, alkyl- or aryl-substituted amino, amide, sulfonamide, ureido, urethane, aryloxy, sulfamoyl, carbamoyl, aryl, alkylthio, arylthio, hydroxy, halogen, cyano, carboxy or salt thereof, sulfo or salt thereof, and phosphoric acid amide.

Typically, the ultrahigh contrast promoting agent is a hydrazine derivative.

DETAILED DESCRIPTION OF THE INVENTION

Briefly stated, a photothermographic material according to the present invention contains a photosensitive silver halide, an organic silver salt, a reducing agent, an ultrahigh contrast promoting agent, and a specific compound.

The ultrahigh contrast promoting agent used herein is described in detail. The ultrahigh contrast promoting agent is an agent which does not function as a developing agent when used alone, but cooperates with a reducing agent as a developing agent to form an ultrahigh contrast image. Therefore, the concept, function and result of a ultrahigh contrast promoting agent are different from a mere combination of reducing agents.

Often the ultrahigh contrast promoting agent is selected from hydrazine derivatives and compounds containing a quaternary nitrogen atom. Hydrazine derivatives useful as the ultrahigh contrast promoting agent are of the following general formula (I).

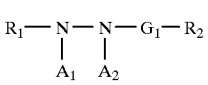

(I)

In formula (I), $R_1$ is an aliphatic or aromatic group. $R_2$ is a hydrogen atom, alkyl, aryl, unsaturated heterocyclic, alkoxy, aryloxy, amino or hydrazino group. $G_1$ is a group represented by:

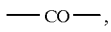

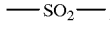

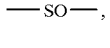

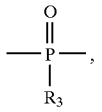

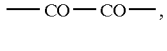

or a thiocarbonyl or iminomethylene group. $A_1$ and $A_2$ are both hydrogen atoms, or one of $A_1$ and $A_2$ is a hydrogen atom and the other is a substituted or unsubstituted alkylsulfonyl group, substituted or unsubstituted arylsulfonyl group or substituted or unsubstituted acyl group. $R_3$ is a group selected from the same range as defined for $R_2$ and may be identical with or different from $R_2$.

In formula (I), the aliphatic groups represented by $R_1$ are preferably those having 1 to 30 carbon atoms, especially normal, branched or cyclic alkyl groups having 1 to 20 carbon atoms. The branched alkyl group may be cyclized so as to form a saturated heterocyclic ring containing one or more hetero atoms. The alkyl group may have a substituent.

In formula (I), the aromatic groups represented by $R_1$ are preferably monocyclic or dicyclic aryl groups and unsaturated heterocyclic groups. The unsaturated heterocyclic group may be fused to a monocyclic or dicyclic aryl group to form a heteroaryl group. Exemplary are monovalent groups derived from benzene, naphthalene, pyridine, pyrimidine, imidazole, pyrazole, quinoline, isoquinoline, benzimidazole, thiazole, and benzothiazole rings. Groups containing a benzene ring are preferred. Aryl is the most preferred group of $R_1$.

The aliphatic or aromatic group represented by $R_1$ may have a substituent. Exemplary substituents include an alkyl group (inclusive of aralkyl groups), alkenyl group, alkynyl group, aryl group, heterocyclic-containing group, pyridinium group, hydroxy group, alkoxy group, aryloxy group, acyloxy group, alkyl or arylsulfonyloxy group, amino group, carbonamide group, sulfonamide group, ureido group, thioureido group, semicarbazide group, thiosemicarbazide group, urethane group, hydrazide structure-bearing group, quaternary ammonium structure-bearing group, alkyl or arylthio group, alkyl or arylsulfonyl group, alkyl or arylsulfinyl group, carboxyl group, sulfo group, acyl group, alkoxy or aryloxycarbonyl group, carbamoyl group, sulfamoyl group, halogen atom, cyano group, nitro group, nitrosyl group, phosphoric acid amide group, diacylamino group, imide group, acyl urea structure-bearing group, selenium or tellurium atom-containing group, and tertiary or quaternary sulfonium structure-bearing group. Desired among these groups are normal, branched or cyclic alkyl groups preferably having 1 to 20 carbon atoms, aralkyl groups, especially monocyclic or dicyclic aralkyl groups whose alkyl moiety has 1 to 3 carbon atoms, alkoxy groups preferably having 1 to 20 carbon atoms, substituted amino groups, especially amino groups having an alkyl substituent of 1 to 20 carbon atoms, acylamino groups preferably having 2 to 30 carbon atoms, sulfonamide groups preferably having 1 to 30 carbon atoms, ureido groups preferably having 1 to 30 carbon atoms, and phosphoric acid amide groups preferably having 1 to 30 carbon atoms.

In formula (I), the alkyl groups represented by $R_2$ are preferably those having 1 to 4 carbon atoms, and the aryl groups are preferably monocyclic or dicyclic aryl groups, for example, a benzene ring-containing group.

The unsaturated heterocyclic groups represented by $R_2$ are preferably 5 or 6-membered rings containing at least one of nitrogen, oxygen and sulfur atoms, for example, imidazolyl, pyrazolyl, triazolyl, tetrazolyl, pyridyl, pyridinium, quinolinium, and quinolinyl groups, with the pyridyl and pyridinium groups being especially preferred.

The alkoxy groups represented by $R_2$ are preferably those having 1 to 8 carbon atoms, the aryloxy groups are preferably monocyclic, the amino groups are preferably unsubstituted amino, alkylamino groups having 1 to 10 carbon atoms, and arylamino groups having up to 10 carbon atoms.

The groups represented by $R_2$ may be substituted ones while preferred substituents are as exemplified for the substituent on $R_1$.

Where $G_1$ is —CO— group, the preferred groups represented by $R_2$ are a hydrogen atom, alkyl groups (e.g., methyl, trifluoromethyl, 3-hydroxypropyl, 3-methanesulfonamidopropyl, and phenylsulfonylmethyl), aralkyl groups (e.g., o-hydroxybenzyl), aryl groups (e.g., phenyl, 3,5-dichlorophenyl, o-methanesulfonamidophenyl, 4-methanesulfonylphenyl, and 2-hydroxymethylphenyl), and $—C_2F_2COOM$ wherein M is a hydrogen atom or alkali metal atom.

Where $G_1$ is $—SO_2—$ group, the preferred groups represented by $R_2$ are alkyl groups (e.g., methyl), aralkyl groups (e.g., o-hydroxybenzyl), aryl groups (e.g., phenyl), and substituted amino groups (e.g., dimethylamino).

Where $G_1$ is a —COCO— group, the preferred groups represented by $R_2$ are alkoxy, aryloxy, and amino groups.

In formula (I), $G_1$ is preferably a —CO— or —COCO— group, most preferably a —CO— group.

$R_2$ may be such a group as to induce cyclization reaction to cleave a $G_1$—$R_2$ moiety from the remaining molecule to generate a cyclic structure containing the atoms of the —$G_1$—$R_2$ moiety. Such examples are described in JP-A 29751/1988, for example, Hydrazine derivatives having at least one nitro or nitrosyl group in $R_1$ or $R_2$ are preferred. Hydrazine derivatives having at least one nitro or nitrosyl group in $R_1$ are especially preferred.

In formula (I), each of $A_1$ and $A_2$ is a hydrogen atom, or a substituted or unsubstituted alkyl or arylsulfonyl group having up to 20 carbon atoms (preferably a phenylsulfonyl group or a phenylsulfonyl group substituted such that the sum of Hammette's substituent constants may be −0.5 or more), or substituted or unsubstituted acyl group having up to 20 carbon atoms (preferably a benzoyl group, a benzoyl group substituted such that the sum of Hammette's substituent constants may be −0.5 or more, or a linear, branched or cyclic, substituted or unsubstituted, aliphatic acyl group wherein the substituent is selected from a halogen atom, ether group, sulfonamide group, carbonamide group, hydroxyl group, carboxyl group and sulfonate group).

Most preferably, both $A_1$ and $A_2$ are hydrogen atoms.

The substituent on $R_1$ and $R_2$ may be further substituted, with preferred examples of the further substituent being those groups exemplified as the substituent on $R_1$. The further substituent, in turn, may be further substituted, the still further substituent, in turn, may be further substituted, and so on. In this way, multiple substitution is acceptable while preferred substituents are those groups exemplified as the substituent on $R_1$.

$R_1$ and $R_2$ in formula (I) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

$R_1$ and $R_2$ in formula (I) may have incorporated therein a group for enhancing adsorption to the surface of silver halide grains. Such adsorptive groups include alkylthio, arylthio, thiourea, heterocyclic thioamide, mercapto heterocyclic and triazole groups as described in U.S. Pat. Nos. 4,385,108 and 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988.

Illustrative, non-limiting, examples of the compound represented by formula (I) are given below.

I-1

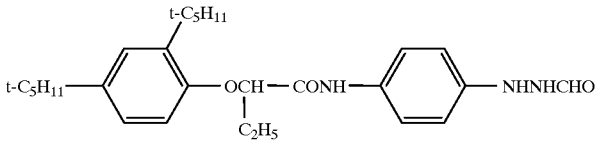

I-2

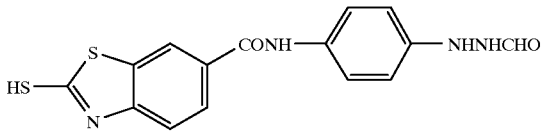

I-3

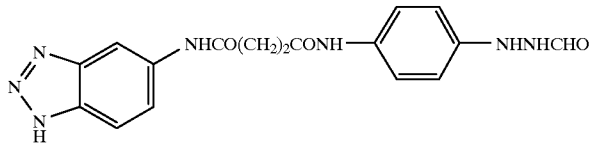

I-4

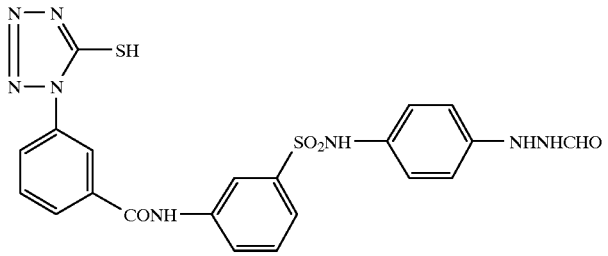

-continued
I-5
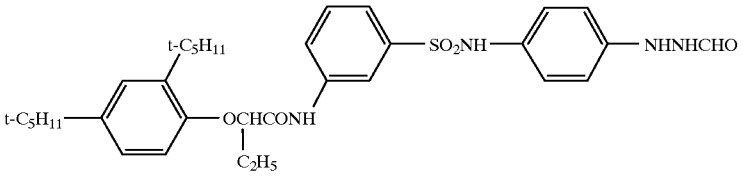
I-6
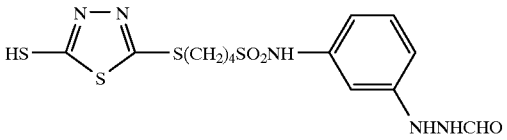
I-7
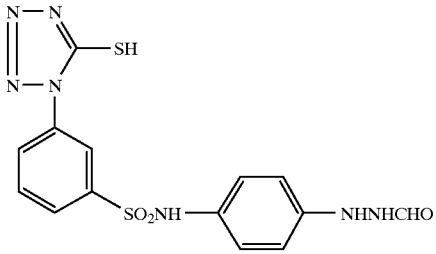
I-8
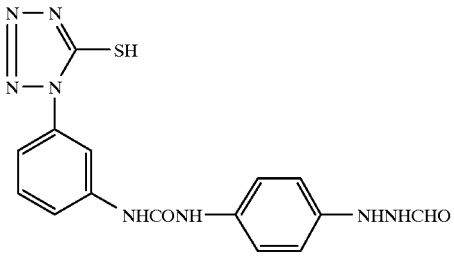
I-9
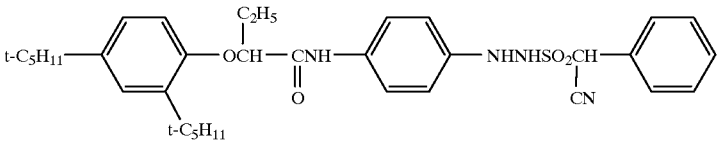
I-10
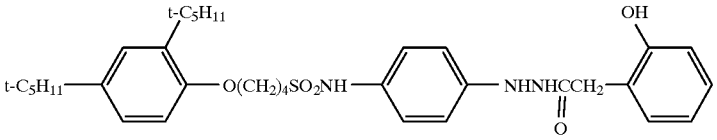
I-11
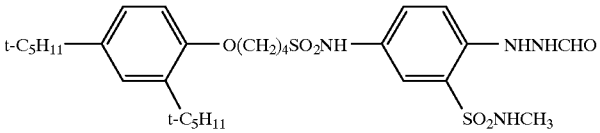

-continued
I-12
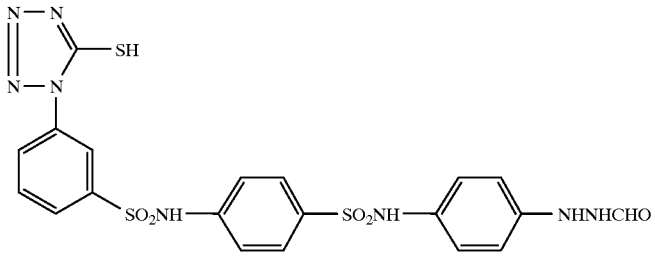
I-13
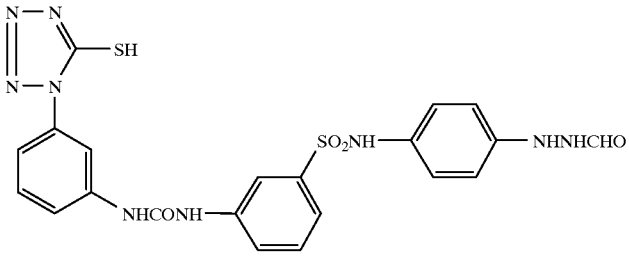
I-14
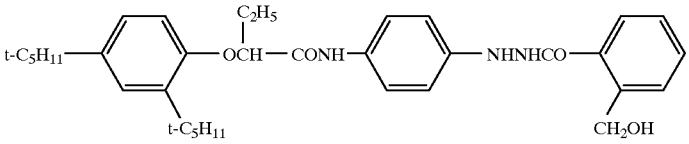
I-15
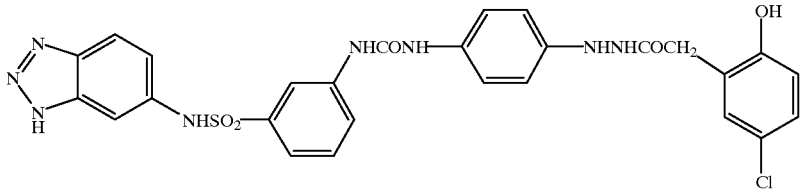
I-16
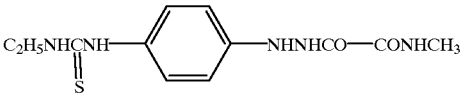
I-17
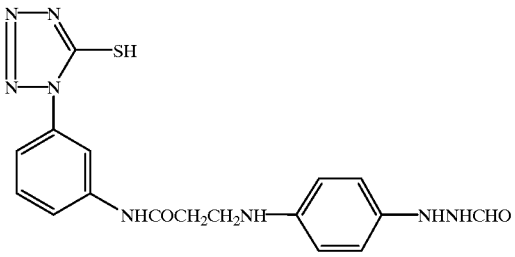

-continued
I-18
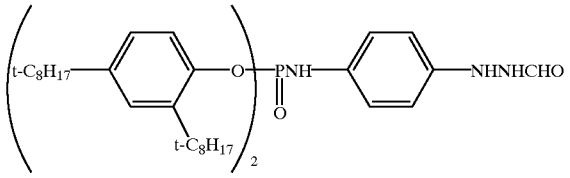
I-19
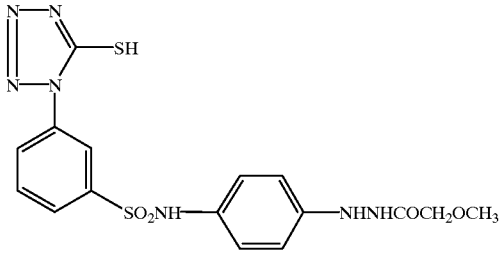
I-20
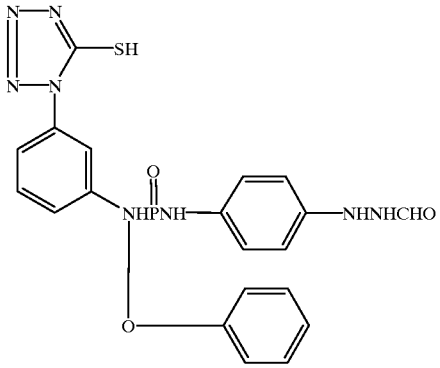
I-21
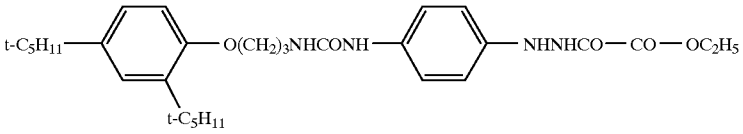
I-22
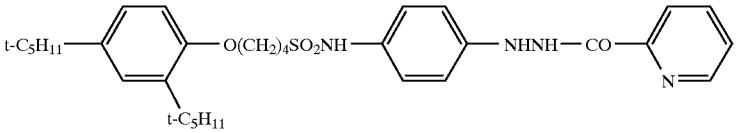

-continued
I-23
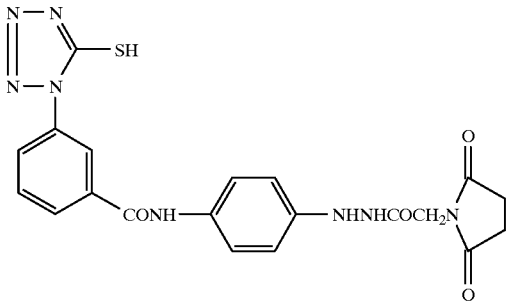
I-24
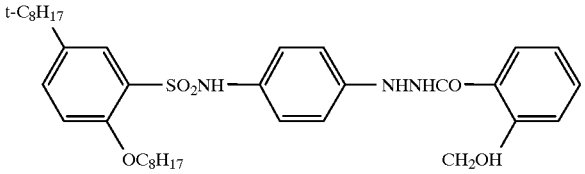
I-25
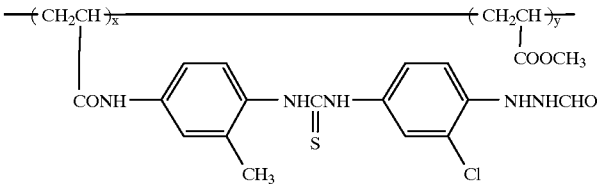
x:y = 3:97
average molecular weight
~100,000
I-26
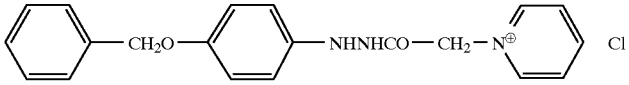
I-27
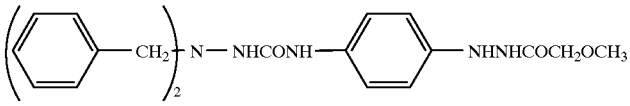
I-28
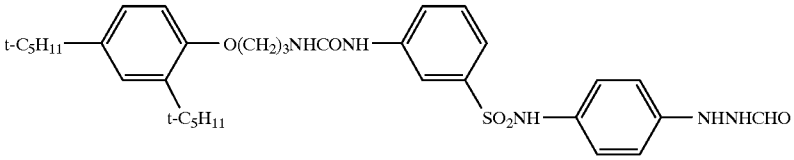
I-29
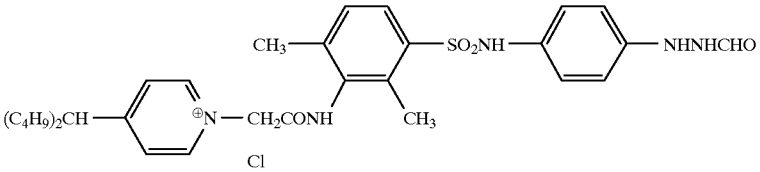

-continued
I-30
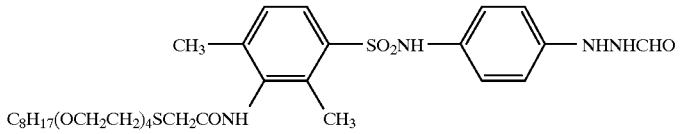
I-31
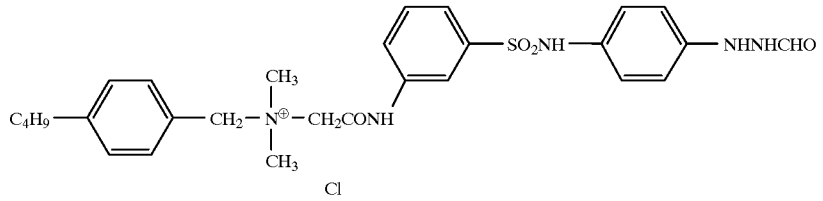
I-32
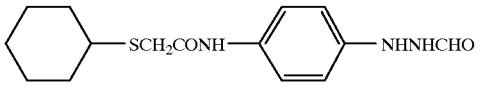
I-33
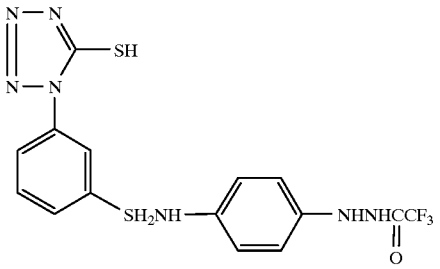
I-34
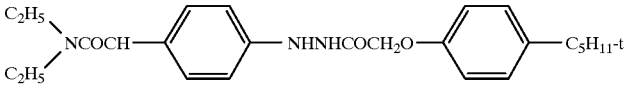
I-35
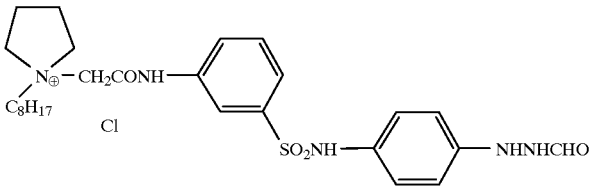
I-36
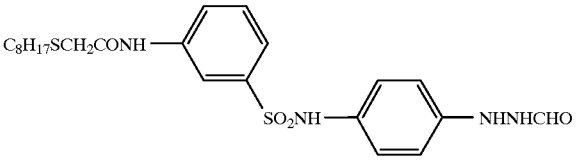

-continued
I-37
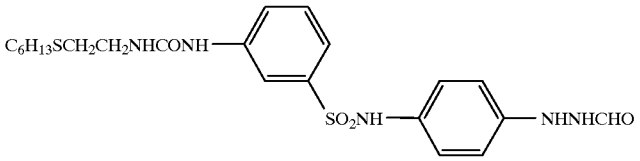
I-38
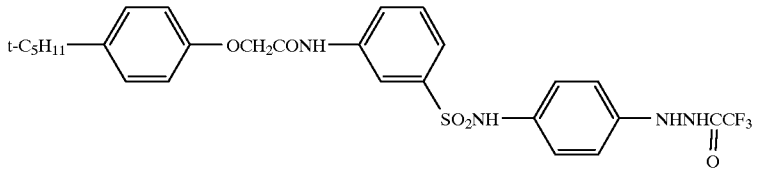
I-39
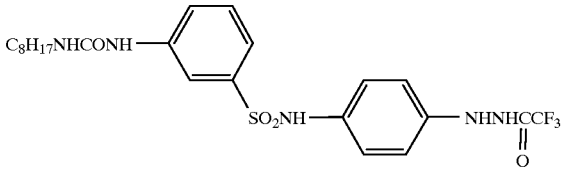
I-40
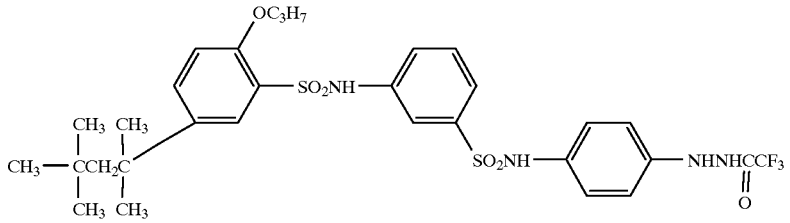
I-41
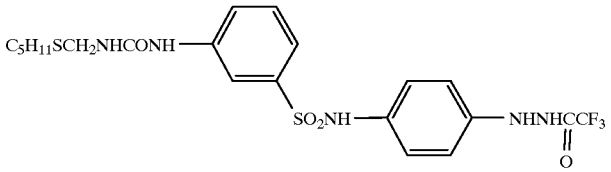
I-42
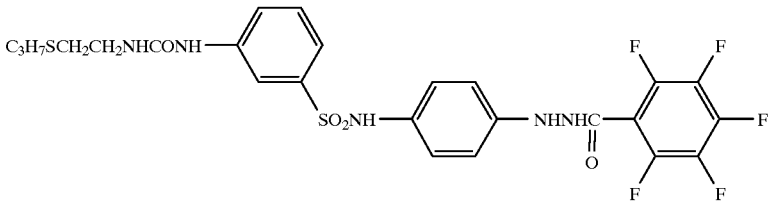
I-43
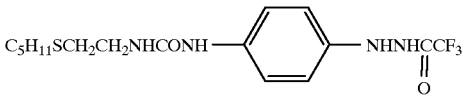

-continued
I-44
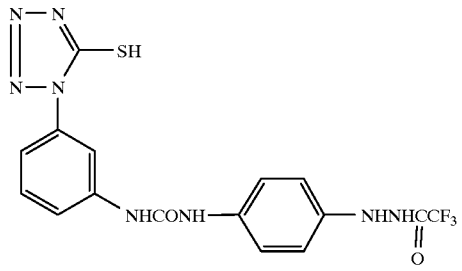
I-45
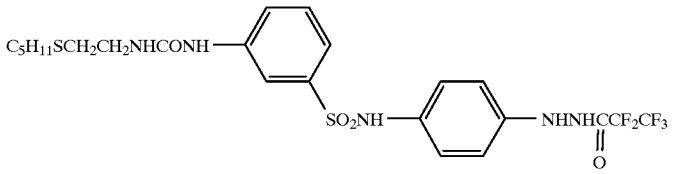
I-46
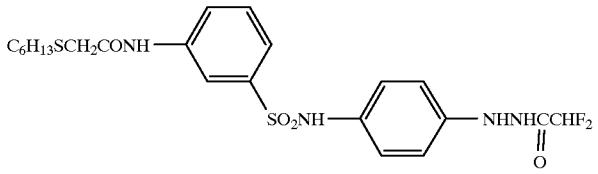
I-47
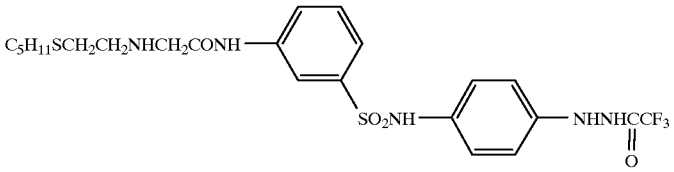
I-48
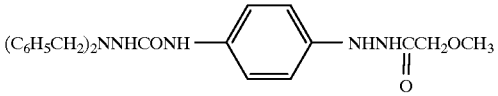
I-49
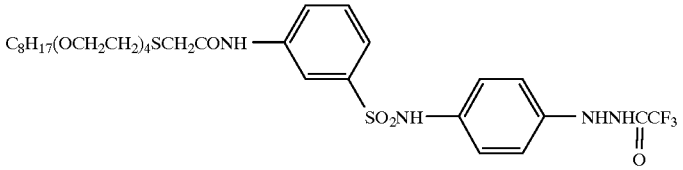
I-50
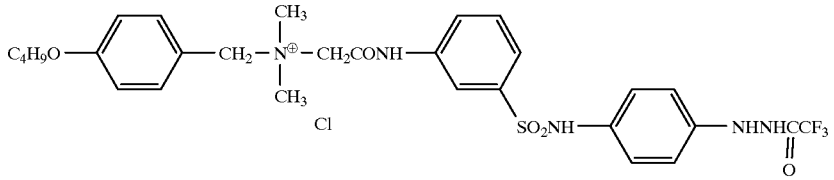

-continued
I-51
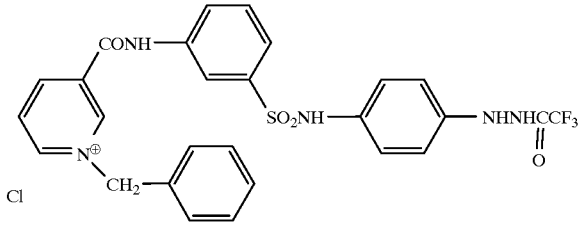
I-52
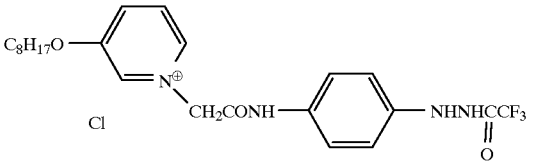
I-53
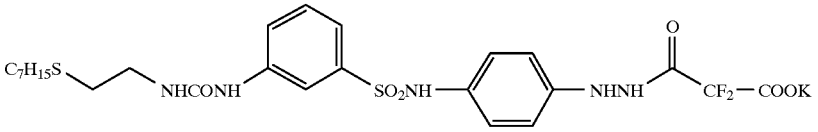
I-54
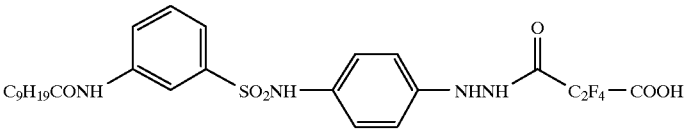
I-55
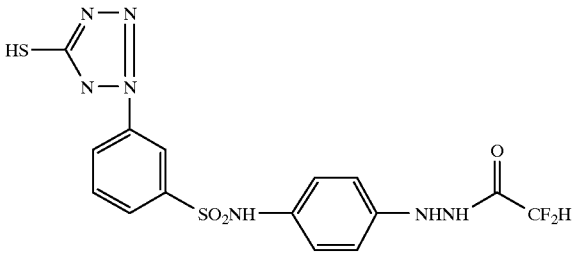
I-56
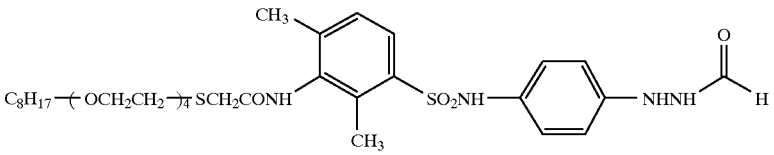
I-57
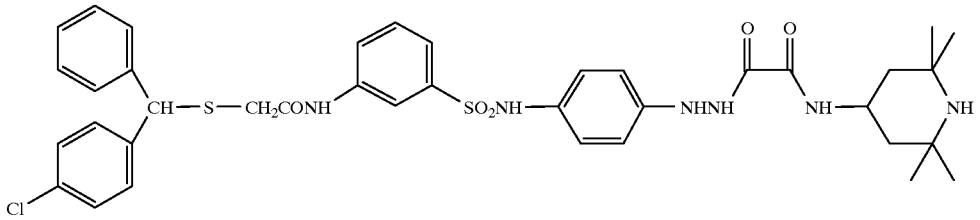

-continued
I-58
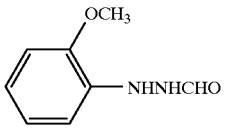
I-59
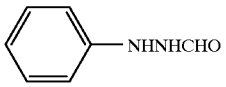
I-60
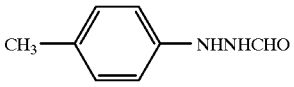
I-61
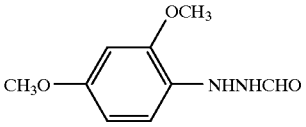
I-62
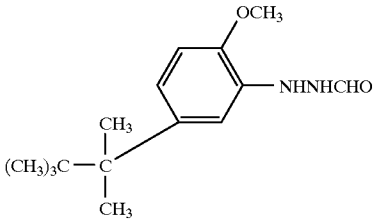
I-63
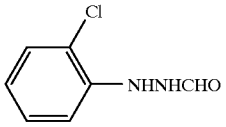
I-64
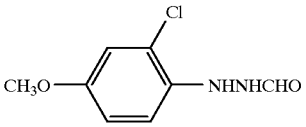
I-65
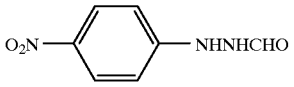
I-66
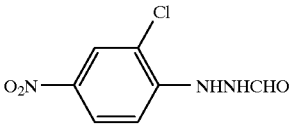

-continued
I-67
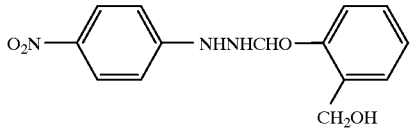
I-68
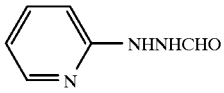
I-69
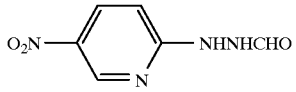
I-70
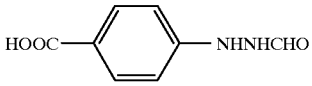
I-71
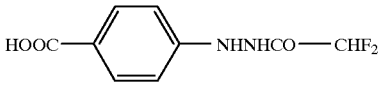
I-72
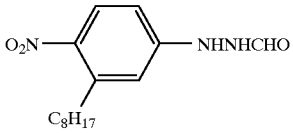
I-73
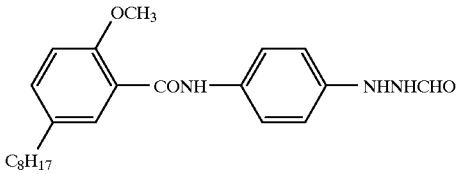
I-74
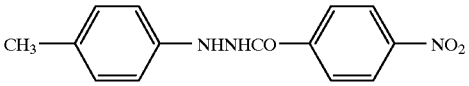
I-75
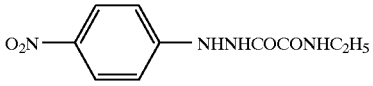
I-76
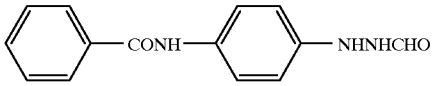

-continued
I-77
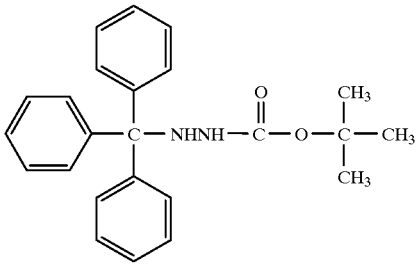
I-78
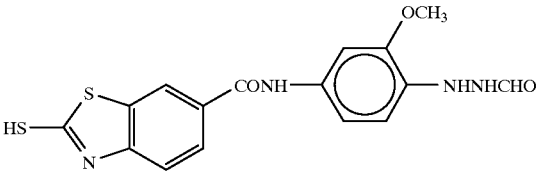
I-79
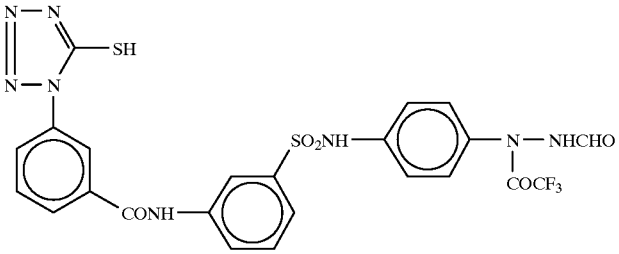
I-80
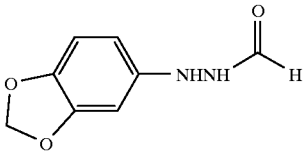
I-81
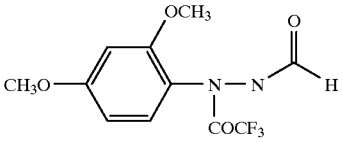
I-82
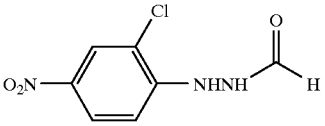
I-83
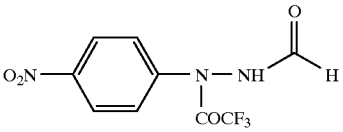

-continued
I-84
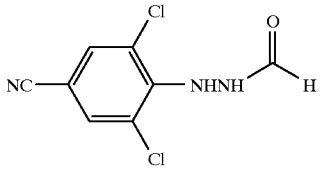
I-85
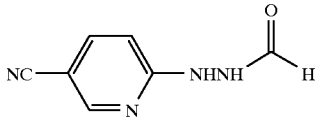
I-86
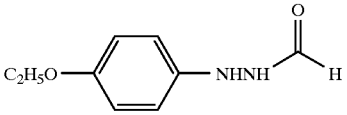
I-87
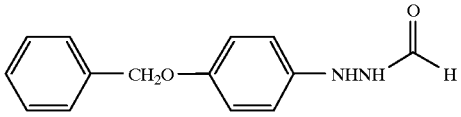
I-88
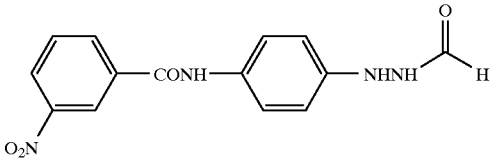
I-89
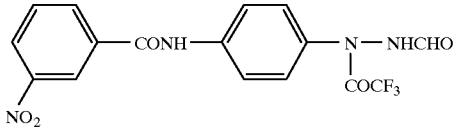
I-90
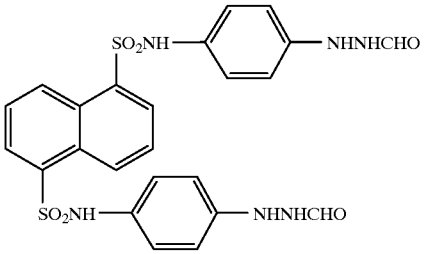
I-91
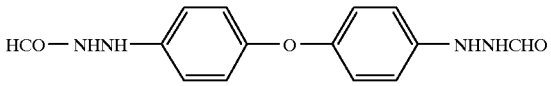
I-92
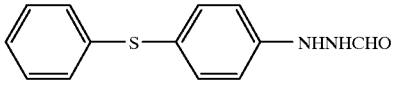

-continued
I-93
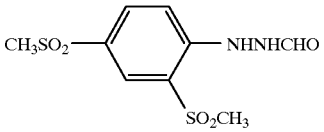
I-94
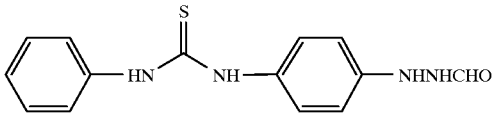
I-95
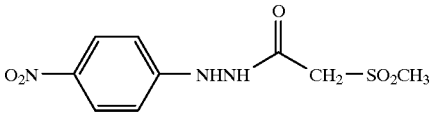
I-96
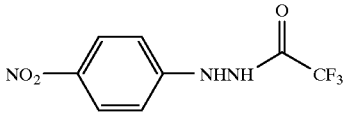
I-97
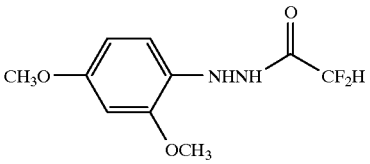
I-98
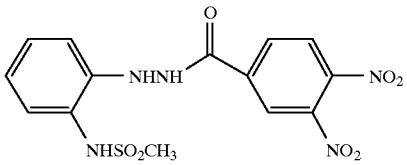
I-99
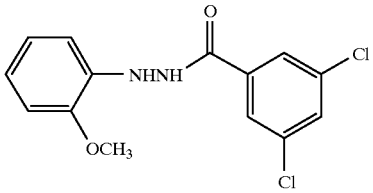
I-100
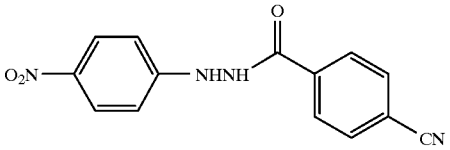
I-101
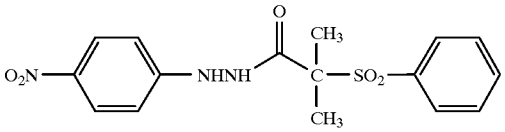

-continued
I-102
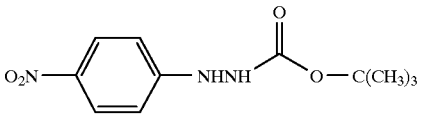
I-103
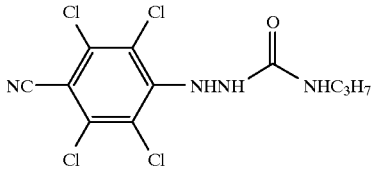
I-104
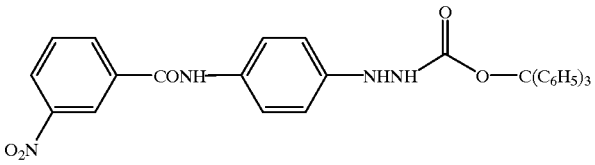
I-105
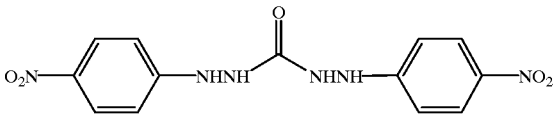
I-106
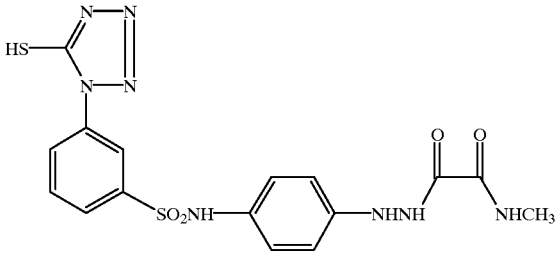
I-107
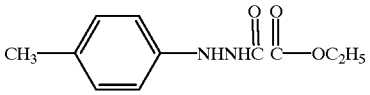
I-108
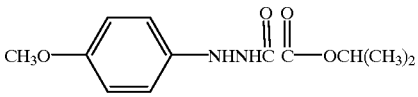
I-109
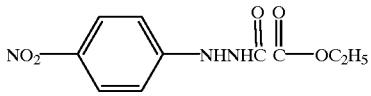
I-110
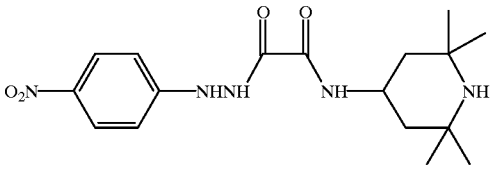

-continued
I-111
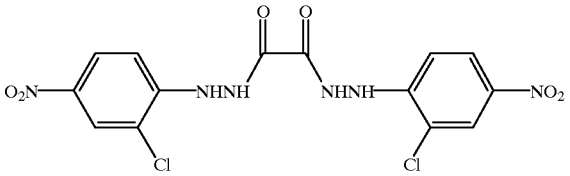
I-112
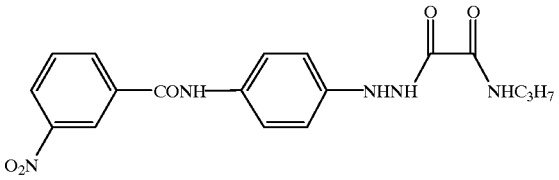
I-113
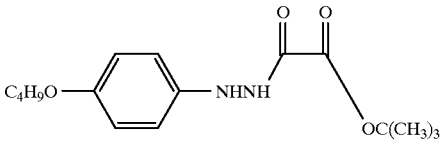
I-114
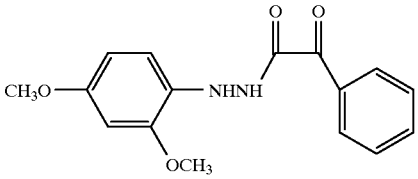
I-115
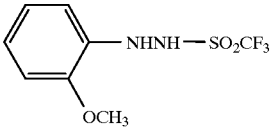
I-116
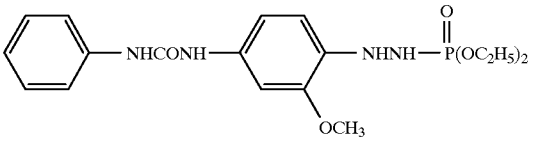
I-117
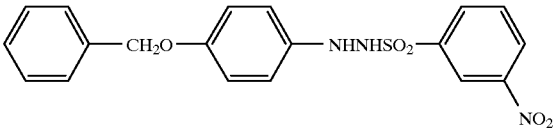
I-118
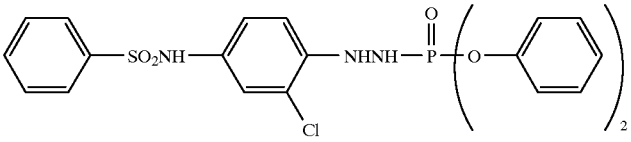

-continued

I-119

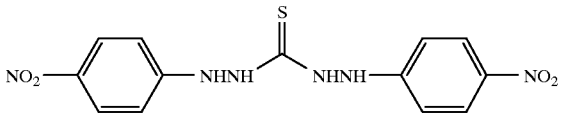

I-120

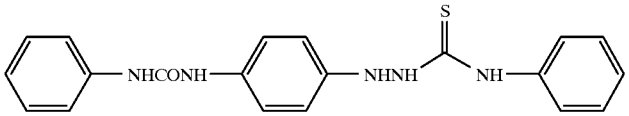

In addition to the above-mentioned examples, the hydrazine derivatives which can be used herein include those examples described in Research Disclosure, Item 23516 (November 1983, page 346), the references cited therein, and the following patents.

| | | | |
|---|---|---|---|
| U.S. Pat. Nos. | 4,080,207 | 4,269,929 | 4,276,364 |
| | 4,278,748 | 4,385,108 | 4,459,347 |
| | 4,478,928 | 4,560,638 | 4,686,167 |
| | 4,912,016 | 4,988,604 | 4,994,365 |
| | 5,041,355 | 5,104,769 | |
| UKP | 2,011,391B | | |
| EP | 217,310 | 301,799 | 356,898 |
| JP-A | 179734/1985 | 170733/1986 | 270744/1986 |
| | 178246/1987 | 270948/1987 | 29751/1988 |
| | 32538/1988 | 104047/1988 | 121838/1988 |
| | 129337/1988 | 223744/1988 | 234244/1988 |
| | 234245/1988 | 234246/1988 | 294552/1988 |
| | 306438/1988 | 10233/1989 | 90439/1989 |
| | 100530/1989 | 105941/1989 | 105943/1989 |
| | 276128/1989 | 280747/1989 | 283548/1989 |
| | 283549/1989 | 285940/1989 | 2541/1990 |
| | 77057/1990 | 139538/1990 | 196234/1990 |
| | 196235/1990 | 198440/1990 | 198441/1990 |
| | 198442/1990 | 220042/1990 | 221953/1990 |
| | 221954/1990 | 285342/1990 | 285343/1990 |
| | 289843/1990 | 302750/1990 | 304550/1996 |
| | 37642/1991 | 54549/1991 | 125134/1991 |
| | 184039/1991 | 240036/1991 | 240037/1991 |
| | 259240/1991 | 280038/1991 | 282536/1991 |
| | 51143/1992 | 56842/1992 | 84134/1992 |
| | 230233/1990 | 96053/1992 | 216544/1992 |
| | 45761/1993 | 45762/1993 | 45763/1993 |
| | 45764/1993 | 45765/1993 | |

Japanese Patent Application No. 94925/1993

Besides, the following hydrazine derivatives are also useful. Exemplary compounds include the compounds of the chemical formula [1] in JP-B 77138/1994, more specifically the compounds described on pages 3 and 4 of the same; the compounds of the general formula (1) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; and the compounds of the general formulae (H) and (Ha) in JP-A 104426/1995, more specifically compounds H-1 to H-44 described on pages 8 to 15 of the same.

The hydrazine derivative is preferably used in an amount of $1\times10^{-6}$ mol to $1\times10^{-1}$ mol, more preferably $1\times10^{-5}$ mol to $5\times10^{-2}$ mol per mol of total silver available from the organic silver salt and silver halide combined.

In the practice of the invention, the hydrazine derivative is used as a solution in a suitable organic solvent such as alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method is used for dissolving the hydrazine derivative with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

In the practice of the invention, an indazole, typically nitroindazole is preferably used as an antifoggant in combination with the hydrazine derivative.

In the photothermographic photosensitive material of the invention, a nucleation promoter is preferably added in combination with the hydrazine derivative. The nucleation promoter used herein includes amine derivatives, onium salts, disulfide derivatives, and hydroxylamine derivatives. Examples of the nucleation promoter are compounds A-1 to A-47 described in Japanese Patent Application No. 266204/1995.

The other typical ultrahigh contrast promoting agent is a compound containing a quaternary nitrogen atom, which is generally selected from pyridinium compounds of the following formulae (Pa), (Pb) and (Pc), quinolinium compounds, and tetrazolium compounds of the formula (T) shown later. First, the pyridinium compounds are described.

(Pa)

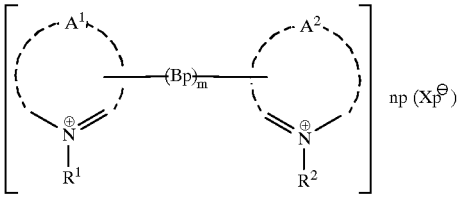

(Pb)

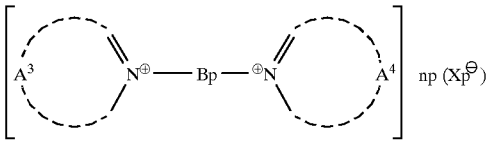

(Pc)

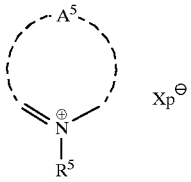

In formulae (Pa), (Pb) and (Pc), each of $A^1$, $A^2$, $A^3$, $A^4$, and $A^5$ is a group of non-metallic atoms necessary to complete a nitrogenous heterocyclic ring which may contain an oxygen, nitrogen or sulfur atom and have a benzene ring fused thereto. The heterocyclic ring formed by $A^1$, $A^2$, $A^3$, $A^4$ or $A^5$ may have a substituent which may be identical or different among $A^1$, $A^2$, $A^3$, $A^4$, and $A^5$. Exemplary substituents include alkyl, aryl, aralkyl, alkenyl, alkynyl, halogen, acyl, alkoxycarbonyl, aryloxycarbonyl, sulfo, carboxy, hydroxy, alkoxy, aryloxy, amide, sulfamoyl, carbamoyl, ureido, amino, sulfonamide, sulfonyl, cyano, nitro, mercapto, alkylthio, and arylthio groups. Preferred exemplary rings formed by $A^1$, $A^2$, $A^3$, $A^4$, and $A^5$ are five and six-membered rings such as pyridine, imidazole, thiozole, oxazole, pyrazine, and pyrimidine rings, with the pyridine ring being most preferred.

Bp is a divalent linking group which is selected from an alkylene group, arylene group, alkenylene group, —$SO_2$—, —SO—, —O—, —S—, —CO—, and —N($R^6$)— wherein $R^6$ is an alkyl group, aryl group or hydrogen atom, alone or in admixture. Preferably Bp is an alkylene or alkenylene group.

Each of $R^1$, $R^2$, and $R^5$ is an alkyl group having 1 to 20 carbon atoms. $R^1$ and $R^2$ may be the same or different. The alkyl group may be a substituted or unsubstituted one, with exemplary substituents being the same as those exemplified as the substituent on $A^1$, $A^2$, $A^3$, $A^4$, and $A^5$. Preferably, each of $R^1$, $R^2$, and $R^5$ is an alkyl group having 4 to 10 carbon atoms. More preferred are unsubstituted alkyl groups or aryl-substituted alkyl groups.

Xp is a counter ion necessary to provide an electric charge balance throughout the molecule, for example, a chloride, bromide, iodide, nitrate, sulfate, p-toluene-sulfonate, and oxalate ion. Letter np represents a number of counter ions necessary to provide an electric charge balance throughout the molecule, with np=0 in the case of an intramolecular salt.

Illustrative, non-limiting, examples of the pyridinium compound which can be used herein are given below.

P-1

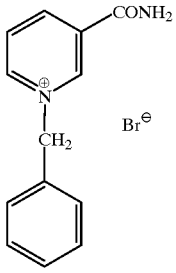

P-2

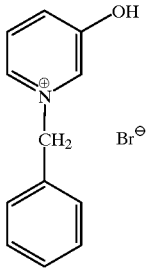

-continued
P-3
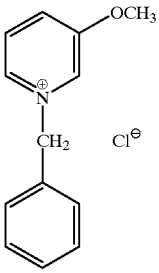
P-4
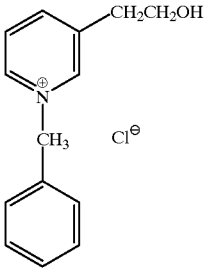
P-5
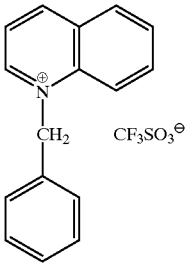
P-6
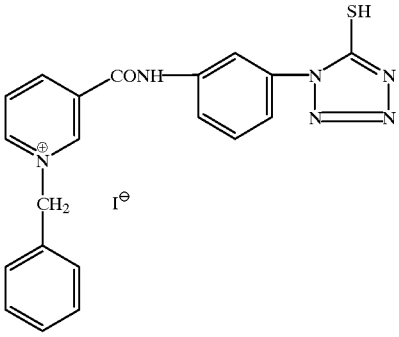
P-7
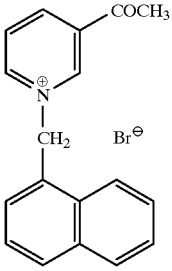

-continued
P-8
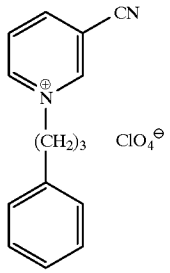
P-9
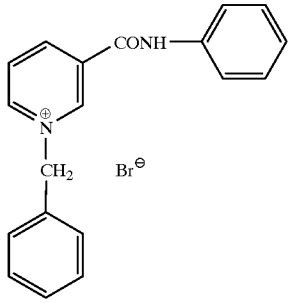
P-10
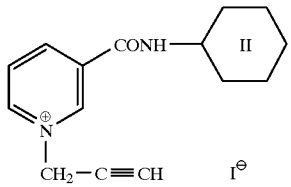
P-11
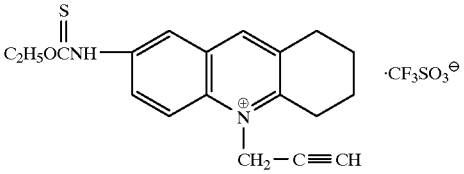
P-12
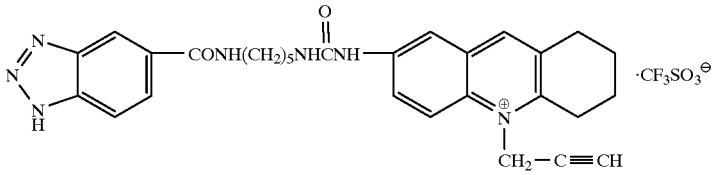
P-13
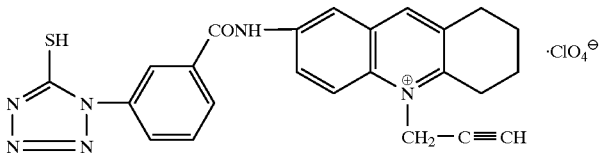
P-14
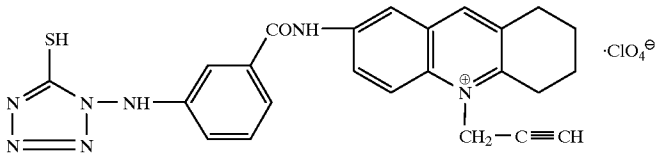

-continued
P-15
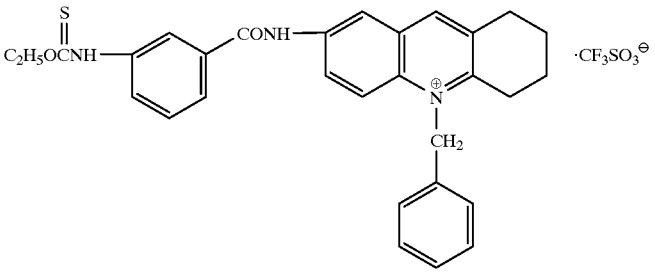
P-16
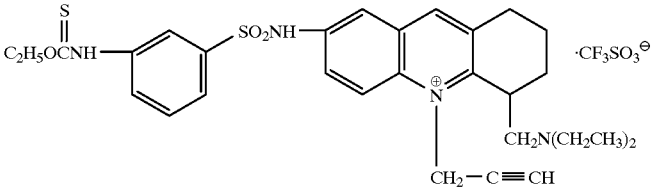
P-17
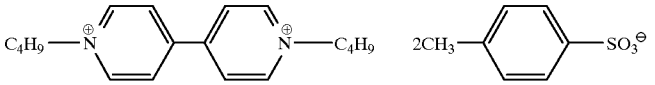
P-18
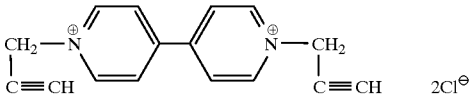
P-19
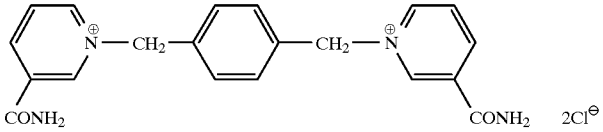
P-20
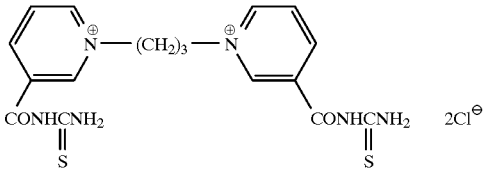
P-21
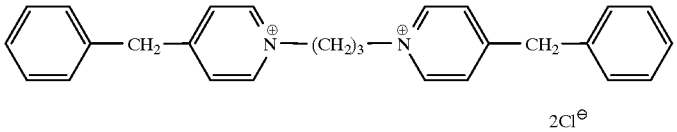
P-22
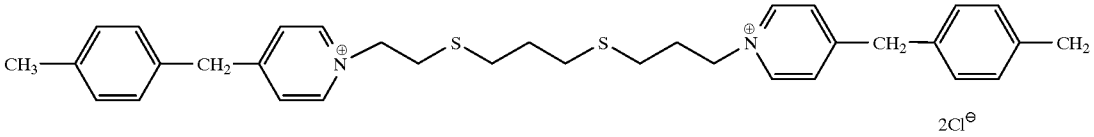
P-23
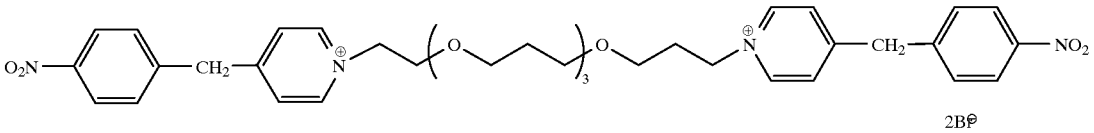

-continued

P-24

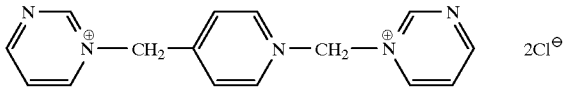

P-25

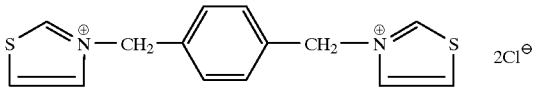

P-26

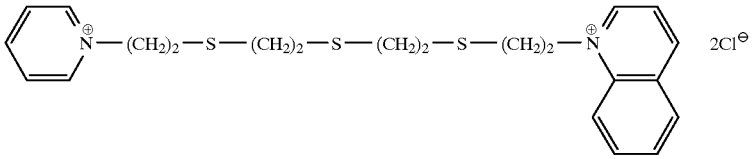

Another example of the compound containing a quaternary nitrogen atom is a triphenyltetrazolium compound of the following formula (T).

(T)

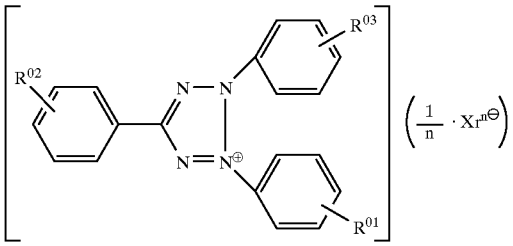

In formula (T), each of substituents $R^{01}$, $R^{02}$ and $R^{03}$ on the phenyl group is preferably a hydrogen atom or electron attractive group having a negative Hammette's sigma value ($\sigma_p$). Hammette's sigma value associated with phenyl substitution is found in the literature, for example, the article of C. Hansch et al. in Journal of Medical Chemistry, vol. 20, 304 (1977), Preferred groups having a negative Hammette's sigma value include methyl ($\sigma_p$=−0.17), ethyl (−0.15), cyclopropyl (−0.21), n-propyl (−0.13), isopropyl (−0.15), cyclobutyl (−0.15), n-butyl (−0.16), isobutyl (−0.20), n-pentyl (−0.15), cyclohexyl (−0.22), amino (−0.66), acetylamino (−0.15), hydroxyl (−0.37), methoxy (−0.27), ethoxy (−0.24), propoxy (−0.25), butoxy (−0.32), and pentoxy (−0.34). All these groups are useful as the substituent on the compound of formula (T).

Letter n is equal to 1 or 2. The anion represented by $Xr^{n-}$ includes, for example, halide ions such as chloride, bromide and iodide ions; residues of inorganic acids such as nitric acid, sulfuric acid and perchloric acid; residues of organic acids such as sulfonic acid and carboxylic acids; and anionic surfactants, for example, lower alkylbenzenesulfonate anions such as p-toluenesulfonate anion, higher alkylbenzenesulfonate anions such as p-dodecylbenzenesulfonate anion, highly alkyl sulfate anions such as lauryl sulfate anion, borate anions such as tetraphenylboron, dialkylsulfosuccinate anions such as di-2-ethylhexylsulfosuccinate anion, polyether alcohol sulfate anions such as cetyl polyethenoxysulfate anion, higher aliphatic anions such as stearate anion, and polymers with an acid residue attached such as polyacrylate anion.

Illustrative, non-limiting, examples of the tetrazolium compound of formula (T) are shown below using a combination of $R^{01}$, $R^{02}$, $R^{03}$, and $Xr^{n-}$.

| Compound No. | $R^{01}$ | $R^{02}$ | $R^{03}$ | $Xr^{n\ominus}$ |
|---|---|---|---|---|
| T-1 | H | H | p-$CH_3$ | $Cl^{\ominus}$ |
| T-2 | p-$CH_3$ | H | p-$CH_3$ | $Cl^{\ominus}$ |
| T-3 | p-$CH_3$ | p-$CH_3$ | p-$CH_3$ | $Cl^{\ominus}$ |
| T-4 | H | p-$CH_3$ | p-$CH_3$ | $Cl^{\ominus}$ |
| T-5 | p-$OCH_3$ | p-$CH_3$ | p-$CH_3$ | $Cl^{\ominus}$ |
| T-6 | p-$OCH_3$ | H | p-$CH_3$ | $Cl^{\ominus}$ |
| T-7 | p-$OCH_3$ | H | p-$OCH_3$ | $Cl^{\ominus}$ |
| T-8 | m-$C_2H_5$ | H | m-$C_2H_5$ | $Cl^{\ominus}$ |
| T-9 | p-$C_2H_5$ | p-$C_2H_5$ | p-$C_2H_5$ | $Cl^{\ominus}$ |
| T-10 | p-$C_3H_7$ | H | p-$C_3H_7$ | $Cl^{\ominus}$ |
| T-11 | p-iso$C_3H_7$ | H | p-iso$C_3H_7$ | $Cl^{\ominus}$ |
| T-12 | p-$OC_2H_5$ | H | p-$OC_2H_5$ | $Cl^{\ominus}$ |
| T-13 | p-$OCH_3$ | H | p-iso$C_3H_7$ | $Cl^{\ominus}$ |
| T-14 | H | H | p-n$C_{12}H_{25}$ | $Cl^{\ominus}$ |
| T-15 | p-n$C_{12}H_{25}$ | H | p-n$C_{12}H_{25}$ | $Cl^{\ominus}$ |
| T-16 | H | p-$NH_2$ | H | $Cl^{\ominus}$ |
| T-17 | p-$NH_2$ | H | H | $Cl^{\ominus}$ |
| T-18 | p-$CH_3$ | H | p-$CH_3$ | $ClO_4^{\ominus}$ |

The above-mentioned tetrazolium compounds can be readily synthesized according to the method described in Chemical Reviews, vol. 55, pages 335–483, for example. The tetrazolium compounds of formula (T) may be used alone or in admixture of two or more in any desired ratio.

The pyridinium and tetrazolium compounds which are used as the ultrahigh contrast promoting agent according to the invention may be used to any layer which is disposed on the same side of the support as the silver halide emulsion layer although they are preferably added to the silver halide emulsion layer or a layer disposed adjacent thereto. Although the optimum amount of the pyridinium or tetrazolium compound added varies with the size and composition of silver halide grains, degree of chemical sensitization and the type of inhibitor, the amount is preferably $1\times10^{-6}$ mol to $1\times10^{-1}$ mol, more preferably $1\times10^{-5}$ mol to $1\times10^{-2}$ mol per mol of silver halide as in the case of hydrazine derivatives.

In a first embodiment, a specific compound is contained for suppressing occurrence of pepper fog.

This compound concurrently possesses a silver halide adsorbing group and an acid group and has substantially no absorption maximum in the visible region typically of at least 440 nm. The compound is of the following general formula (II):

C—L—D (II)

wherein C is a group for promoting adsorption to the silver halide, D is an acid group, and L is a divalent linking group.

The compound having "substantially no absorption maximum in the visible region" means that the residual color left by the compound on a photographic photosensitive material has a tone of the level raising no practical problem or lower level, more specifically the residual color left by the compound after development step has a tone of the level raising no practical problem or lower level. Preferably the compound should have the absorption maximum in methanol at a wavelength of 460 nm or shorter, especially 430 nm or shorter.

The group for promoting adsorption to the silver halide, represented by C, encompasses all commonly used such groups, for example, a group having a thioamide component, a mercapto group, a heterocyclic group, a group in the form of a radical of a cyanine or merocyanine compound with one hydrogen atom eliminated, and a group in the form of a combination of two or more of the foregoing groups.

The thioamide adsorption promoting group represented by C is characterized by containing a divalent thioamide group as represented by —(C═S)-amino-. This thioamide group may be a part of a 5- or 6-membered heterocyclic ring. Useful thioamide adsorption promoting groups include commonly used thioamide adsorption promoting groups as disclosed, for example, in U.S. Pat. Nos. 4,030,925, 4,031,127, 4,080,207, 4,245,037, 4,255,511, 4,266,013, 4,276,364, Research Disclosure, Vol. 151, November 1976, Item 15,162, and ibid., Vol. 170, December 1978, Item 17,626.

Especially preferred thioamide groups are represented by the following formula (III).

$$R^4—E—(C=S)—E'— \quad (III)$$

In formula (III), one of E and E' is —N($R^5$)— and the other is —O—, —S— or —N($R^6$)—, and $R^4$ is a hydrogen atom, aliphatic group or aromatic group or completes a 5- or 6-membered heterocyclic ring with E or E'. $R^5$ or $R^6$ in E is a hydrogen atom, aliphatic group or aromatic group. $R^5$ or $R^6$ in E' is a hydrogen atom or benzyl substituent when E' is directly attached to an aromatic ring and is otherwise selected from the same substituents as described for E. At least one of $R^4$, $R^5$ and $R^6$ is a hydrogen atom. The aliphatic groups represented by $R^4$, $R^5$ and $R^6$ may be identical or different and include alkyl groups having 1 to 18 carbon atoms (e.g., methyl, ethyl and hexadecyl), alkenyl groups having 2 to 18 carbon atoms (e.g., allyl and 2-butenyl), alkynyl groups having 2 to 18 carbon atoms (e.g., propargyl), and cycloalkyl groups having 3 to 12 carbon atoms (e.g., cyclohexyl). The aromatic groups represented by $R^4$, $R^5$ and $R^6$ may be identical or different and include aryl groups having 6 to 20 carbon atoms (e.g., phenyl and naphthyl).

$R^4$, $R^5$ and $R^6$ may have a suitable substituent. Exemplary substituents include alkyl groups preferably having 1 to 18 carbon atoms (e.g., methyl, ethyl, hexyl and isobutyl), alkenyl groups preferably having 2 to 18 carbon atoms (e.g., vinyl, allyl and butynyl), alkynyl groups preferably having 2 to 18 carbon atoms (e.g., ethynyl, propargyl and butynyl), aralkyl groups preferably having 7 to 20 carbon atoms (e.g., benzyl), aromatic groups preferably having 6 to 20 carbon atoms (e.g., phenyl and naphthyl), hydroxyl groups, aliphatic oxy groups (including alkoxy, alkenyloxy, and alkynyloxy groups preferably those having 1 to 18 carbon atoms, such as methoxy, ethoxy, allyloxy, propargyloxy and butynyloxy), aromatic oxy groups preferably having 6 to 20 carbon atoms (e.g., phenyloxy), halogen atoms (e.g., fluorine, chlorine, bromine and iodine), amino groups, substituted amino groups preferably having 1 to 18 carbon atoms (e.g., methylamino, dimethylamino, hexylamino, and phenylamino), aliphatic thio groups preferably having 1 to 18 carbon atoms (e.g., methylthio and hexylthio), aromatic thio groups preferably having 6 to 20 carbon atoms (e.g., phenylthio), acyloxy groups preferably having 1 to 18 carbon atoms (e.g., acetoxy and benzoxy), sulfonyloxy groups preferably having 1 to 18 carbon atoms (e.g., methanesulfonyloxy and toluenesulfonyloxy), acylamino groups preferably having 1 to 18 carbon atoms (e.g., acetylamino and benzoylamino), sulfonylamino groups preferably having 1 to 18 carbon atoms (e.g., methanesulfonylamino and benzenesulfonylamino), carboxyl groups, aliphatic oxycarbonyl groups preferably having 1 to 18 carbon atoms (e.g., methoxycarbonyl and butyloxycarbonyl), aromatic oxycarbonyl groups preferably having 7 to 20 carbon atoms (e.g., phenoxycarbonyl), acyl groups preferably having 1 to 20 carbon atoms (e.g., formyl, acetyl and benzoyl), carbamoyl groups, N-substituted carbamoyl groups preferably having 2 to 20 carbon atoms (e.g., N-methylcarbamoyl, N-isobutylcarbamoyl and N-phenylcarbamoyl), sulfamoyl groups, N-substituted sulfamoyl groups preferably having 1 to 18 carbon atoms (e.g., N-methylsulfamoyl, N,N-dimethylsulfamoyl, N-butynylsulfamoyl and N-phenylsulfamoyl), sulfo groups, cyano groups, ureido groups, substituted ureido groups preferably having 2 to 20 carbon atoms (e.g., 3-methylureido, 3-allylureido and 3-phenylureido), substituted urethane groups preferably having 2 to 20 carbon atoms (e.g., methoxycarbonylamino, cyclohexyloxycarbonylamino and phenoxycarbonylamino), carbonate ester groups preferably having 2 to 20 carbon atoms (e.g., ethoxycarbonyloxy, oxycarbonyloxy and phenoxycarbonyloxy), and substituted or unsubstituted imino groups preferably having up to 18 carbon atoms (e.g., N-methylimino and N-phenylimino). The aforementioned substituents may have similar substituents thereon.

Preferably, $R^5$ and $R^6$ in E' are hydrogen.

Where both E and E' are amino groups, the adsorption promoting group is a thiourea group. Other than hydrogen, preferred groups represented by $R^4$ and $R^5$ or $R^6$ in E are substituted alkyl groups, for example, alkoxyalkyl groups (e.g., methoxyethyl), haloalkyl groups (e.g., perhaloalkyl groups including trifluoromethyl and homologues), aralkyl groups (e.g., phenylalkyl and naphthylalkyl), unsubstituted alkyl groups (e.g., methyl and hexyl), and aryl groups (e.g., phenyl, naphthyl, alkylphenyl, cyanophenyl, halophenyl and alkoxyphenyl).

$R^4$, $R^5$ and $R^6$ generally have 1 to 18 carbon atoms, preferably up to 8 carbon atoms.

Where the thiocarbonyl group is attached to an oxy group such as $R^4$—O—, the resulting group is a thiourethane group. Where the thiocarbonyl group is attached to a thio group such as $R^4$—S—, the resulting group is a dithiocarbamate group. It is rather preferred that among E and E', E is —O— or —S—. It is further preferred that E is —O— rather than —S—.

Where E or E' forms a heterocyclic ring with $R^4$, the ring is preferably 5- or 6-membered.

Preferred rings formed by E' and $R^4$ are those found as an acidic nucleus in merocyanine dyes, for example, 4-thiazoline-2-thione, thiazoline-2-thione, 4-oxazoline-2-thione, oxazolidine-2-thione, 2-pyrazoline-5-thione, 4-imidazoline-2-thione, 2-thiohydantoin, rhodanine, isorhodanine, 2-thio-2,4-oxazolidinedione, thiobarbituric acid, 1,3,4-thiadiazoline-2-thione, and 1,3,4-oxadiazoline-2-thione. These groups may have a suitable substituent as mentioned for $R^4$.

Where E forms a heterocyclic ring with $R^4$, exemplary rings are the same as will be described later for the heterocyclic ring of C. Preferred examples include pyrrole, pyrroline, pyrrolidine, piperidine, morpholine, piperazine, and indole.

The mercapto group represented by C includes aliphatic mercapto groups, aromatic mercapto groups, and heterocyclic mercapto groups (wherein the atom adjoining the carbon to which a SH group is attached is not a nitrogen atom).

The aliphatic mercapto groups include mercaptoalkyl groups (such as mercaptoethyl and mercaptopropyl), mercaptoalkenyl groups (such as mercaptopropenyl), and mercaptoalkynyl groups (such as mercaptobutynyl). The aromatic mercapto groups include mercaptophenyl and mercaptonaphthyl. The heterocyclic mercapto groups include 4-mercaptopyridine, 5-mercaptoquinolinyl and 6-mercaptobenzothiazolyl.

The heterocyclic group represented by C includes 5- and 6-membered heterocyclic rings formed by a combination of nitrogen, oxygen or sulfur with carbon. Preferred examples of the heterocyclic ring include benzotriazole, triazole, tetrazole, indazole, benzimidazole, imidazole, benzothiazole, thiazole, benzoxazole, oxazole, thiadiazole, oxadiazole, and triazine rings. These heterocyclic rings may have a suitable substituent thereon, with exemplary substituents being as exemplified for the substituent on $R^4$.

The heterocyclic rings are preferably benzotriazole, triazole, tetrazole, and indazole, with benzotriazole and indazole being especially preferred.

Illustrative preferred examples of the heterocyclic group include benzotriazol-5-yl, 6-chlorobenzotriazol-5-yl, benzotriazole-5-carbonyl, 5-phenyl-1,3,4-triazol-2-yl, 4-(5-methyl-1,3,4-triazol-2-yl)benzoyl, 1H-tetrazol-5-yl, and 3-cyanoindazol-5-yl.

The group in the form of a radical of a cyanine or merocyanine compound represented by C has substantially no absorption maximum in the visible region and is selected from monomethinecyanines and apomerocyanines, for example. More specifically, the group is selected from cyanines of the following general formula (IV) and merocyanines of the following general formula (V).

As to the above-mentioned monomethinecyanines and apomerocyanines, specifically cyanines of formula (IV) and merocyanines of formula (V), there are generally known numerous compounds which are broadly defined as spectral sensitizing dyes for silver halide emulsions. These compounds are useful in the present invention since they have substantially no absorption maximum in the visible region.

Cyanines of formula (IV)

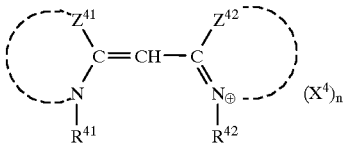

In the formula, each of $Z^{41}$ and $Z^{42}$ is a group of non-metallic atoms necessary to complete a benzoxazole, benzothiazole, benzoselenazole, naphthoxazole, naphthothiazole, naphthoselenazole, thiazole, thiazoline, oxazole, selenazole, selenazoline, pyridine or quinoline nucleus. Each of $R^{41}$ and $R^{42}$ is an alkyl or aralkyl group. $X^4$ is an electric charge balancing counter ion. Letter n is equal to 0 or 1.

When the cyanine of formula (IV) is turned into a radical, preferably one hydrogen atom is eliminated from the group of atoms represented by $Z^{41}$ or $Z^{42}$ or the group represented by $R^{41}$ or $R^{42}$, especially one hydrogen atom eliminated from $R^{41}$ or $R^{42}$.

Where the cyanine of formula (IV) has an acid group as a substituent (for example, $R^{41}$ or $R^{42}$ is an alkyl or aralkyl group having an acid group), the compound itself can become a compound of the general formula (II).

In formula (IV), the heterocyclic ring formed by each of $Z^{41}$ and $Z^{42}$ is preferably a benzoxazole, benzothiazole, naphthoxazole, naphthothiazole, thiazole or oxazole nucleus, with the benzoxazole, benzothiazole or naphthoxazole nucleus being more preferred. The benzoxazole or naphthoxazole nucleus is most preferred. In formula (IV), the heterocyclic ring formed by each of $Z^{41}$ and $Z^{42}$ may have at least one substituent, examples of which include halogen atoms (such as fluorine, chlorine, bromine and iodine), nitro, alkyl groups preferably having 1 to 4 carbon atoms (e.g., methyl, ethyl, trifluoromethyl, benzyl and phenethyl), aryl groups (e.g., phenyl), alkoxy groups preferably having 1 to 4 carbon atoms (e.g., methoxy, ethoxy, propoxy and butoxy), carboxyl, alkoxycarbonyl groups preferably having 2 to 5 carbon atoms (e.g., ethoxycarbonyl), hydroxy and cyano.

With respect to $Z^{41}$ and $Z^{42}$ in formula (IV), examples of the benzothiazole nucleus include benzothiazole, 4-chlorobenzothiazole, 5-chlorobenzothiazole, 6-chlorobenzothiazole, 7-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-propoxybenzothiazole, 5-carboxybenzothiazole, 5-ethoxycarbonylbenzothiazole, 5-phenethylbenzothiazole, 5-fluorobenzothiazole, 5-chloro-6-methylbenzothiazole, 5-trifluoromethylbenzothiazole, 5,6-dimethylbenzothiazole, and 5-hydroxy-6-methylbenzothiazole nuclei; examples of the naphthothiazole nucleus include naphtho[2,1-d]thiazole, naphtho[1,2-d]thiazole, naphtho[2,3-d]thiazole, 5-methoxynaphtho[1,2-d]thiazole, 7-ethoxynaphtho[1,2-d]thiazole, and 5-methoxynaphtho[2,3-d]thiazole nuclei; examples of the benzoselenazole nucleus include benzoselenazole, 5-chlorobenzoselenazole, 5-nitrobenzoselenazole, 5-methoxybenzoselenazole, 5-ethoxybenzoselenazole, 5-hydroxybenzoselenazole, and 5-chloro-6-methylbenzoselenazole nuclei; examples of the naphthoselenazole nucleus include naphtho-[1,2-d]selenazole and naphtho[2,1-d]selenazole nuclei; examples of thiazole nucleus include thiazole, 4-methylthiazole, 4-phenylthiazole, 4,5-dimethylthiazole, and 4,5-diphenylthiazole nuclei; and examples of the thiazoline nucleus include thiazoline and 4-methylthiazoline nuclei.

With respect to $Z^{41}$ and $Z^{42}$, examples of the benzoxazole nucleus include benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-ethoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, and 5,6-dimethylbenzoxazole nuclei; examples of the naphthoxazole nucleus include naphth[2,1-d]oxazole, naphtha[2,1-d]oxazole, naphth[2,3-d]oxazole, and 5-methoxynaphth[1,2-d]oxazole nuclei.

With respect to $Z^{41}$ and $Z^{42}$, examples of the oxazole nucleus include oxazole, 4-methyloxazole, 4-ethyloxazole, 4-phenyloxazole, 4-benzyloxazole, 4-methoxyoxazole, 4,5-dimethyloxazole, 5-phenyloxazole, and 4-methoxyoxazole nuclei; examples of the pyridine nucleus include 2-pyridine, 4-pyridine, 5-methyl-2-pyridine and 3-methyl-4-pyridine nuclei; examples of the quinoline nucleus include 2-quinoline, 4-quinoline, 3-methyl-2-quinoline, 5-ethyl-2-quinoline, 6-methyl-2-quinoline, 8-fluoro-4-quinoline, 8-chloro-2-quinoline, 8-fluoro-2-quinoline, 6-methoxy-2-quinoline, 6-ethoxy-4-quinoline, 8-chloro-4-quinoline, 8-methyl-4-quinoline, and 8-methoxy-4-quinoline nuclei.

In formula (IV), the alkyl groups represented by $R^{41}$ and $R^{42}$ may be substituted or unsubstituted ones. The unsubstituted alkyl groups are preferably those having up to 18 carbon atoms, especially up to 8 carbon atoms, for example, methyl, ethyl, n-propyl, n-butyl, n-hexyl, and n-octadecyl groups. The substituted alkyl groups are preferably those groups whose alkyl moiety has up to 6 carbon atoms, especially up to 4 carbon atoms, for example, sulfo-substituted alkyl groups wherein the sulfo group may attached to the alkyl through an alkoxy or aryl group (e.g., 2-sulfoethyl, 3-sulfopropyl, 3-sulfobutyl, 4-sulfobutyl, 2-(3-sulfopropoxy)ethyl, 2-[2-(3-sulfopropoxy)ethoxy]ethyl, 2-hydroxy-3-sulfopropyl, p-sulfophenethyl and p-sulfophenylpropyl), carboxy-substituted alkyl groups wherein the carboxy group may attached to the alkyl through an alkoxy or aryl group (e.g., carboxymethyl, 2-carboxyethyl, 3-carboxypropyl and 4-carboxybutyl), hydroxyalkyl groups (e.g., 2-hydroxyethyl and 3-hydroxypropyl), acyloxyalkyl groups (e.g., 2-acetoxyethyl and 3-acetoxypropyl), alkoxyalkyl groups (e.g., 2-methoxyethyl and 3-methoxypropyl), alkoxycarbonylalkyl groups (e.g., 2-methoxycarbonylethyl, 3-methoxycarbonylpropyl and 4-ethoxycarbonylbutyl), vinyl-substituted alkyl groups (e.g., allyl), cyanoalkyl groups (e.g., 2-cyanoethyl), carbamoylalkyl groups (e.g., 2-carbamoylethyl), aryloxyalkyl groups (e.g., 2-phenoxyethyl and 3-phenoxypropyl), aralkyl groups (e.g., 2-phenethyl and 3-phenylpropyl), and aryloxyalkyl groups (e.g., 2-phenoxyethyl and 3-phenoxypropyl).

Preferably one of the substituents represented by $R^{41}$ and $R^{42}$ is an alkyl group having a sulfo or carboxyl group.

The electric charge balancing counter ion represented by $X^4$ is any desired anion capable of offsetting a positive charge given by the quaternary ammonium salt in the heterocyclic ring, for example, a bromide ion, chloride ion, iodide ion, p-toluenesulfonate ion, ethylsulfonate ion, perchlorate ion, trifluoromethanesulfonate ion, and thiocyan ion. In this case, n is 1.

Where the quaternary ammonium salt in the heterocyclic ring further contains an anion substituent such as a sulfoalkyl substituent, the salt may take the form of betaine. In this case, no counter ion is necessary and n is 0. Where the quaternary ammonium salt in the heterocyclic ring has two anion substituents, for example, two sulfoalkyl groups, $X^4$ is a cationic counter ion, for example, an alkali metal ion (such as sodium ion and potassium ion) and ammonium salt (such as triethylammonium).

Merocyanines of formula (V)

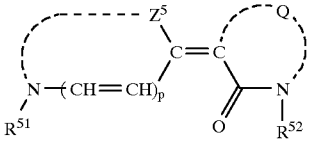

In the formula, $Z^5$ is a group of non-metallic atoms necessary to complete a thiazoline, thiazolidine, selenazoline, selenazolidine, pyrrolidine, dihydropyridine, oxazoline, oxazolidine, imidazoline, indoline, tetrazoline, benzothiazoline, benzoselenazoline, benzimidazoline, benzoxazoline, naphthothiazoline, naphthoselenazoline, naphthoxazoline, naphthoimidazoline or dihydroxyquinoline nucleus. Q is a group of non-metallic atoms necessary to complete a rhodanine, 2-thiooxazoline-2,4-dione, 2-thioselenazoline-2,4-dione, 2-thiohydantoin, barbituric acid or 2-thiobarbituric acid nucleus. Each of $R^{51}$ and $R^{52}$ is a hydrogen atom, alkyl or aryl group. Letter p is equal to 0 or 1.

When the merocyanine of formula (V) is turned into a radical, preferably one hydrogen atom is eliminated from the group of atoms represented by $Z^5$ or Q or the group represented by $R^{51}$ or $R^{52}$, especially one hydrogen atom eliminated from $R^{51}$ or $R^{52}$.

Where the merocyanine of formula (V) has an acid group as a substituent (for example, $R^{51}$ or $R^{52}$ is an alkyl or aralkyl group having an acid group), the compound itself can become a compound of the general formula (II).

In formula (V), $Z^5$ is a group of non-metallic atoms necessary to complete a thiazoline nucleus such as thiazoline, 4-methylthiazoline, 4-phenylthiazoline, 4,5-dimethylthiazoline and 4,5-diphenylthiazoline;

- a benzothiazoline nucleus such as benzothiazoline, 4-chlorobenzothiazoline, 5-chlorobenzothiazoline, 6-chlorobenzothiazoline, 7-chlorobenzothiazoline, 5-nitrobenzothiazoline, 6-nitrobenzothiazoline, 4-methylbenzothiazoline, 5-methylbenzothiazoline, 6-methylbenzothiazoline, 5-bromobenzothiazoline, 6-bromobenzothiazoline, 5-iodobenzothiazoline, 5-methoxybenzothiazoline, 6-methoxybenzothiazoline, 5-ethoxybenzothiazoline, 5-propoxybenzothiazoline, 5-butoxybenzothiazoline, 5-carboxybenzothiazoline, 5-ethoxycarbonylbenzothiazoline, 5-phenethylbenzothiazoline, 5-fluorobenzothiazoline, 5-chloro-6-methylbenzothiazoline, 5-trifluoromethylbenzothiazoline (5,6-dimethylbenzothiazoline, 5-hydroxy-6-methylbenzothiazoline, tetrahydrobenzothiazoline, 4-phenylbenzothiazoline, and 5-phenylbenzothiazoline;
- a naphthothiazoline nucleus such as naphtho[2,1-d]thiazoline, naphtho[1,2-d]thiazoline, naphtho[2,3-d]thiazoline, 5-methoxynaphtho[1,2-d]thiazoline, 7-ethoxynaphtho[2,1-d]thiazoline, 8-methoxynaphtho[2,1-d]thiazoline, and 5-methoxynaphtho[2,3-d]thiazoline;
- a thiazolidine nucleus such as thiazolidine, 4-methylthiazolidine, and 4-nitrothiazolidine;
- an oxazoline nucleus such as oxazoline, 4-methyloxazoline, 4-nitrooxazoline; 5-methyloxazoline, 4-phenyloxazoline, 4,5-diphenyloxazoline, and 4-ethyloxazoline;
- a benzoxazoline nucleus such as benzoxazoline, 5-chlorobenzoxazoline, 5-methylbenzoxazoline, 5-bromobenzoxazoline, 5-fluorobenzoxazoline, 5-phenylbenzoxazoline, 5-methoxybenzoxazoline, 5-nitrobenzoxazoline, 5-trifluoromethylbenzoxazoline, 5-hydroxybenzoxazoline, 5-carboxybenzoxazoline, 6-methylbenzoxazoline, 6-chlorobenzoxazoline, 6-nitrobenzoxazoline, 6-methoxybenzoxazoline, 6-hydroxybenzoxazoline, 5,6-dimethylbenzoxazoline, and 5-ethoxybenzoxazoline;
- a naphthoxazoline nucleus such as naphth[2,1-d]oxazoline, naphth[1,2-d]oxazoline, naphth[2,3-d]oxazoline, 5-nitronaphth[1,2-d]oxazoline;

an oxazolidine nucleus such as 4,4-dimethyloxazolidine;

a selenazoline nucleus such as 4-methylselenazoline, 4-nitroselenazoline, and 4-phenylselenazoline;

a selenazolidine nucleus such as selenazolidine, 4-methylselenazolidine, and 4-phenylselenazolidine;

a benzoselenazoline nucleus such as benzoselenazoline, 5-chlorobenzoselenazoline, 5-nitrobenzoselenazoline, 5-methoxybenzoselenazoline, 5-hydroxybenzoselenazoline, 6-nitrobenzoselenazoline, and 5-chloro-6-nitrobenzoselenazoline;

a naphthoselenazoline nucleus such as naphtho[2,1-d] selenazoline and naphtho[1,2-d]selenazoline;

a 3,3-dialkylindoline nucleus such as 3,3-dimethylindoline, 3,3-diethylindoline, 3,3-dimethyl-5-dianoindoline, 3,3-dimethyl-6-nitroindoline, 3,3-dimethyl-5-nitroindoline, 3,3-dimethyl-5-methoxyindoline, 3,3-dimethyl-5-methylindoline, and 3,3-dimethyl-5-chloroindoline;

an imidazoline nucleus such as 1-alkylimidazoline, 1-alkyl-4-phenylimidazoline, and 1-arylimidazoline;

a benzimidazoline nucleus such as 1-alkylbenzimidazoline, 1-alkyl-5-chlorobenzimidazoline, 1-alkyl-5,6-dichlorobenzimidazoline, 1-alkyl-5-methoxybenzimidazoline, 1-alkyl-5-cyanobenzimidazoline, 1-alkyl-5-fluorobenzimidazoline, 1-alkyl-5-trifluoromethylbenzimidazoline, 1-allyl-5,6-dichlorobenzimidazoline, 1-allyl-5-chlorobenzimidazoline, 1-arylbenzimidazoline, 1-aryl-5-chlorobenzimidazoline, 1-aryl-5,6-dichlorobenzimidazoline, 1-aryl-5-methoxybenzimidazoline, and 1-aryl-5-cyanobenzimidazoline;

a naphthoimidazoline nucleus such as 1-alkylnaphtho-[1,2-d]imidazoline and 1-arylnaphtho[1,2-d]imidazoline wherein the alkyl is preferably selected from those having 1 to 8 carbon atoms, for example, unsubstituted alkyl groups such as methyl, ethyl, propyl, isopropyl and butyl and hydroxyalkyl groups such as 2-hydroxyethyl and 3-hydroxypropyl, and the aryl is preferably selected from phenyl, halogen-substituted phenyl (e.g., chloro-substituted phenyl), alkyl-substituted phenyl (e.g., methyl-substituted phenyl), and alkoxy-substituted phenyl (e.g., methoxy-substituted phenyl);

a pyrrolidine nucleus such as 2-pyrrolidine;

a dihydropyridine nucleus such as 1,4-dihydropyridine, 5-methyl-1,2-dihydropyridine, and 3-methyl-1,4-dihydropyridine;

a dihydroquinoline nucleus such as 1,4-dihydroquinoline, 3-methyl-1,2-dihydroquinoline, 5-ethyl-1,2-dihydroquinoline, 6-methyl-1,2-dihydroquinoline, 6-nitro-1,2-dihydroquinoline, 8-fluoro-1,2-dihydroquinoline, 6-methoxy-1,2-dihydroquinoline, 6-hydroxy-1,2-dihydroquinoline 8-chloro-1,2-dihydroquinoline, 6-ethoxy-1,4-dihydroquinoline, 6-nitro-1,4-dihydroquinoline, 8-chloro-1,4-dihydroquinoline, 8-fluoro-1,4-dihydroquinoline, 8-methyl-1,4-dihydroquinoline, 8-methoxy-1,4-dihydroquinoline, dihydroisoquinoline, 6-nitro-1,2-isoquinoline, and 6-nitro-2,3-dihydroisoquinoline; and a tetrazoline nucleus.

Among these, $Z^5$ is preferably an oxazoline, oxazolidine, thiazoline, benzothiazoline, thiazolidine, benzoxazoline, naphthoxazoline, selenazoline, selenazolidine, benzoselenazoline, benzimidazoline, pyrrolidine, dihydropyrrolidine or tetrazoline nucleus. More preferably, $Z^5$ is an oxazoline, oxazolidine, benzoxazoline, thiazoline, thiazolidine, selenazoline, selenazolidine, benzimidazoline, pyrrolidine or dihydropyrrolidine nucleus. Most preferably, $Z^5$ is an oxazoline, oxazolidine, benzoxazoline, thiazoline, thiazolidine, benzimidazoline or pyrrolidine nucleus.

Each of $R^{51}$ and $R^{52}$ is a hydrogen atom, an unsubstituted alkyl group having 1 to 18 carbon atom, preferably 1 to 8 carbon atoms (e.g., methyl, ethyl, propyl, isopropyl, butyl, hexyl, dodecyl, and octadecyl), a substituted alkyl group, for example, an aralkyl group (e.g., benzyl and β-phenylethyl), hydroxyalkyl group (e.g., 2-hydroxyethyl, 3-hydroxypropyl, and 2-hydroxyethoxyethyl), a carboxyalkyl group (e.g., carboxymethyl, 2-carboxyethyl, 3-carboxypropyl, and 4-carboxybutyl), a sulfo-substituted alkyl group (the sulfo group may be attached to the alkyl group through an alkoxy or aryl group, e.g., 2-sulfoethyl, 3-sulfopropyl, 3-sulfobutyl, 4-sulfobutyl, 2-(3-sulfopropoxy)ethyl, 2-hydroxy-3-sulfopropyl, and 2-[2-(3-sulfopropoxy)ethoxy]ethyl, and p-sulfophenethyl), a sulfatealkyl group (e.g., 3-sulfatepropyl and 4-sulfatebutyl), a mercapto group, a vinyl-substituted alkyl group (e.g., allyl), an acyloxyalkyl group (e.g., 2-acetoxyethyl and 3-acetocypropyl), an alkoxyalkyl group (e.g., 2-methoxyethyl and 3-methoxypropyl), an alkoxycarbonylalkyl group (e.g., 2-methoxycarbonylethyl, 3-methoxycarbonylpropyl, and 4-ethoxycarbonylbutyl), a cyanoalkyl group. (e.g., 2-cyanoethyl), a carbamoylalkyl group (e.g., 2-carbamoylethyl), an aryloxyalkyl group (e.g., 2-phenoxyethyl and 3-phenoxypropyl), a mercaptoalkyl group (e.g., 2-mercaptoethyl and 3-mercaptopropyl), and an alkylthioalkyl group (e.g., 2-methylthioethyl) or an aryl group, for example, phenyl, tolyl, naphthyl, methoxyphenyl and chlorophenyl. Preferably at least one of $R^{51}$ and $R^{52}$ is an alkyl group having a sulfo or carboxyl group.

Q is a group of non-metallic atoms necessary to complete a rhodanine nucleus, a 2-thiooxazoline-2,4-dione nucleus, a 2-thioselenazoline-2,4-dione nucleus, a thiohydantoin nucleus, a barbituric acid nucleus or a thiobarbituric acid nucleus, for example, barbituric acid nuclei or thiobarbituric acid nuclei containing a 1-alkyl group (e.g., 1-methyl, 2-ethyl, 1-propyl and 1-butyl), 1,3-dialkyl group (e.g., 1,3-dimethyl, 1,3-diethyl, 1,3-dipropyl, 1,3-diisopropyl, 1,3-dicyclohexyl and 1,3-di(β-methoxyethyl)), 1,3-diaryl group (e.g., 1,3-diphenyl, 1,3-di(p-chlorophenyl), and 1,3-di(p-ethoxycarbonylphenyl)), 1-sulfoalkyl group (e.g., 1-(2-sulfoethyl), 1-(3-sulfopropyl), and 1-(4-sulfobutyl)), 1,3-disulfoalkyl group (e.g., 1,3-di(2-sulfoethyl), 1,3-di(3-sulfopropyl), and 1,3-di(4-sulfocyclohexyl)), 1,3-di (sulfoaryl) group (e.g., 1,3-di(4-sulfophenyl)) or 1-sulfoaryl group (e.g., 1-(4-sulfophenyl)), with the proviso that the substituent at position-1 is as defined for the substituent ($R^{52}$) at position-3 and they may be identical or different.

The heterocyclic ring formed by Q is preferably a rhodanine or thiohydantoin nucleus, with the rhodanine nucleus being more preferred.

C is preferably a cyanine or merocyanine radical, with the cyanine radical being most preferred.

D is an acid group which is dissociated into an anion upon development. Some exemplary acid groups have been described as the substituent on C. More particularly, examples of the acid group include a sulfonic acid group, carboxylic acid group, phosphonic acid group, sulfinic acid group, sulfoamino group, phosphinic acid group, sulfuric acid monoester group, sulfonamide group, sulfamoyl group, hydroxyimino group, hydroxyaminocarbonyl group, sulfinamide group, sulfinamoyl group and hydroxyaminosulfonyl group. D is preferably a sulfonic acid group, carboxylic acid group, phosphonic acid group, sulfinic acid group, sulfonamide group or sulfuric acid monoester group, more preferably a sulfonic acid group, carboxylic acid group or phosphonic acid group, most preferably a sulfonic acid group.

The acid group represented by D may take the form of an acid anion. In this case, the acid group may have a suitable cation as an electric charge balancing counter ion. Exemplary cations include ammonium salts (e.g., triethylammonium and pyridinium) and alkali metal ions (e.g., sodium ion and potassium ion).

L is a divalent linking group which is an atom selected from C, N, S and O or a group of atoms containing at least one of C, N, S and O. Illustratively, L is an alkylene group, alkenylene group, alkynylene group, arylene group, —O—, —S—, —NH—, —N═, —CO— or —$SO_2$— (which may have a substituent) alone or a combination of two or more. More illustratively, L is (1) an alkylene group preferably having 1 to 12 carbon atoms, such as methylene, ethylene, trimethylene, and tetramethylene, (2) an alkenylene group preferably having 2 to 12 carbon atoms, such as vinylene and butenylene, (3) an alkynylene group preferably having 2 to 12 carbon atoms, such as ethynylene and butynylene, (4) an arylene group preferably having 6 to 10 carbon atoms, such as phenylene and naphthylene, (5) —O—, (6) —S—, (7) —NH—, (8) —N═, (9) —CO— or (10) —$SO_2$—. Combinations of these groups are shown below.

(11)

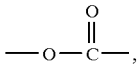

(12)

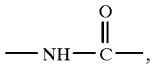

(13)

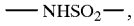

(14)

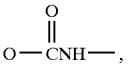

(15)

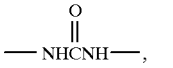

(16)

Also useful are combinations of one of (1) to (4) with one of (5) to (16).

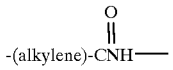

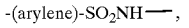

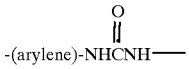

Preferred among the compounds of general formula (II) which can be used herein are compounds having an acid group of the general formula (IV) or (V). Compounds of formula (IV) are more preferred with respect to pepper fog and residual color.

Illustrative examples of the compound of general formula (II) wherein C is a mercapto or heterocyclic group are shown below. The invention is not limited thereto.

$HSCH_2CH_2SO_3H$ II-1

$HSCH_2CO_2H$ II-2

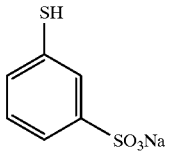

II-3

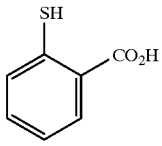

II-4

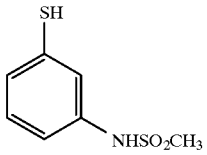

II-5

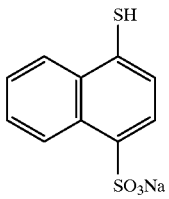

II-6

-continued
II-7
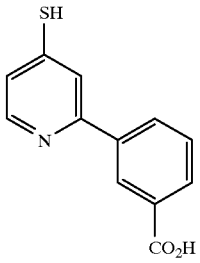
II-8
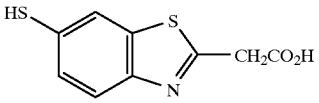
II-9
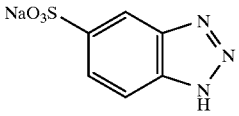
II-10
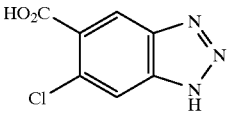
II-11
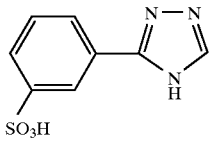
II-12
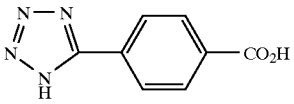
II-13
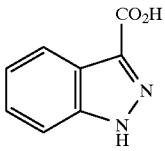
II-14
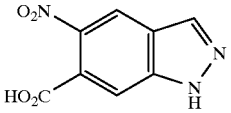
II-15
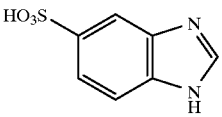
-continued
II-16
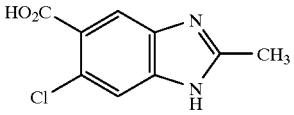
II-17
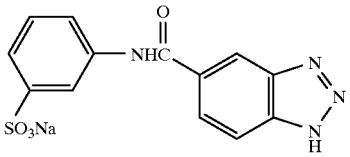
Illustrative examples of the compound of general formula (II) wherein C is a compound of general formula (III) are shown below. The invention is not limited thereto.
III-1
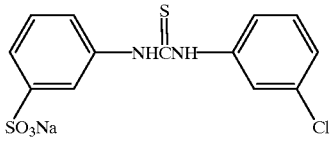
III-2
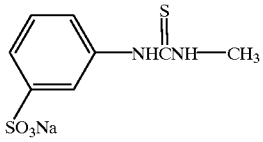
III-3
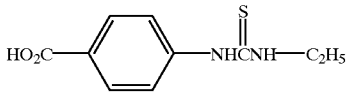
III-4
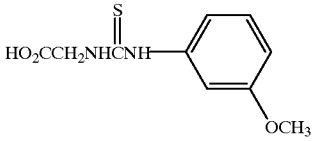
III-5
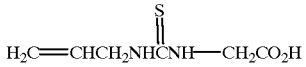
III-6
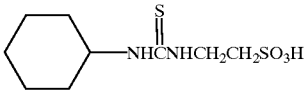
III-7
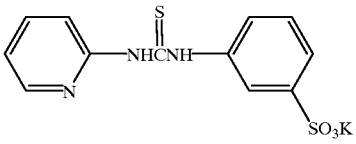
III-8
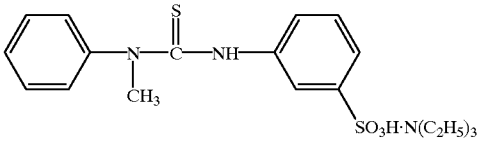

-continued
III-9
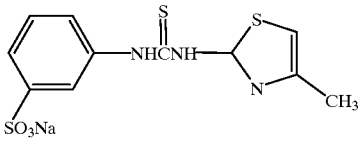
III-10
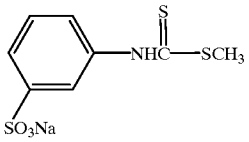
III-11
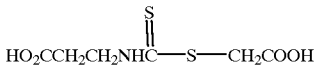
III-12
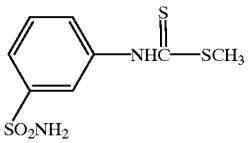
III-13
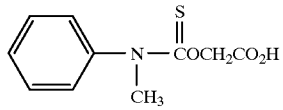
III-14
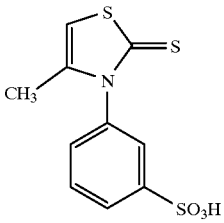
III-15
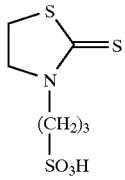
III-16
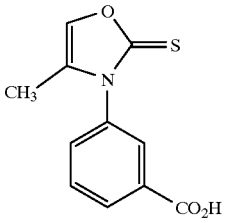
III-17
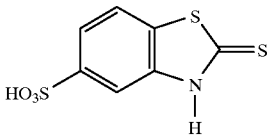
-continued
III-18
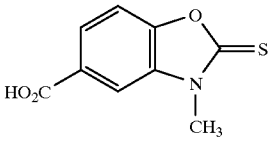
III-19
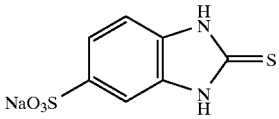
III-20
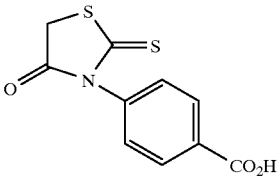
III-21
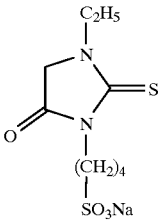
III-22
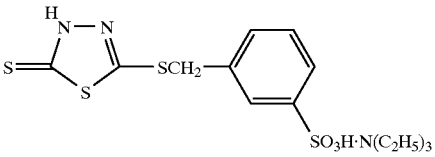
III-24
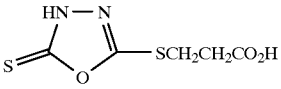
III-25
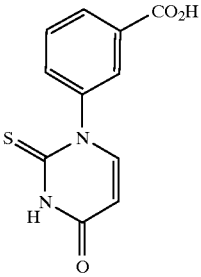
III-26
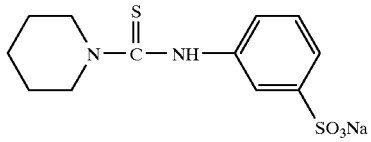
III-27
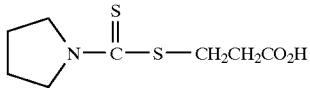

-continued

III-28

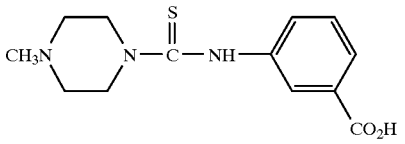

III-29

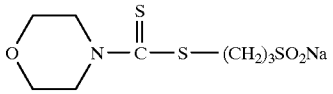

Heterocyclic compounds of general formula (II) or (III) can be readily synthesized according to the teaching of A. Katritzky and C. W. Reese Ed., "Comprehensive Heterocyclic Chemistry, the Structure, Reactions, Synthesis and Use of Heterocyclic Compounds," Pergamon Press, Oxford (1984), Vol. 2 to 6, and thioamide compounds synthesized according to the teaching of E. Miiller Ed., "Methoden der Organischen Chemie," Georg Thieme Verlag, Stuttgart (1955), Vol. 9. Those compounds which have not been described can also be synthesized by a similar method.

Illustrative examples of the compound of general formula (II) wherein C is a radical of a compound of general formula (IV) or (V) are shown below. The invention is not limited thereto.

N-1

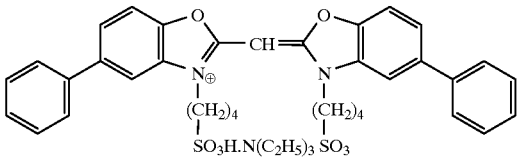

N-2

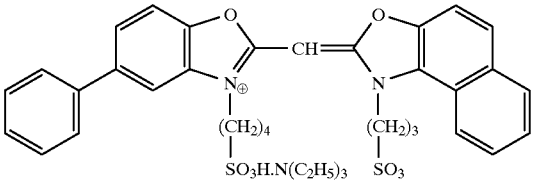

N-3

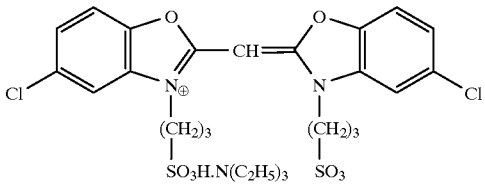

N-4

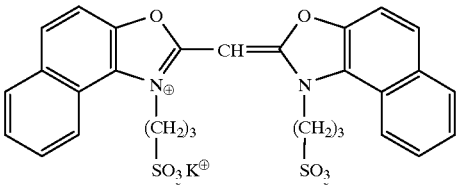

-continued

N-5

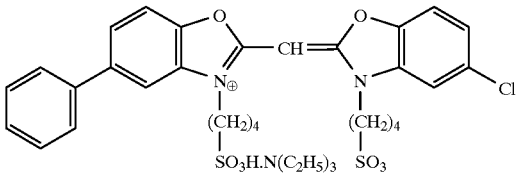

N-6

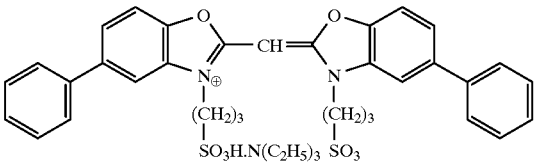

N-7

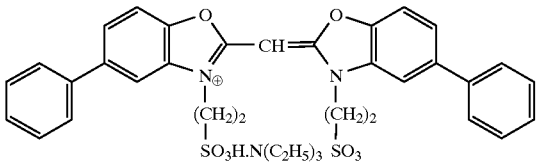

N-8

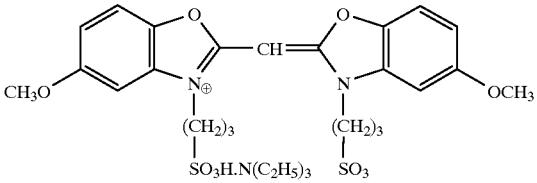

N-9

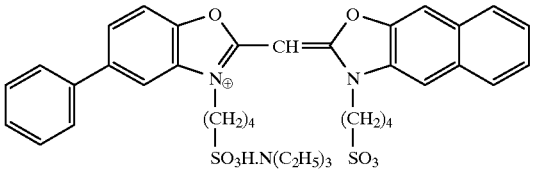

N-10

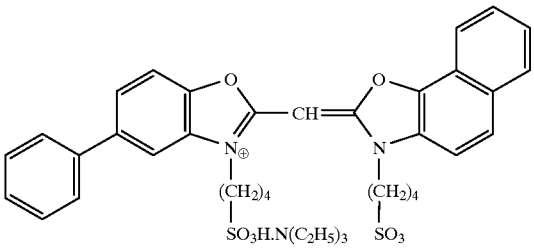

N-11

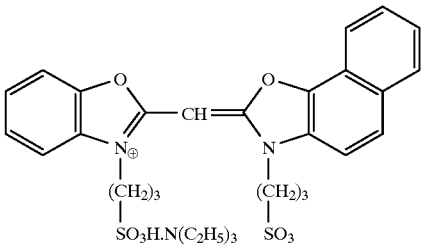

-continued
N-12
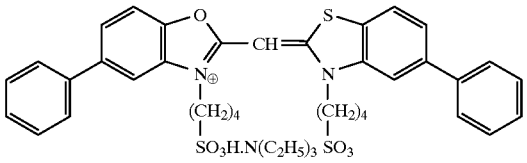
N-13
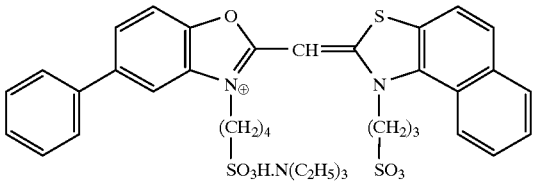
N-14
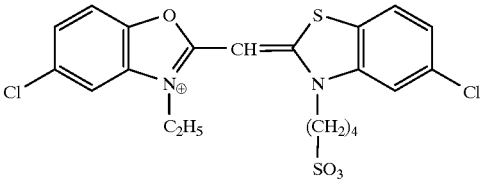
N-15
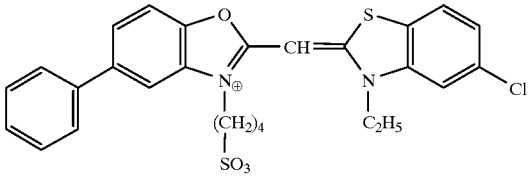
N-16
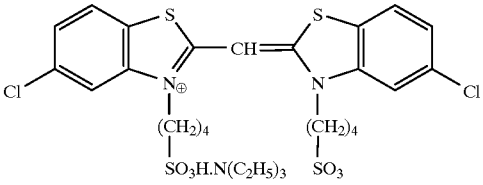
N-17
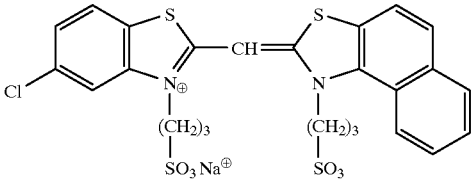
N-18
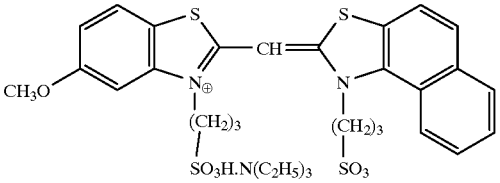
-continued
N-19
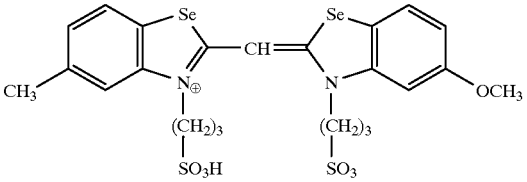
N-20
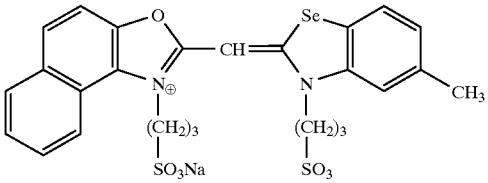
N-21
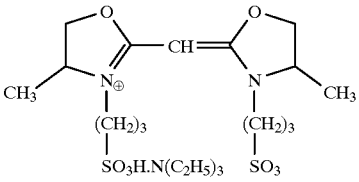
N-22
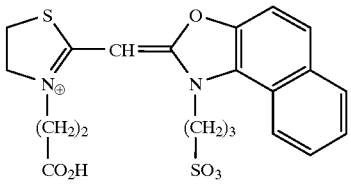
N-23
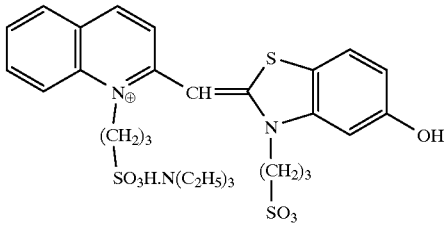
N-24
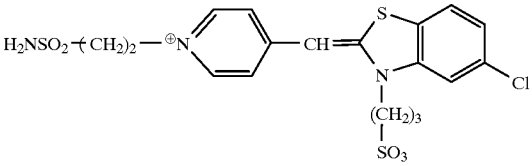
N-25
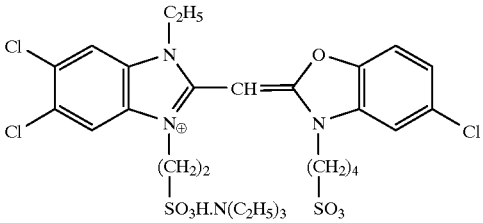

-continued
N-26
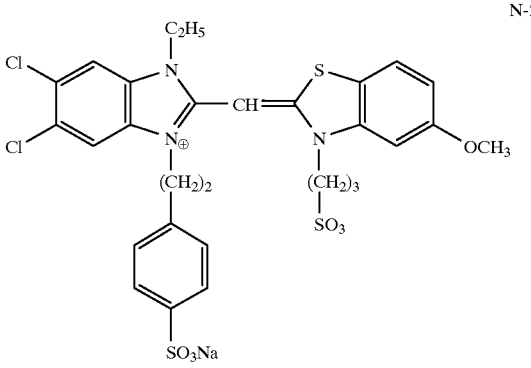
N-27
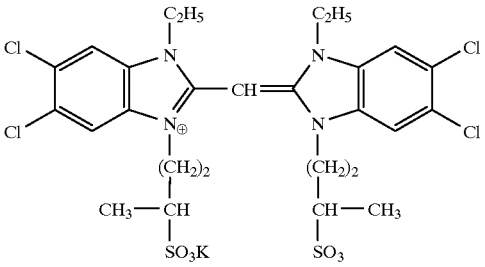
N-28
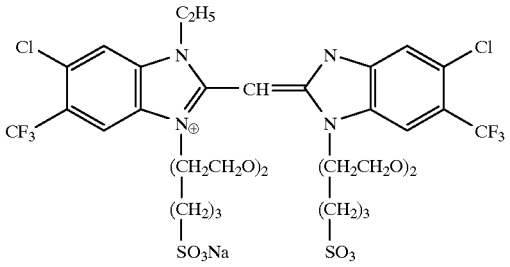
N-29
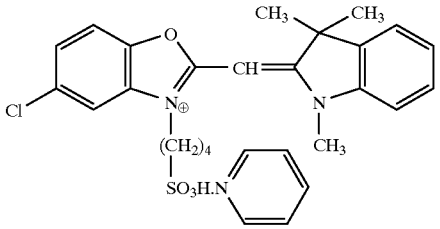
N-30
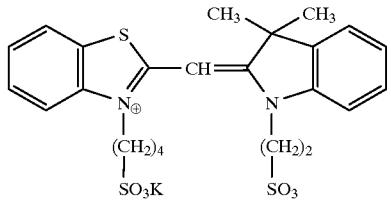
V-1
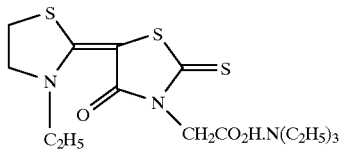
-continued
V-2
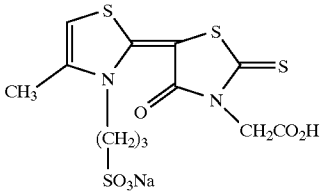
V-3
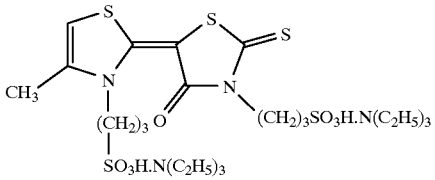
V-4
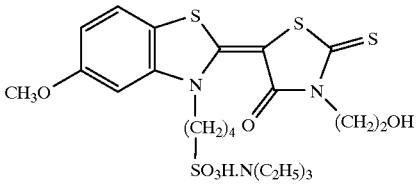
V-5
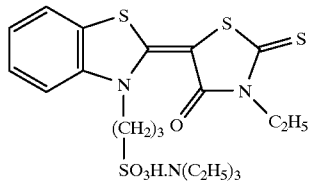
V-6
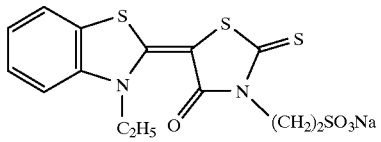
V-7
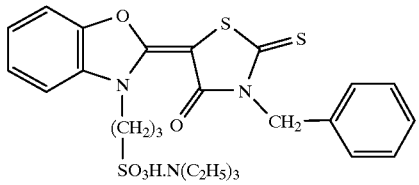
V-8
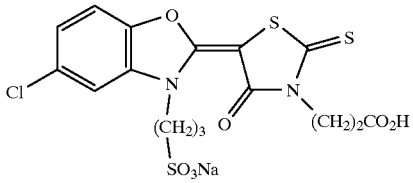
V-9
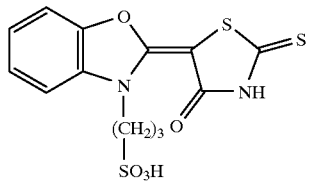

-continued
V-10
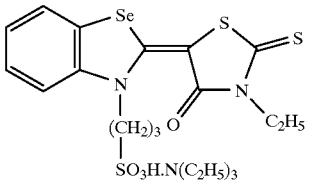
V-11
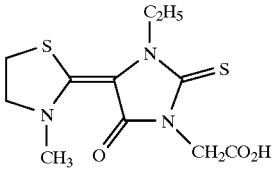
V-12
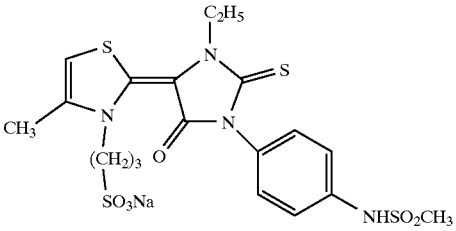
V-13
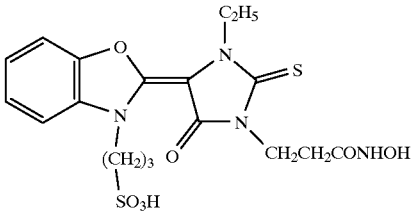
V-14
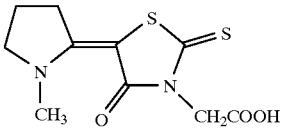
V-15
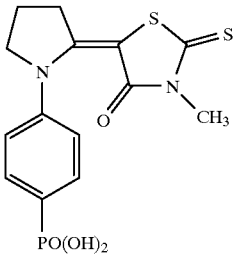
V-16
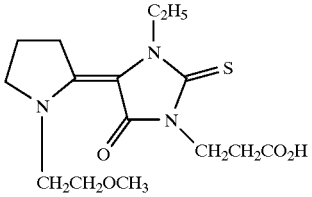
-continued
V-17
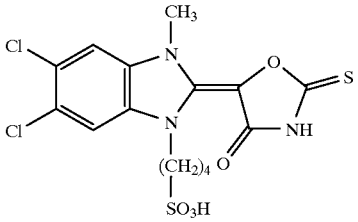
V-18
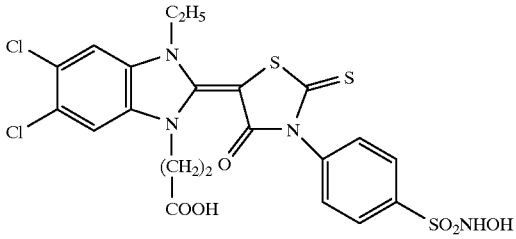
V-19
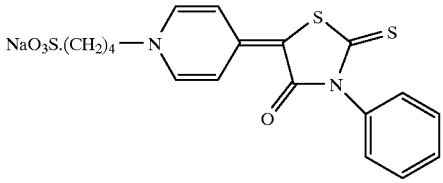
V-20
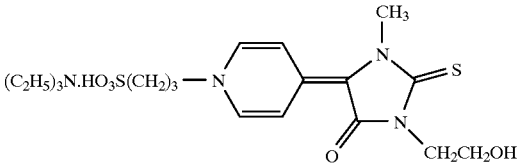
V-21
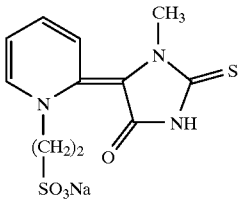
V-22
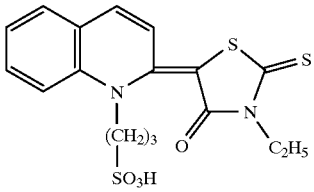
V-23
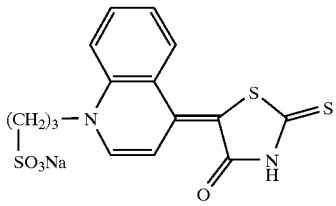

-continued

V-24

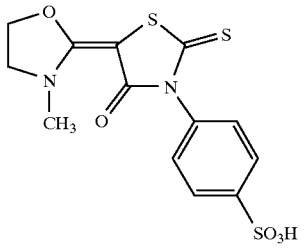

V-25

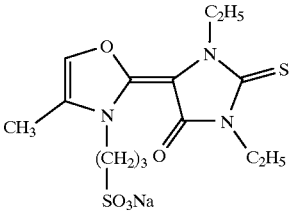

V-26

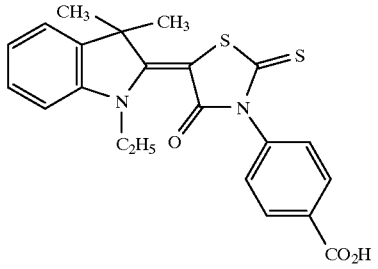

V-27

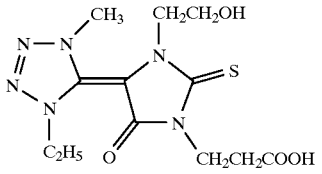

Compounds of general formulae (IV) and (V) are described in U.S. Pat. No. 2,852,385, 2,694,638, 3,615,635, 2,912,329, 3,314,031, 3,397,060, 3,506,443, and UKP 1,339,833 and can be synthesized according to the teaching of these patents and F. M. Hamer, "The Cyanine Dyes and Related Compounds," Interscience Publishers, New York (1964). Those compounds which have not been described can also be synthesized by a similar method.

In the practice of the invention, when the compound of general formula (II) is contained in photographic photosensitive material, it is preferably contained in a silver halide emulsion layer. The compound may also be contained in another non-photosensitive hydrophilic layer, for example, protective layer, intermediate layer, filter layer and antihalation layer. More particularly, when the compound is water soluble, it is added to a hydrophilic colloid solution as an aqueous solution. When the compound is substantially insoluble in water, it is added to a hydrophilic colloid solution as a solution in a water-miscible organic solvent such as alcohols, esters and ketones. When the compound is added to the silver halide emulsion layer, such addition may be done at any time from the start of chemical ripening until coating, preferably from the end of chemical ripening until coating. Most preferably the compound is added to a coating solution which is prepared for coating purpose.

Preferably the compound of formula (II) is contained in an amount of $1\times10^{-6}$ to $1\times10^{-2}$ mol, especially $1\times10^{-5}$ to $1\times10^{-3}$ mol per mol of silver halide.

As the pepper fog-inhibiting agent, there may be used any of well-known compounds, for example, thiourea compounds as described in WO 93/02388 and WO 93/08503, isothiourea compounds as described in WO 93/08504 and JP-A 258951/1992, nitrogenous heterocyclic compounds as described in JP-A 43985/1996, 180480/1994, 316042/1992, 120850/1990, and 103532/1990, purine compounds as described in JP-A 67140/1992 and 44630/1991, mercapto compounds as described in JP-A 190227/1992, precursors as described in JP-A 30243/1987, tetraazaindene compounds as described in U.S. Pat. No. 5,256,519, and acid compounds as described in JP-A 223834/1986 and 228437/1986. These compounds may be used alone or in addition to the pepper fog-inhibiting agent according to the invention.

In a second embodiment, a 5- or 6-membered heterocyclic mercapto compound having at least two nitrogen atoms or a tetraazaindene compound is contained for the purpose of suppressing a change of photographic properties, typically image enlargement with a variation of developing conditions.

The compounds used herein are of the following general formulae (1) and (2).

formula (1)

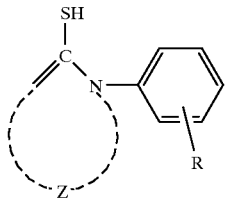

formula (2)

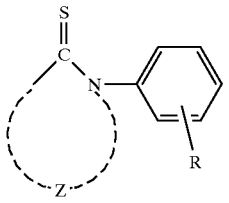

In formulae (1) and (2), Z is a group of atoms necessary to complete a 5- or 6-membered hetero-aromatic ring containing at least two nitrogen atoms and atoms selected from carbon, oxygen, sulfur, selenium, and tellurium. The group represented by Z may further have a substituent. R is selected from the group consisting of hydrogen, alkyl, aralkyl, alkoxy, alkyl- or aryl-substituted amino, amide, sulfonamide, ureido, urethane, aryloxy, sulfamoyl, carbamoyl, aryl, alkylthio, arylthio, hydroxy, halogen, cyano, carboxy or salt thereof, sulfo or salt thereof, and phosphoric acid amide. The group represented by R may further have a substituent.

More particularly, in formulae (1) and (2), the ring that Z completes with the carbon atom is a 5- or 6-membered heteroaromatic ring containing at least two nitrogen atoms and atoms selected from carbon, oxygen, sulfur, selenium, and tellurium. Exemplary hetero-aromatic rings are imidazole, pyrazole, triazole, tetrazole, thiadiazole, thiadiazine, pyridazine, pyrimidine, pyrazine, and triazine rings.

In formulae (1) and (2), R is selected from hydrogen, alkyl groups (e.g., methyl, ethyl, propyl, and cyclohexyl), aralkyl groups (e.g., benzyl), alkoxy groups (e.g., methoxy and ethoxy), alkyl- or aryl-substituted amino groups (e.g., dimethylamino), amide groups (e.g., pentylamide), sulfonamide groups (e.g., methylsulfonamide), ureido group, urethane groups (e.g., methylurethane and ethylurethane), aryloxy groups (e.g., phenoxy and naphthoxy), sulfamoyl groups (e.g., sulfamoyl), carbamoyl groups (e.g., ethylcarbamoyl and phenylcarbamoyl), aryl groups (e.g., phenyl and naphthyl), alkylthio groups (e.g., methylthio and hexylthio), arylthio groups (e.g., phenylthio), hydroxy group, halogen atoms (e.g., fluorine, chlorine, bromine and iodine), cyano group, carboxy groups including salts thereof, sulfo groups including salts thereof, and phosphoric acid amide groups. These groups may further have a substituent which may be selected from the foregoing groups, for example. The total number of carbon atoms in R is preferably 0 to 20.

Illustrative, non-limiting, examples of the compounds of the general formulae (1) and (2) are shown in Table 1.

TABLE 1

| Compound No. | Structure |
|---|---|
| 1-1 | 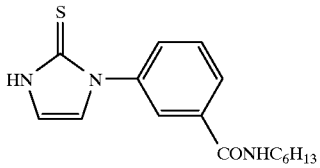 |
| 1-2 | 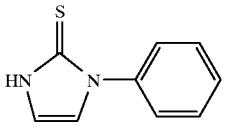 |
| 1-3 | 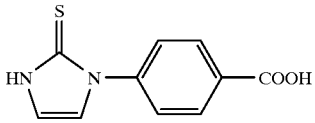 |
| 1-4 | 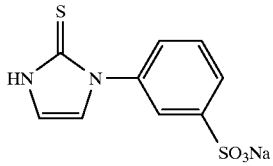 |
| 1-5 | 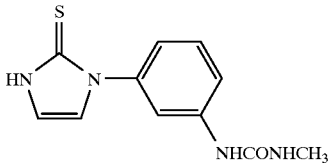 |
| 1-6 | 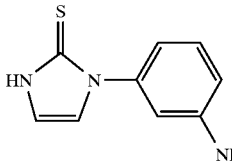 |

TABLE 1-continued

| Compound No. | Structure |
|---|---|
| 1-7 | 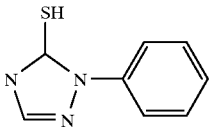 |
| 1-8 | 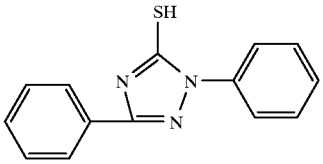 |
| 1-9 | 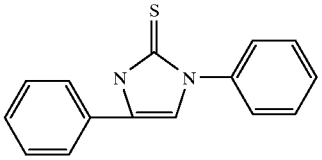 |
| 1-10 | 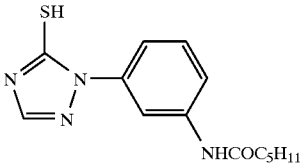 |
| 1-11 | 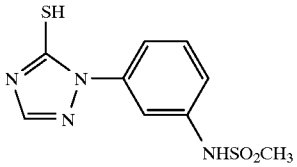 |
| 1-12 | 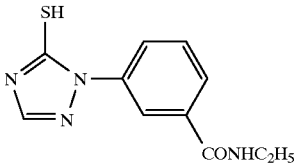 |
| 1-13 | 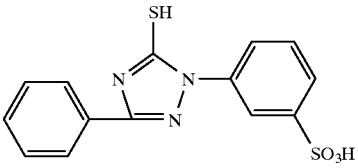 |
| 1-14 | 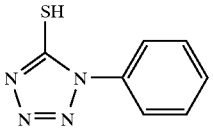 |

TABLE 1-continued

| Compound No. | Structure |
|---|---|
| 1-15 | 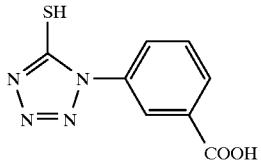 |
| 1-16 | 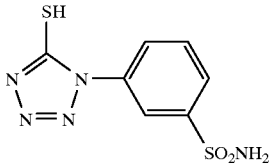 |
| 1-17 | 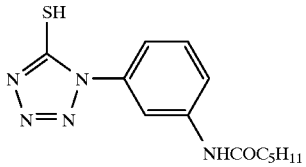 |
| 1-18 | 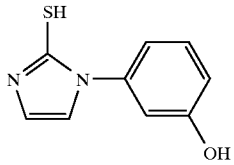 |
| 1-19 | 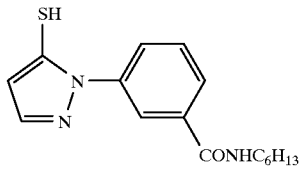 |
| 1-20 | 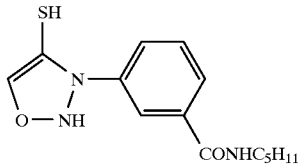 |
| 1-21 | 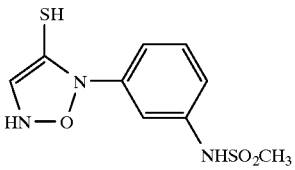 |
| 1-22 | 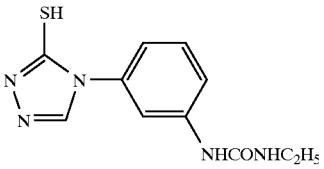 |

TABLE 1-continued

| Compound No. | Structure |
|---|---|
| 1-23 | 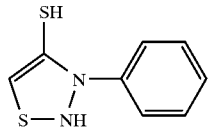 |
| 1-24 | 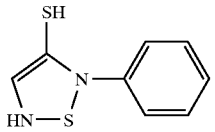 |
| 1-25 | 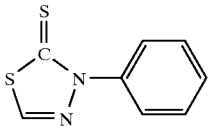 |
| 1-26 | 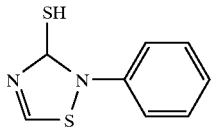 |
| 1-27 | 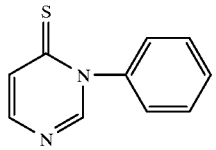 |
| 1-28 | 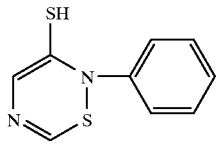 |
| 1-29 | 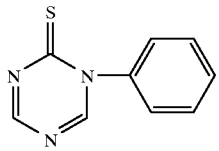 |
| 1-30 | 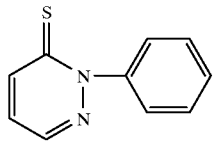 |

The compounds of formulae (1) and (2) are used as a solution in water or a suitable organic solvent such as alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method is used for dissolving the compound with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the compound in powder form in water in a ball mill, colloidal mill or ultrasonic mixer.

The compounds of formulae (1) and (2) may be added to any layer which is disposed on the same side of the support as the silver halide emulsion layer although they are preferably added to the silver halide emulsion layer or a layer disposed adjacent thereto.

Preferably the compound of formula (1) or (2) is added in amounts of $1\times10^{-1}$ to $5\times10^{-2}$ mol, more preferably $5\times10^{-4}$ to $1\times10^{-2}$ mol per mol of silver halide.

In another embodiment, a tetraazaindene compound of the general formula (3) is used instead of the compounds of formulae (1) and (2).

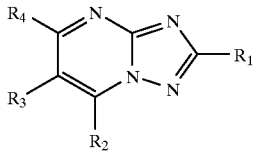

In formula (3), $R_1$ to $R_4$ are independently selected from hydrogen, hydroxyl, mercapto, halogen atoms (e.g., fluorine, chlorine, bromine, and iodine), cyano, sulfo, hydroxycarbonyl, hydroxyamino, alkyl groups (methyl, ethyl, propyl and cyclohexyl), aralkyl groups (e.g., benzyl), alkoxy groups (methoxy and ethoxy), aryloxy groups (e.g., phenoxy and naphthoxy), alkyl- or aryl-substituted amino groups (e.g., dimethylamino), amide, sulfonamide, ureido, urethane, sulfamoyl, carbamoyl, aryl groups (e.g., phenyl and naphthyl), alkylthio groups (e.g., methylthio and hexylthio), arylthio groups (e.g., phenylthio), and phosphoric acid amide groups. These groups may further have a substituent which may be selected from the foregoing groups and alkyloxycarbonyl groups, for example. Where $R_3$ and $R_4$ are alkyl groups, they may be taken together to form a ring.

Preferably, one to three, especially one or two groups selected from mercapto, hydroxyl, hydroxyamino, alkoxy and alkythio groups are contained in a molecule as $R_1$ to $R_4$. Preferably, $R_1$, $R_2$ or $R_3$ contain OH or SH. Most preferably, R is OH, SH or NHOH.

Illustrative, non-limiting, examples of the compounds of the general formula (3) are shown in Tables 2 and 3.

TABLE 2

| Compound No. | $R_1$ | $R_2$ | $R_3$ | $R_4$ |
|---|---|---|---|---|
| 3-1 | H | OH | H | $CH_3$ |
| 3-2 | H | OH | $R_3$, $R_4$; $(CH_2)_3$ | |
| 3-3 | H | OH | $R_3$, $R_4$; $(CH_2)_4$ | |
| 3-4 | H | OH | H | $CH_2CONH(CH_2)_3N(C_2H_5)_2$ |
| 3-5 | H | OH | H | $CF_3$ |
| 3-6 | H | OH | H | $CH_2CON(C_2H_5)_2$ |
| 3-7 | H | OH | H | $CH_2CONH$—Ph-o-$OCH_3$ |
| 3-8 | H | OH | H | $CH_2CONHC_8H_{17}$(n) |
| 3-9 | H | OH | H | $CH_2CONHCH_2CH_2$—Ph |
| 3-10 | H | OH | H | $CH_2COOH$ |
| 3-11 | H | OH | H | $CH_2COOC_2H_5$ |
| 3-12 | H | OH | H | Ph |
| 3-13 | SH | OH | H | $CH_3$ |
| 3-14 | $SCH_3$ | OH | H | $CF_3$ |
| 3-15 | $CH_2OH$ | OH | H | $CH_3$ |
| 3-16 | Ph-p-Cl | OH | H | $CH_3$ |
| 3-17 | Ph-p-$OCH_3$ | OH | H | $CH_3$ |
| 3-18 | $CH_2$—Ph | OH | H | $CH_3$ |

TABLE 2-continued

| Compound No. | $R_1$ | $R_2$ | $R_3$ | $R_4$ |
|---|---|---|---|---|
| 3-19 | $CH_3$ | OH | H | $CH_3$ |
| 3-20 | H | NHOH | H | $CH_3$ |
| 3-21 | H | NHOH | H | Ph |
| 3-22 | H | SH | H | $CF_3$ |
| 3-23 | SH | OH | H | $CH_3$ |
| 3-24 | $CH_2OH$ | OH | H | Ph |
| 3-25 | $CH_2OH$ | OH | H | $CH_2COOC_2H_5$ |
| 3-26 | $SCH_3$ | OH | H | $CH_2COOC_2H_5$ |
| 3-27 | $CH_3$ | OH | H | $C_4H_9$(t) |
| 3-28 | H | SH | $R_3$, $R_4$; $(CH_3)_3$ | |
| 3-29 | H | SH | $R_3$, $R_4$; $(CH_2)_4$ | |
| 3-30 | H | SH | H | Ph |

TABLE 3

| Compound No. | $R_1$ | $R_2$ | $R_3$ | $R_4$ |
|---|---|---|---|---|
| 3-31 | H | H | H | $CH_3$, $R_2$; $SCH_2CH_2N(C_2H_5)_2$ |
| 3-32 | H | SH | Br | $CH_3$ |
| 3-33 | H | $CH_3$ | H | SH |
| 3-34 | $CH_3$ | OH | H | Ph-o-$OCH_3$ |
| 3-35 | SH | H | H | H |
| 3-36 | H | SH | H | H |
| 3-37 | $CH_3$ | OH | H | $CF_3$ |
| 3-38 | $CH_3$ | OH | $R_3$, $R_4$; $(CH_2)_4$ | |
| 3-39 | H | $CH_3$ | H | $OC_2H_5$ |
| 3-40 | $CH_2OH$ | OH | H | $CH_3$ |
| 3-41 | $CH_2OH$ | OH | $R_3$, $R_4$; $(CH_2)_4$ | |
| 3-42 | $CH_3$ | OH | H | $CH_2COOC_2H_5$ |
| 3-43 | H | OH | COOH | H |
| 3-44 | $CH_3$ | OH | $CH_2CH_2OH$ | $CH_3$ |
| 3-45 | $CH_2OH$ | OH | H | -Ph-o-$OCH_3$ |
| 3-46 | H | OH | $CH_2CH_2OH$ | $CH_3$ |
| 3-47 | $NH_2$ | OH | H | $CH_3$ |
| 3-48 | $SCH_3$ | OH | H | $CH_3$ |
| 3-49 | $SCH_3$ | OH | H | OH |
| 3-50 | $CH_3$ | OH | H | Ph |
| 3-51 | H | SH | H | $C_5H_{11}$ |
| 3-52 | Ph-p-Cl | $CH_3$ | H | $CH_3$ |
| 3-53 | Ph | OH | H | H |
| 3-54 | $SCH_3$ | OH | COOH | =O, (7,H) |
| 3-55 | SH | OH | H | $CH_3$ |
| 3-56 | H | Ph | H | $CH_3$ |
| 3-57 | Ph | OH | H | $CH_2Ph$ |
| 3-58 | $SCH_3$ | OH | H | Ph |
| 3-59 | $SCH_3$ | OH | $R_3$, $R_4$; $(CH_2)_4$ | |
| 3-60 | H | OH | H | $CH_2COOH$ |

In Tables 2 and 3, Ph is phenyl, o indicates attachment at the ortho-position, p indicates attachment at the para-position, $R_3$,$R_4$; $(CH_2)_3$ or $(CH_2)_4$ indicates that $R_3$ and $R_4$ form a ring.

The compound of formula (3) is used as a solution in water or a suitable organic solvent such as alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method is used for dissolving the compound with the aid of an oil such as dibutyl phthalate, tricresyl phosphate, glyceryl triacetate and diethyl phthalate or an auxiliary solvent such as ethyl acetate and cyclohexanone whereby an emulsified dispersion is mechanically prepared. Alternatively, a method known as a solid dispersion method is used for dispersing the compound in powder form in water in a ball mill, colloidal mill or ultrasonic mixer.

The compounds of formula (3) may be added to any layer which is disposed on the same side of the support as the silver halide emulsion layer although they are preferably added to the silver halide emulsion layer or a layer disposed adjacent thereto.

Preferably the compound of formula (3) is added in amounts of $1\times10^{-4}$ to $5\times10^{-2}$ mol, more preferably $5\times10^{-4}$ to $1\times10^{-2}$ mol per mol of silver halide.

The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 1 to 10% by weight of an image forming layer. In a multilayer embodiment wherein the reducing agent is added to a layer other than an emulsion layer, the reducing agent should preferably be contained in a slightly greater amount of about 2 to 15% by weight of that layer.

For photothermographic photosensitive materials using organic silver salts, a wide range of reducing agents or developing agents are disclosed. Exemplary reducing agents include amidoximes such as phenylamidoxime, 2-thienylamidoxime, and p-phenoxyphenylamidoxime; azines such as 4-hydroxy-3,5-dimethoxybenzaldehydeazine; combinations of aliphatic carboxylic acid arylhydrazides with ascorbic acid such as a combination of 2,2'-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenylhydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2'-dihydroxy-1,1'-binaphthyl, 6,6'-dibromo-2,2'-dihydroxy-1,1'-binaphthyl, and bis(2-hydroxy-1-naphthyl)methane; combinations of bis-β-naphthols with 1,3-dihydroxybenzene derivatives such as 2,4-dihydroxybenzophenone and 2',4'-dihydroxyacetophenone; 5-pyrazolones such as 3-methyl-1-phenyl-5-pyrazolone; reductones such as dimethylaminohexosereductone, anhydrodihydroaminohexose-reductone and anhydrodihydropiperidonehexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)propane; ascorbic acid derivatives such as 1-ascorbyl palmitate and ascorbin stearate; aldehydes and ketones such as benzil and diacetyl; 3-pyrazolidones and certain indane-1,3-diones.

Especially preferred reducing agents used herein are those compounds of the following formulae (R-I), (R-II), (R-III), and (R-IV).

(R-I)

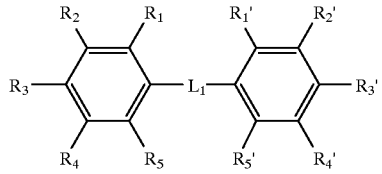

(R-II)

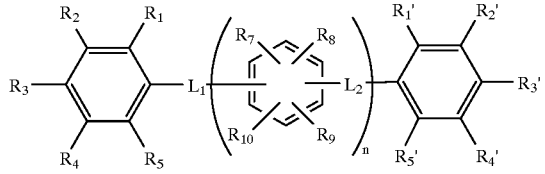

(R-III)

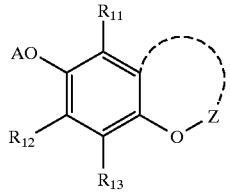

(R-IV)

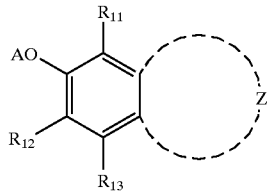

In formula (R-III), Z forms a cyclic structure represented by the following formula (Z-1) or (Z-2).

(Z-1)

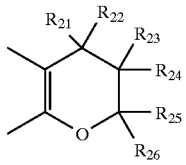

or (Z-2)

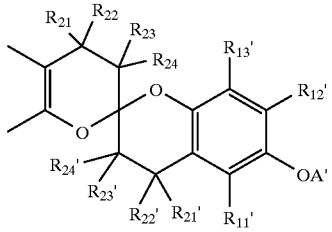

In formula (R-IV), Z forms a cyclic structure represented by the following formula (Z-3) or (Z-4).

(Z-3)

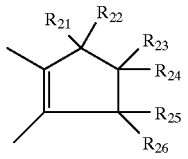

or (Z-4)

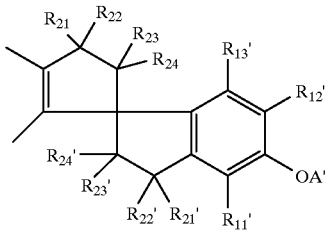

In formulae (R-I) and (R-II), each of $L_1$ and $L_2$ is a group CH—$R_6$ or a sulfur atom, and n is a natural number.

Herein, R is used as a representative of $R_1$ to $R_{10}$, $R_1'$ to $R_5'$, $R_{11}$ to $R_{13}$, $R_{11}'$ to $R_{13}'$, $R_{21}$ to $R_{26}$, and $R_{21}'$ to $R_{24}'$. R is a hydrogen atom, alkyl group having 1 to 30 carbon atoms, aryl group, aralkyl group, halogen atom, amino group or a substituent represented by —O—A, with the proviso that at least one of $R_1$ to $R_5$, at least one of $R_1'$ to $R_5'$, and at least one of $R_7$ to $R_{10}$ each are a group represented by —O—A. Alternatively, R groups, taken together, may form a ring. A and A' each are a hydrogen atom, alkyl group having 1 to 30 carbon atoms, acyl group having 1 to 30 carbon atoms, aryl group, phosphate group or sulfonyl group. R, A and A' may be substituted groups while typical examples of the substituent include an alkyl group (including active methine groups), nitro group, alkenyl group, alkynyl group, aryl group, heterocyclic ring-containing group, group containing a quaternized nitrogen atom-containing heterocyclic ring (e.g., pyridinio group), hydroxyl group, alkoxy group (including a group containing recurring ethyleneoxy or propyleneoxy units), aryloxy group, acyloxy group, acyl group, alkoxycarbonyl group, aryloxycarbonyl group, carbamoyl group, urethane group, carboxyl group, imido group, amino group, carbonamide group, sulfonamide group, ureido group, thioureido group, sulfamoylamino group, semicarbazide group, thiosemicarbazide group, hydrazino-containing group, quaternary ammonio-containing group, mercapto group, (alkyl, aryl or heterocyclic) thio group, (alkyl or aryl) sulfonyl group, (alkyl or aryl) sulfinyl group, sulfo group, sulfamoyl group, acylsulfamoyl group, (alkyl or aryl) sulfonylureido group, (alkyl or aryl) sulfonylcarbamoyl group, halogen atom, cyano group, phosphoric acid amide group, phosphate structure-containing group, acylurea structure-bearing group, selenium or tellurium atom-containing group, and tertiary or quaternary sulfonium structure-bearing group. The substituent on R, A and A' may be further substituted, with preferred examples of the further substituent being those groups exemplified as the substituent on R. The further substituent, in turn, may be further substituted, the still further substituent, in turn, may be further substituted, and so on. In this way, multiple substitution is acceptable while preferred substituents are those groups exemplified as the substituent on R, A and A'.

Illustrative, non-limiting, examples of the compounds represented by formulae (R-I), (R-II), (R-III) and (R-IV) are given below.

TABLE 4

| No. | R1, R1' | R2, R2' | R3, R3' | R4, R4' | R5, R5' | L1 | R6 |
|---|---|---|---|---|---|---|---|
| R-I-1 | —OH | —$CH_3$ | —H | —$CH_3$ | —H | CH-R6 | —H |
| R-I-2 | —OH | —$CH_3$ | —H | —$CH_3$ | —H | CH-R6 | —$CH_3$ |
| R-I-3 | —OH | —$CH_3$ | —H | —$CH_3$ | —H | CH-R6 | —$C_3H_7$ |
| R-I-4 | —OH | —$CH_3$ | —H | —$CH_3$ | —H | CH-R6 | —$C_5H_{11}$ |
| R-I-5 | —OH | —$CH_3$ | —H | —$CH_3$ | —H | CH-R6 | —TMB |
| R-I-6 | —OH | —$CH_3$ | —H | —$CH_3$ | —H | CH-R6 | —$C_9H_{19}$ |
| R-I-7 | —OH | —$CH_3$ | —H | —$CH_3$ | —H | S | — |
| R-I-8 | —OH | —$CH_3$ | —H | —$C_2H_5$ | —H | S | — |
| R-I-9 | —OH | —$CH_3$ | —H | —$C_4H_9$(t) | —H | S | — |
| -I-10 | —OH | —$C_4H_9$(t) | —H | —$CH_3$ | —H | CH-R6 | —H |
| R-I-11 | —OH | —$C_4H_9$(t) | —H | —$CH_3$ | —H | CH-R6 | —$CH_3$ |
| R-I-12 | —OH | —$C_4H_9$(t) | —H | —$CH_3$ | —H | CH-R6 | —TMB |
| R-I-13 | —OH | —$C_4H_9$(t) | —H | —$C_2H_5$ | —H | CH-R6 | — |
| R-I-14 | —OH | —CHex | —H | —$CH_3$ | —H | S | — |
| R-I-15 | —OH | —$C_4H_9$(t) | —H | —$C_2H_5$ | —H | S | —Ph |
| R-I-16 | —OH | —$C_2H_5$ | —H | —$C_4H_9$(t) | —H | CH-R6 | —H |
| R-I-17 | —OH | —$C_2H_5$ | —H | —$C_4H_9$(t) | —H | CH-R6 | —$CH_3$ |
| R-I-18 | —OH | —$C_2H_5$ | —H | —$C_4H_9$(t) | —H | CH-R6 | —TMB |
| R-I-19 | —OH | —$CH_3$ | —H | —$C_4H_9$(t) | —H | CH-R6 | —Ph |
| R-I-20 | —OH | —$CH_3$ | —CL | —$C_4H_9$(t) | —H | CH-R6 | —H |
| R-I-21 | —OH | —$CH_3$ | —H | —$C_4H_9$(t) | —OCH3 | CH-R6 | —H |
| R-I-22 | —H | —$C_4H_9$(t) | —OH | —CPen | —H | CH-R6 | —H |
| R-I-23 | —H | —$C_4H_9$(t) | —OH | —$C_4H_9$(t) | —H | CH-R6 | —TMB |
| R-I-24 | —H | —$C_4H_9$(t) | —OH | —H | —H | CH-R6 | —H |
| R-I-25 | —H | —$C_4H_9$(t) | —OH | —H | —H | CH-R6 | —$C_3H_7$ |
| R-I-26 | —H | —$CH_3$ | —OH | —$C_4H_9$(t) | —H | CH-R6 | —TMB |
| R-I-27 | —H | —$C_2H_5$ | —OH | —$C_4H_9$(t) | —H | CH-R6 | —H |
| R-I-28 | —H | —$CH_3$ | —OH | —$C_2H_5$ | —H | CH-R6 | —TMB |
| R-I-29 | —H | —$CH_3$ | —OH | —$CH_3$ | —H | S | — |
| R-I-30 | —H | —$CH_3$ | —OH | —$CH_3$ | —Cl | S | — |
| R-I-31 | —H | —$CH_3$ | —OH | —$C_2H_5$ | —H | S | — |
| R-I-32 | —H | —$C_2H_5$ | —OH | —$C_2H_5$ | —H | S | — |
| R-I-33 | —H | —$C_2H_5$ | —OH | —$CH_3$ | —Cl | S | — |

TABLE 4-continued

| No. | R1, R1' | R2, R2' | R3, R3' | R4, R4' | R5, R5' | L1 | R6 |
|---|---|---|---|---|---|---|---|
| R-I-34 | —H | —$CH_3$ | —OH | —$C_4H_9$(t) | —H | S | — |
| R-I-35 | —H | —CHex | —OH | —$C_4H_9$(t) | —H | S | — |

TMB: 1,3,3-trimethylbutyl group

Cpen: cyclopentyl group

Chex: cyclohexyl group (R-I)

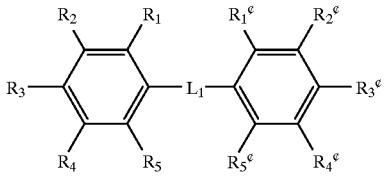

TABLE 5

| No. | $R_1$ | $R_2$ | $R_3$ | $R_4$ | $R_5$ | $R_{1'}$ | $R_{2'}$ | $R_{3'}$ | $R_{4'}$ | $R_{5'}$ | $L_1$ | $R_6$ |
|---|---|---|---|---|---|---|---|---|---|---|---|---|
| R-I-36 | —OH | —$CH_3$ | —H | —$CH_3$ | —H | —H | —$CH_3$ | —OH | —$CH_3$ | —H | CH-R6 | —H |
| R-I-37 | —OH | —$C_4H_9$(t) | —H | —$CH_3$ | —H | —H | —$CH_3$ | —OH | —$CH_3$ | —H | CH-R6 | —H |
| R-I-38 | —OH | —$CH_3$ | —H | —$CH_3$ | —H | —H | —CHex | —OH | —$CH_3$ | —H | CH-R6 | —$CH_3$ |
| R-I-39 | —OH | —$C_4H_9$(t) | —H | —$CH_3$ | —H | —H | —$CH_3$ | —OH | —$CH_3$ | —H | CH-R6 | —$CH_3$ |
| R-I-40 | —OH | —$CH_3$ | —H | —$CH_3$ | —H | —H | —$CH_3$ | —OH | —$CH_3$ | —H | CH-R6 | —TMB |
| R-I-41 | —OH | —$C_4H_9$(t) | —H | —$CH_3$ | —H | —H | —$CH_3$ | —OH | —$CH_3$ | —H | CH-R6 | —TMB |
| R-I-42 | —OH | —$CH_3$ | —H | —$CH_3$ | —H | —H | —$CH_3$ | —OH | —$CH_3$ | —H | S | — |
| R-I-43 | —OH | —$C_4H_9$(t) | —H | —$CH_3$ | —H | —H | —$CH_3$ | —OH | —$CH_3$ | —H | S | — |
| R-I-44 | —OH | —$CH_3$ | —H | —$CH_3$ | —H | —H | —CHex | —OH | —$CH_3$ | —H | S | — |

CHex: cyclohexyl group (R-I)

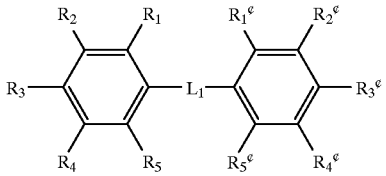

TABLE 6

| No. | $R_1$, $R_{1'}$ | $R_2$, $R_{2'}$ | $R_3$, $R_{3'}$ | $R_4$, $R_{4'}$ | $R_5$, $R_{5'}$ | $R_7$ | $R_8$ | $R_9$ | $R_{10}$ | $L_1$ | $R_6$ | $L_2$ | $R_{6'}$ | n |
|---|---|---|---|---|---|---|---|---|---|---|---|---|---|---|
| R-II-1 | —OH | —$C_4H_9$(t) | —H | —$CH_3$ | —H | —OH | —$CH_3$ | —$CH_3$ | —H | CH-R6 | —H | CH-R6 | —$CH_3$ | 1 |
| R-II-2 | —OH | —$CH_3$ | —H | —$CH_3$ | —H | —OH | —$C_2H_5$ | —$CH_3$ | —H | CH-R6 | —TMB | CH-R6 | —$CH_3$ | 1 |
| R-II-3 | —OH | —$C_4H_9$(t) | —H | —$CH_3$ | —H | —OH | —$CH_3$ | —$CH_3$ | —H | CH-R6 | —H | CH-R6 | —TMB | 3 |
| R-II-4 | —OH | —$CH_3$ | —H | —$CH_3$ | —H | —OH | —$C_2H_5$ | —$CH_3$ | —H | CH-R6 | —TMB | CH-R6 | —TMB | 2 |
| R-II-5 | —H | —$C_4H_9$(t) | —OH | —$CH_3$ | —H | —OH | —$CH_3$ | —$CH_3$ | —H | S | — | CH-R6 | —$CH_3$ | 1 |
| R-II-6 | —H | —$CH_3$ | —OH | —$CH_3$ | —H | —OH | —$C_2H_5$ | —$CH_3$ | —H | S | — | S | — | 1 |
| R-II-7 | —H | —$C_4H_9$(t) | —OH | —$CH_3$ | —H | —OH | —$CH_3$ | —$CH_3$ | —H | S | — | S | — | 2 |
| R-II-8 | —H | —$CH_3$ | —OH | —$CH_3$ | —H | —OH | —$C_2H_5$ | —$CH_3$ | —H | S | — | CH-R6 | —TMB | 3 |

(R-II)

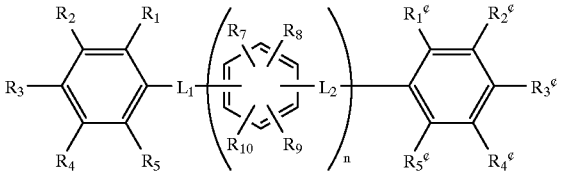

TABLE 7

| No. | Z | $R_{11}$ | $R_{12}$ | $R_{13}$ | $R_{21}$ | $R_{22}$ | $R_{23}$ | $R_{24}$ | $R_{25}$ | $R_{26}$ | A |
|---|---|---|---|---|---|---|---|---|---|---|---|
| R-III-1 | Z-1 | —$CH_3$ | —$CH_3$ | —$CH_3$ | —H | —H | —H | —H | —$CH_3$ | —$C_{16}H_{33}$ | —H |
| R-III-2 | Z-1 | —$CH_3$ | —$CH_3$ | —$CH_3$ | —H | —H | —H | —H | —$CH_3$ | —$C_{16}H_{13}$ | —H |
| R-III-3 | Z-1 | —$CH_3$ | —$C_8H_{17}$ | —H | —H | —$CH_3$ | —H | —H | —$CH_3$ | —$CH_3$ | —H |
| R-III-4 | Z-1 | —H | —$C_8H_{17}$ | —H | —H | —$CH_3$ | —H | —H | —$CH_3$ | —$CH_3$ | —H |
| R-III-5 | Z-1 | —H | —H | —$CH_3$ | —H | —H | —H | —H | —$CH_3$ | —$C_{16}H_{33}$ | —H |
| R-III-6 | Z-1 | —H | —$CH_3$ | —H | —$CH_3$ | —$CH_3$ | —H | —H | —$CH_3$ | —$CH_3$ | —H |
| R-III-7 | Z-1 | —H | —$CH_3$ | —H | —$CH_3$ | —$CH_3$ | —H | —H | —$CH_3$ | —DHP | —H |

DHP: 2,4-dihydroxyphenyl group (R-III)

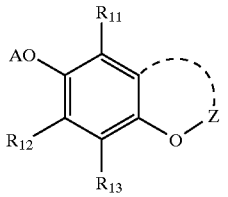

(Z-1)

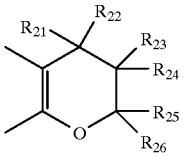

TABLE 8

| No. | Z | $R_{11}$, $R_{11'}$ | $R_{12}$, $R_{12'}$ | $R_{13}$, $R_{13'}$ | $R_{21}$, $R_{22}$ | $R_{21'}$, $R_{22'}$ | $R_{23}$, $R_{24}$ | $R_{23'}$, $R_{24'}$ | A |
|---|---|---|---|---|---|---|---|---|---|
| R-III-8 | Z-2 | —H | —$CH_3$ | —H | —$CH_3$ | —$CH_3$ | —H | —H | —H |
| R-III-9 | Z-2 | —$CH_3$ | —$CH_3$ | —$CH_3$ | —H | —H | —$CH_3$ | —$CH_3$ | —H |
| R-III-10 | Z-2 | —$CH_3$ | —$CH_3$ | —$CH_3$ | —H | —H | —H | —H | —H |
| R-III-11 | Z-2 | —$CH_3$ | —OH | —$CH_3$ | —$CH_3$ | —$CH_3$ | —H | —H | —H |
| R-III-12 | Z-2 | —H | —OH | —$CH_3$ | —$CH_3$ | —$CH_3$ | —H | —H | —H |

(R-III)

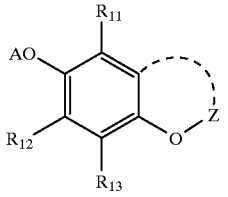

(Z-2)

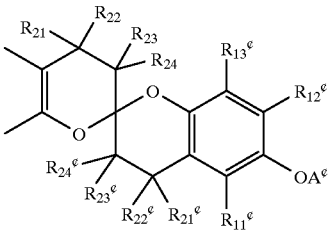

TABLE 9

| No. | Z | $R_{11}$ | $R_{12}$ | $R_{13}$ | $R_{21}$, $R_{22}$ | $R_{23}$, $R_{24}$ | $R_{25}$, $R_{26}$ | A |
|---|---|---|---|---|---|---|---|---|
| R-IV-1 | Z-3 | —H | —OH | —$CH_3$ | —$CH_3$ | —H | —H | —H |
| R-IV-2 | Z-3 | —$CH_3$ | —$CH_3$ | —$CH_3$ | —$CH_3$ | —H | —H | —H |

TABLE 9-continued
| No. | Z | $R_{11}$ | $R_{12}$ | $R_{13}$ | $R_{21}$, $R_{22}$ | $R_{23}$, $R_{24}$ | $R_{25}$, $R_{26}$ | A |
|---|---|---|---|---|---|---|---|---|
(R-IV)
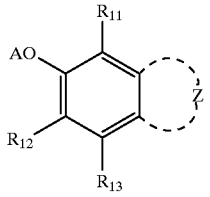
(Z-3)
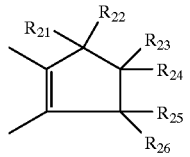
TABLE 10
| No. | Z | $R_{11}$, $R_{11'}$ | $R_{12}$, $R_{12'}$ | $R_{13}$, $R_{13'}$ | $R_{21}$, $R_{21'}$ | $R_{22}$, $R_{22'}$ | $R_{23}$, $R_{24}$ | $R_{23'}$, $R_{24'}$ | A |
|---|---|---|---|---|---|---|---|---|---|
| R-IV-3 | Z-4 | —$CH_3$ | —H | —H | —$CH_3$ | —$CH_3$ | —H | —H | —H |
| R-IV-4 | Z-4 | —$CH_3$ | —$CH_3$ | —H | —$CH_3$ | —$CH_3$ | —H | —H | —H |
| R-IV-5 | Z-4 | —$CH_3$ | —H | —H | —$C_2H_5$ | —$CH_3$ | —H | —H | —H |
(R-IV)
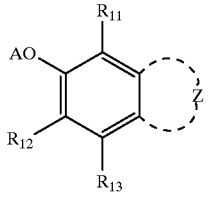
(Z-4)
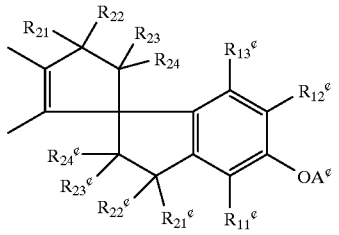
R-I-45
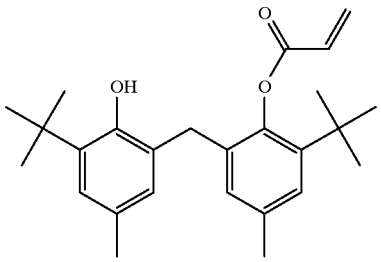
-continued
R-I-46
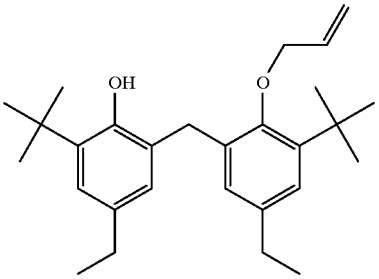

-continued
R-I-47
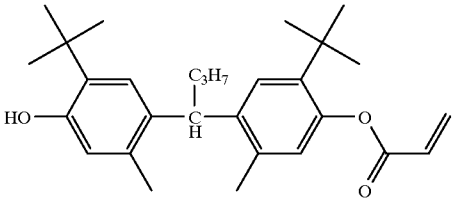
R-I-48
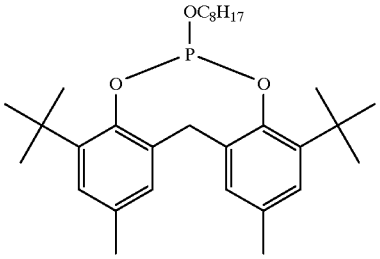
R-I-49
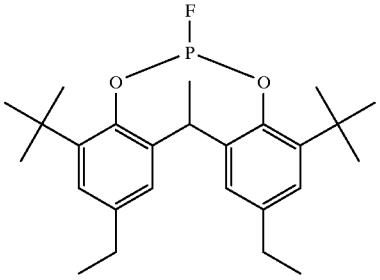
R-I-50
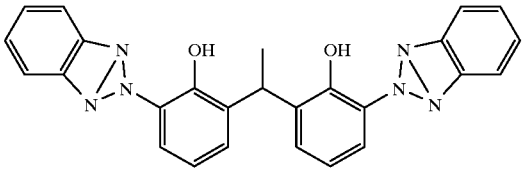
R-I-51
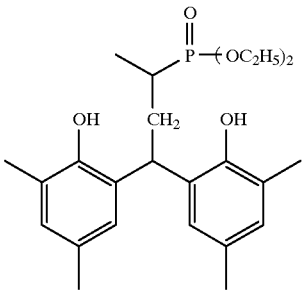
R-I-52
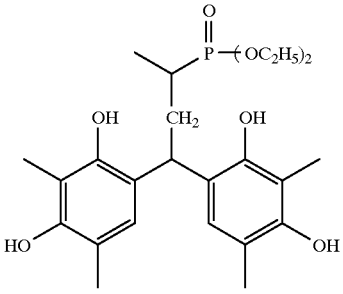
-continued
R-I-53
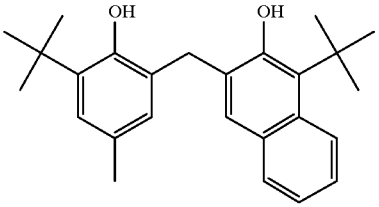
R-I-54
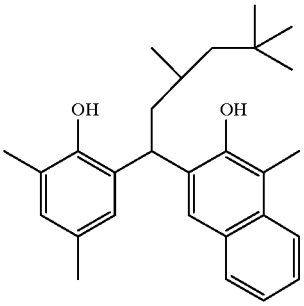
R-I-55
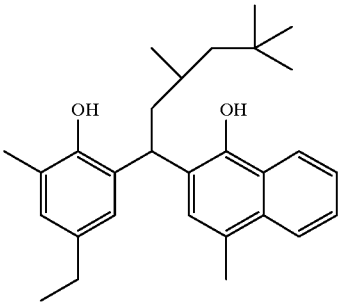
R-II-9
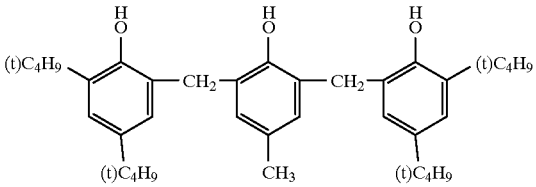
R-II-10
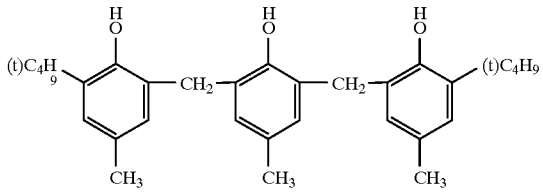
R-II-11
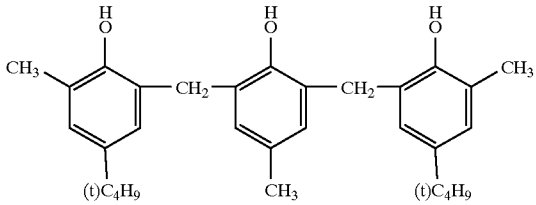

-continued

R-II-10

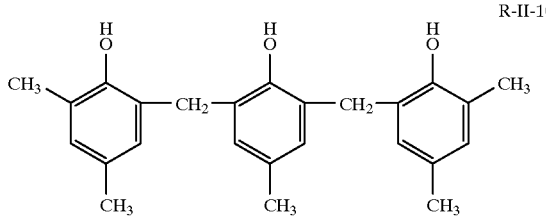

The reducing agent is preferably used in an amount of $1\times10^{-2}$ to 10 mol, more preferably $1\times10^{-2}$ to 1.5 mol per mol of silver. The reducing agent and the ultrahigh contrast promoting agent are preferably used in a molar ratio between $1:10^{-3}$ and $1:10^{-1}$.

The photothermographic photosensitive material according to the invention is processed by a heat development process to form photographic images. As described in the preamble, such photothermographic photosensitive materials are disclosed in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

The photothermographic photosensitive material according to the invention preferably contains a reducible silver source (e.g., organic silver salt), a catalytic amount of a photocatalyst (e.g., silver halide), a toner for controlling the tonality of silver, and a reducing agent, typically dispersed in a binder (typically organic binder) matrix. Although the photothermographic photosensitive material is stable at room temperature, it is developed merely by heating at an elevated temperature (e.g., higher than 60° C., preferably 80 to 120° C.) after exposure, that is, without a need for a processing solution. Upon heating, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, eventually forming an image.

In the photothermographic photosensitive material of the invention, the ultrahigh contrast promoting agent participates in the image forming process to form a super-high contrast image. Formation of super-high contrast images assisted by ultrahigh contrast promoting agents is well known for systems to be processed with solutions, but not known for photothermographic systems using organic silver salts and is thus quite unexpected.

The photothermographic photosensitive material of the invention has at least one photosensitive layer on a support. It is acceptable to form only a photosensitive layer on a support although it is preferred to form at least one non-photosensitive layer on the photosensitive layer. In order to control the quantity or wavelength distribution of light transmitted to the photosensitive layer, a filter layer may be formed on the same side as or on the opposite side to the photosensitive layer, or a dyestuff or pigment may be contained in the photosensitive layer. The dyestuff used to this end is preferably selected from the compounds described in Japanese Patent Application No. 1184/1995. The photosensitive layer may consist of two or more strata. Also a combination of high/low sensitivity strata or low/high sensitivity strata may be used for the adjustment of gradation.

Various additives may be added to any of the photosensitive layer, a non-photosensitive layer, and other layers. In the photothermographic material of the invention, various additives such as surfactants, antioxidants, stabilizers, plasticizers, UV absorbers, and coating aids may be used.

A binder is used to hold such additives. It is preferably transparent or semi-transparent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly(methacrylic acid), copoly(styrene-maleic anhydride), copoly(styrene-acrylonitrile), copoly(styrene-butadiene), poly(vinyl acetals) (e.g., poly(vinyl formal) and poly(vinyl butyral)), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

Addition of toners is quite desirable. Preferred toners are disclosed in Research Report No. 17029. Exemplary toners include imides such as phthalimide; cyclic imides, pyrazolin-5-ones, and quinazolinones such as succinimide, 3-phenyl-2-pyrazoline-5-one, 1-phenylurazol, quinazoline and 2,4-thiazolizinedione; naphthalimides such as N-hydroxy-1,8-naphthalimide; cobalt complexes such as cobalt hexamine trifluoroacetate; mercaptans such as 3-mercapto-1,2,4-triazole; N-(aminomethyl) aryldicarboxyimides such as N-(dimethylaminomethyl) phthalimide; combinations of a blocked pyrazole, an isothiuronium derivative and a certain optical bleaching agent such as a combination of N,N'-hexamethylenebis(1-carbamoyl-3,5-dimethylpyrazole), 1,8-(3,6-dioxaoctane)bis (isothiuroniumtrifluoroacetate) and 2-tribromomethylsulfonyl-benzothiazole; merocyanine dyes such as 3-ethyl-5-{(3-ethyl-2-benzothiazolinylidene)-1-methylethylidene}-2-thio-2,4-oxazolidinedione; phthalazinones, phthalazinone derivatives or metal salts thereof such as 4-(1-naphthyl)phthalazinone, 6-chlorophthalazinone, 5,7-dimethyloxyphthalazinone and 2,3-dihydro-1,4-phthalazinedione; combinations of phthalazinones with sulfinic acid derivatives such as a combination of 6-chlorophthalazinone with sodium benzenesulfinate and a combination of 8-methylphthalazinone with sodium p-trisulfonate; combinations of phthalazines with phthalic acid; combinations of phthalazines (inclusive of phthalazine adducts) with maleic anhydride and at least one of phthalic acid, 2,3-naphthalenedicarboxylic acid and o-phenylenic acid derivative and anhydrides thereof (e.g., phthalic acid, 4-methylphthalic acid, 4-nitrophthalic acid, and tetrachlorophthalic anhydride); quinazolinediones, benzoxazine, and naphthoxazine derivatives; benzoxazine-2,4-diones such as 1,3-benzoxazine-2,4-dione; pyrimidine and asym-triazines such as 2,4-dihydroxypyrimidine; and tetraazapentalene derivatives such as 3,6-dimercapto-1,4-diphenyl-1H,4H-2,3a,5,6a-tetraazapentalene. Phthalazones are preferred toners.

The silver halide which is useful as a catalytic amount of photocatalyst may be selected from photosensitive silver halides such as silver bromide, silver iodide, silver chloride, silver chlorobromide, silver iodobromide, and silver chloroiodobromide, with an iodide ion being preferably contained. The silver halide may be added to the image forming layer by any desired method whereupon the silver halide is disposed close to the reducible silver source. In general, the silver halide is contained in an amount of 0.75 to 30% by weight based on the reducible silver source. The silver halide may be prepared by converting a silver soap moiety through reaction with a halide ion, or by preforming silver halide and adding it upon generation of a soap, or a combination of these methods. The latter method is preferred.

The reducible silver source is preferably selected from silver salts of organic and hetero-organic acids containing a reducible silver ion source, especially silver salts of long chain aliphatic carboxylic acids having 10 to 30 carbon atoms, especially 15 to 25 carbon atoms. Also preferred are complexes of organic or inorganic silver salts with ligands having an overall stability constant to silver ion in the range of 4.0 to 10.0. Preferred examples of the silver salt are described in Research Disclosure Nos. 17029 and 29963. Included are silver salts of organic acids (e.g., gallic acid, oxalic acid, behenic acid, stearic acid, palmitic acid, and lauric acid); silver salts of carboxyalkylthioureas (e.g., 1-(3-carboxypropyl)thiourea and 1-(3-carboxypropyl)-3,3-dimethylthiourea); silver complexes of polymeric reaction products of aldehydes and hydroxy-substituted aromatic carboxylic acids (exemplary aldehydes are formaldehyde, acetaldehyde and butylaldehyde and exemplary hydroxy-substituted acids are salicylic acid, benzoic acid, 3,5-dihydroxybenzoic acid, and 5,5-thiodisalicylic acid); silver salts or complexes of thioenes (e.g., 3-(2-carboxyethyl)-4-hydroxymethyl-4-(thiazoline-2-thioene and 3-carboxymethyl-4-thiazoline-2-thioene); silver complexes or salts of nitrogenous acids such as imidazoles, pyrazoles, urazoles, 1,2,4-thiazoles, 1H-tetrazoles, 3-amino-5-benzylthio-1,2,4-triazoles, and benzotriazoles; silver salts of saccharin and 5-chlorosalicylaldoxime; and silver salts of mercaptides. The preferred silver source is silver behenate. The reducible silver source is preferably used in an amount of up to 3 g/m$^2$, more preferably up to 2 g/m$^2$ of silver.

An antifoggant may be contained in the photosensitive material according to the invention. The most effective antifoggant was mercury ion. Use of a mercury compound as the antifoggant in photosensitive material is disclosed, for example, in U.S. Pat. No. 3,589,903. Mercury compounds, however, are undesirable from the environmental aspect. Preferred in this regard are non-mercury antifoggants as disclosed, for example, in U.S. Pat. Nos. 4,546,075 and 4,452,885 and JP-A 57234/1984.

Especially preferred non-mercury antifoggants are compounds as disclosed in U.S. Pat. Nos. 3,874,946 and 4,756,999 and heterocyclic compounds having at least one substituent represented by —C($X^1$) ($X^2$) ($X^3$) wherein $X^1$ and $X^2$ are halogen atoms such as F, Cl, Br, and I, and $X^3$ is hydrogen or halogen. Preferred examples of the antifoggant are shown below.

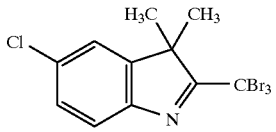

-continued

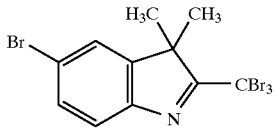

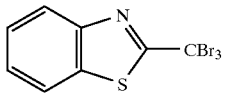

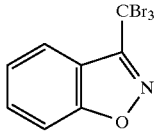

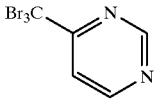

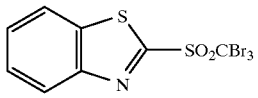

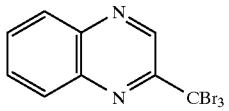

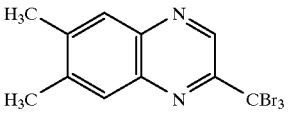

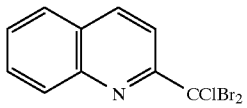

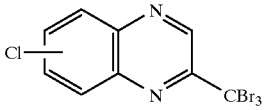

-continued

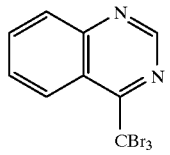

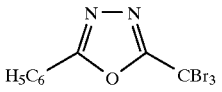

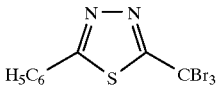

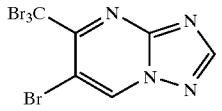

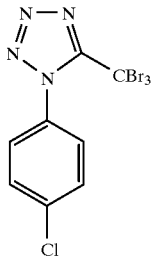

More preferred antifoggants are disclosed in U.S. Pat. No. 5,028,523, British Patent Application Nos. 92221383.4, 9300147.7 and 9311790.1 by the same assignee as the present invention.

In the photothermographic material according to the invention, there may be used sensitizing dyes as disclosed in JP-A 159841/1988, 140335/1985, 231437/1988, 259651/1988, 304242/1988, and 15245/1988, U.S. Pat. Nos. 4,639,414, 4,740,445, 4,741,966, 4,751,175, and 4,835,096.

Useful sensitizing dyes which can be used herein are described in Research Disclosure, Item 17643 IV-A (December 1978, page 23), ibid., Item 1831 X (August 1978, page 437) and the references cited therein.

It is advantageous to select a sensitizing dye having appropriate spectral sensitivity to the spectral properties of a particular light source of various scanners. Exemplary sensitizing dyes include (A) simple merocyanines as described in JP-A 162247/1985 and 48653/1990, U.S. Pat. No. 2,161,331, W. German Patent No. 936,071, and Japanese Patent Application No. 189532/1991 for argon laser light sources; (B) tri-nucleus cyanine dyes as described in JP-A 62425/1975, 18726/1979 and 102229/1984 and merocyanines as described in Japanese Patent Application No. 103272/1994 for He-Ne laser light sources; (C) thiacarbocyanines as described in JP-B 42172/1973, 9609/1976, 39818/1980, JP-A 284343/1987 and 105135/1990 for LED light sources and red semiconductor laser light sources; and (D) tricarbocyanines as described in JP-A 191032/1984 and 80841/1985 and 4-quinoline nucleus-containing dicarbocyanines as described in JP-A 192242/1984 and 67242/1991 (as represented by formulae (IIIa) and (IIIb) therein) for infrared semiconductor laser light sources.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization.

For exposure of the photothermographic photosensitive material of the invention, an Ar laser (488 nm), He-Ne laser (633 nm), red semiconductor laser (670 nm), and infrared semiconductor laser (780 nm and 830 nm) are preferably used.

A dye-containing layer may be included as an antihalation layer in the photothermographic photosensitive material of the invention. For Ar laser, He-Ne laser, and red semiconductor laser light sources, a dye is preferably added so as to provide an absorbance of at least 0.3, more preferably at least 0.8 at an exposure wavelength in the range of 400 to 750 nm. For infrared semiconductor laser light sources, a dye is preferably added so as to provide an absorbance of at least 0.3, more preferably at least 0.8 at an exposure wavelength in the range of 750 to 1500 nm. The dyes may be used alone or in admixture of two or more. The dye may be added to a dye layer disposed on the same side as the photosensitive layer adjacent to the support or a dye layer disposed on the support opposite to the photosensitive layer.

The support used herein includes sheets of paper, synthetic paper, paper laminated with a synthetic resin (e.g., polyethylene, polypropylene and polystyrene), plastic films (e.g., polyethylene terephthalate, polycarbonate, polyimide, nylon, and cellulose triacetate), metal sheets (e.g., aluminum, aluminum alloy, zinc, iron, and copper), metal-laminated or metallized paper sheets and plastic films.

In general, plastic film undergoes dimensional shrinkage or expansion when it passes through a heat development machine. Such dimensional changes give rise to a serious problem in precise multi-color printing when the film is used as a printing photosensitive material. Therefore, it is preferred to use a film experiencing a minimal dimensional change. Such films are of styrene polymers having a syndiotactic structure and heat treated polyethylene. Plastic materials having a higher glass transition temperature are also preferred, and for example, polyether ethyl ketone, polystyrene, polysulfone, polyether sulfone, and polyarylates are useful.

In the photothermographic photosensitive material of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar—SM and Ar—S—S—Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer in amounts of 0.001 to 1.0 mol, more preferably 0.01 to 0.3 mol per mol of silver.

Next, the photosensitive silver halide is described. A method for forming a photosensitive silver halide is well known in the art. Any of the methods disclosed in Research Disclosure No. 17029 (June 1978) and U.S. Pat. No. 3,700,458, for example, may be used. Illustrative methods which can be used herein are a method of preparing an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention. The photosensitive silver halide should preferably have a smaller grain size for the purpose of minimizing white turbidity after image formation. Specifically, the grain size is preferably up to 0.20 $\mu$m, more preferably 0.01 $\mu$m to 0.15 $\mu$m, most preferably 0.02 $\mu$m to 0.12 $\mu$m. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the plane indices (Miller indices) of an outer surface of silver halide grains. Preferably silver halide grains have a high proportion of {100} plane featuring high spectral sensitization efficiency upon adsorption of a spectral sensitizing dye. The proportion of {100} plane is preferably at least 50%, more preferably at least 65%, most preferably at least 80%. Note that the proportion of Miller index {100} plane can be determined by the method described in T. Tani, J. Imaging Sci., 29, 165 (1985), utilizing the adsorption dependency of {111} plane and {100} plane upon adsorption of a sensitizing dye.

The halogen composition of photosensitive silver halide is not critical and may be any of silver chloride, silver chlorobromide, silver bromide, silver iodobromide, silver iodochlorobromide, and silver iodide. Silver bromide or silver iodobromide is preferred in the practice of the invention. Most preferred is silver iodobromide preferably having a silver iodide content of 0.1 to 40 mol %, especially 0.1 to 20 mol %. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, and iron. The metal complexes may be used alone or in admixture of two or more complexes of a common metal or different metals. The metal complex is preferably contained in an amount of 1 nmol to 10 mmol, more preferably 10 nmol to 100 $\mu$mol per mol of silver. Illustrative metal complex structures are those described in JP-A 225449/1995. Preferred among cobalt and iron complexes are hexacyano metal complexes. Illustrative, non-limiting examples include a ferricyanate ion, ferrocyanate ion, and hexacyanocobaltate ion. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis(carbamoyl)tellurides, bis(oxycarbonyl)ditellurides, bis(carbamoyl)ditellurides, compounds having a P=Te bond, tellurocarboxylic salts, Te-organyltellurocarboxylic esters, di(poly)tellurides, tellurides, telluroles, telluroacetals, tellurosulfonates, compounds having a P-Te bond, Te-containing heterocyclics, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and UKP 618,061. Illustrative examples of the compound used in the reduction sensitization method include ascorbic acid, thiourea dioxide, stannous chloride, aminoiminomethanesulfinic acid, hydrazine derivatives, boran compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibratory mill or homogenizer or a method of preparing an organic silver salt by adding the already prepared photosensitive silver halide at any timing during preparation of an organic silver salt. Any desired mixing method may be used insofar as the benefits of the invention are fully achievable.

The organic silver salt used herein is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 30% by weight of an image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido) benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt which can be used herein may take any desired shape although needle crystals having a minor axis and a major axis are preferred. The inverse proportional relationship between the size of silver salt crystal grains and their covering power that is well known for photosensitive silver halide materials also applies to the photothermographic material of the present invention. That is, as organic silver salt grains constituting image forming regions of photothermographic material increase in size, the covering power becomes smaller and the image density becomes lower. It is thus necessary to reduce the grain size. In the practice of the invention, grains should preferably have a minor axis of 0.01 μm to 0.20 μm, more preferably 0.01 μm to 0.15 μm and a major axis of 0.10 μm to 5.0 μm, more preferably 0.10 μm to 4.0 μm. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the autocorrelation function of the fluctuation of scattering light relative to a time change, and obtaining the grain size (volume weighed mean diameter) therefrom.

The photothermographic photosensitive material of the present invention is preferably a one side photosensitive material having at least one photosensitive layer containing a silver halide emulsion on one surface of a support and a backing layer (or back layer) on the other surface.

In the present invention, a matte agent may be added to the one side photosensitive material for improving transportation. The matte agent used herein is generally a microparticulate water-insoluble organic or inorganic compound. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 μm to 30 μm are preferably used in the practice of the invention. The particle size distribution of the matte agent may be either narrow or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

In the practice of the invention, the backing layer should preferably have a degree of matte as expressed by a Bekk smoothness of 10 to 250 seconds, more preferably 50 to 180 seconds.

In the photosensitive material of the invention, the matte agent is preferably contained in an outermost surface layer, a layer functioning as an outermost surface layer, a layer close to the outer surface or a layer functioning as a so-called protective layer.

In the practice of the invention, the binder used in the backing layer is preferably transparent or semi-transparent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly (vinyl pyrrolidone), casein, starch, poly(acrylic acid), poly (methyl methacrylate), polyvinyl chloride, poly(methacrylic acid), copoly(styrene-maleic anhydride), copoly(styrene-acrylonitrile), copoly(styrene-butadiene), poly(vinyl acetals) (e.g., poly(vinyl formal) and poly(vinyl butyral)), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

In the practice of the invention, the backing layer preferably has a maximum absorbance of 0.3 to 2 in a desired wavelength range, more preferably an IR absorbance of 0.5 to 2 and an absorbance of 0.001 to less than 0.5 in the visible range. Most preferably it is an anti-halation layer having an optical density of 0.001 to less than 0.3.

Where anti-halation dyes are used in the practice of the invention, such a dye may be any compound which has sufficiently low absorption in the visible region and provides the backing layer with a preferred absorbance spectrum profile. Exemplary anti-halation dyes are the compounds described in JP-A 13295/1995, U.S. Pat. No. 5,380,635, JP-A 68539/1990, page 13, lower-left column to page 14, lower-left column, and JP-A 24539/1991, page 14, lower-left column to page 16, lower-right column though not limited thereto.

A backside resistive heating layer as described in U.S. Pat. Nos. 4,460,681 and 4,374,921 may be used in a photothermographic image system according to the present invention.

A surface protective layer may be provided in the photosensitive material according to the present invention for the purpose of preventing adhesion of an image forming layer. The surface protective layer may be formed of any adhesion-preventing material. Examples of the adhesion-preventing material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof.

In the emulsion layer or a protective layer therefor according to the invention, there may be used light absorbing substances and filter dyes as described in U.S. Pat. Nos. 3,253,921, 2,274,782, 2,527,583, and 2,956,879. The dyes may be mordanted as described in U.S. Pat. No. 3,282,699.

In the emulsion layer or a protective layer therefor according to the invention, there may be used matte agents, for example, starch, titanium dioxide, zinc oxide, and silica as well as polymer beads including beads of the type described in U.S. Pat. Nos. 2,992,101 and 2,701,245. The emulsion surface may have any degree of matte insofar as no star dust failures occur although a Bekk smoothness of 1,000 to 10,000 seconds, especially 2,000 to 10,000 seconds is preferred.

The emulsion layer is based on a binder. Exemplary binders are naturally occurring polymers and synthetic resins, for example, gelatin, polyvinyl alcohol, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included. Preferred polymers are polyvinyl butyral, butylethyl cellulose, methacrylate copolymers, maleic anhydride ester copolymers, polystyrene and butadiene-styrene copolymers. These polymers may be used alone or in admixture of two or more as desired. The polymer is used in such a range that it may effectively function as a binder to hold various components. The effective range may be properly determined by those skilled in the art without undue experimentation. Taken at least as a measure for holding the organic silver salt in the film, the weight ratio of the binder to the organic silver salt is preferably in the range of from 15:1 to 1:2, more preferably from 8:1 to 1:1.

With respect to the binder for the silver halide emulsion layer and other hydrophilic colloid layers, the binders described in JP-A 18542/1990 may be used.

EXAMPLE

Examples of the present invention are given below by way of illustration and not by way of limitation.

Example 1

Preparation of organic acid silver salt emulsion

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a solution containing 1.2% by weight of polyvinyl acetate in butyl acetate was added to the aqueous mixture. The mixture was allowed to stand for 10 minutes, separating into two layers. After the aqueous layer was removed, the remaining gel was washed twice with water. There was obtained a gel-like mixture of silver behenate, silver stearate, and silver bromide, which was dispersed in 1,800 grams of a solution containing 2.6% of polyvinyl butyral (Denka Butyral #3000-K by Denki Kagaku Kogyo K.K.) in isopropyl alcohol. The dispersion was further dispersed in 600 grams of polyvinyl butyral (Denka Butyral #4000-2 by Denki Kagaku Kogyo K.K.) and 300 grams of isopropyl alcohol, obtaining an organic acid silver salt emulsion of needle grains having a mean minor diameter of 0.05 μm, a mean major diameter of 1.2 μm, and a coefficient of variation of 25%.

Preparation of emulsion layer coating solution

Various chemicals were added to the above-prepared organic acid silver salt emulsion as follows. It is noted that the amounts of chemicals added are expressed per mol of silver. With stirring 25° C., 10 mg of sodium phenylthiosulfonate, 70 mg of dye (a), 2 grams of 2-mercapto-5-methylbenzimidazole, 21.5 grams of 4-chlorobenzophenone-2-carboxylic acid, 580 grams of 2-butanone, and 220 grams of dimethylformamide were added to the emulsion, which was allowed to stand for 3 hours. Then, 8 grams of 5-tribromomethylsulfonyl-2-methylthiadiazole, 6 grams of 2-tribromomethylsulfonylbenzothiazole, 5 grams of 4,6-ditrichloromethyl-2-phenyltriazine, 2 grams of disulfide compound (a), 0.3 mol of reducing agent (R-I-5), and $6.5\times10^{-3}$ mol of ultrahigh contrast promoting agent (I-65) were added. Further, $5.0\times10^{-4}$ mol of a pepper fog-inhibiting agent as shown in Table 11 was added. With stirring, 5 grams of tetrachlorophthalic acid, 1.1 grams of Megafax F-176P (fluorinated surfactant by Dai-Nihon Ink Chemical Industry K.K.), 590 grams of 2-butanone and 10 grams of methyl isobutyl ketone were added.

Emulsion surface protecting layer coating solution

A coating solution was prepared by dissolving 75 grams of CAB 171-15S (cellulose acetate butyrate by Eastman Chemical K.K.), 5.7 grams of 4-methylphthalic acid, 1.5 grams of tetrachlorophthalic anhydride, 12.5 grams of phthalazine, 0.3 grams of Megafax F-176P, 2 grams of Sildex H31 (spherical silica by Dokai Chemical K.K., mean particle size 3 μm), and 7 grams of Sumidur N3500 (polyisocyanate by Sumitomo-Bayern Urethane K.K.) in 3,070 grams of 2-butanone and 30 grams of ethyl acetate.

Preparation of back-coated support

Onto a polyethylene terephthalate film having a moisture-proof undercoat containing vinylidene chloride on either surface, a back layer and a back surface protective layer were concurrently applied in an overlapping manner. It is noted that the coverage of each component is expressed per square meter of the film. The back layer contained 1.5 grams of gelatin, 30 mg of sodium p-dodecylbenzenesulfonate, 100 mg of 1,2-bis(vinylsulfonylacetamide)ethane, 50 mg of dyestuff (a), 100 mg of dyestuff (b), 30 mg of dyestuff (c), 50 mg of dyestuff (d), and 1 mg of proxisel. The back surface protective layer contained 1.5 grams of gelatin, 20 mg of polymethyl methacrylate having a mean particle size of 2.5 μm, 15 mg of sodium p-dodecylbenzenesulfonate, 15 mg of sodium dihexyl-α-sulfosuccinate, 50 mg of sodium acetate, and 1 mg of proxisel.

Onto the thus prepared support, the emulsion layer coating solution was applied in a coverage of 2 g/m$^2$ of silver. The emulsion surface protecting layer coating solution was applied onto the emulsion layer to form a protective layer having a dry thickness of 2 μm.

Dye (a), disulfide compound (a), dyestuff (a), (b), (c), and (d) are shown below.

Dye (a)

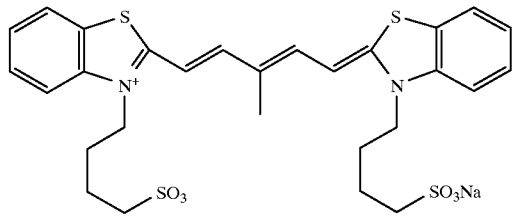

Dyestuff (a)

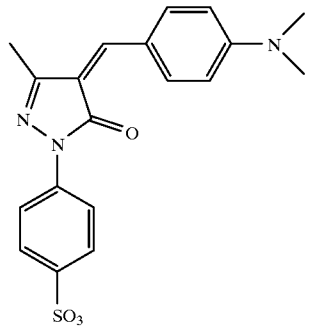

-continued

Disulfide compound (a)

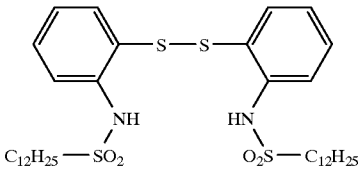

Dyestuff (b)

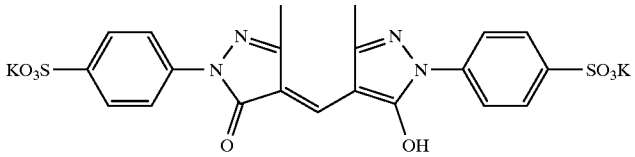

Dyestuff (c)

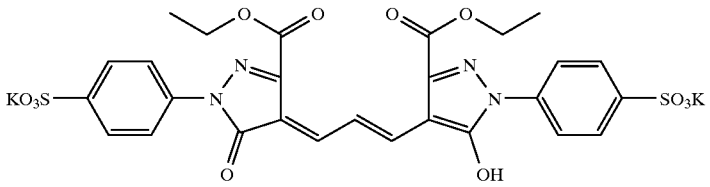

Dyestuff (d)

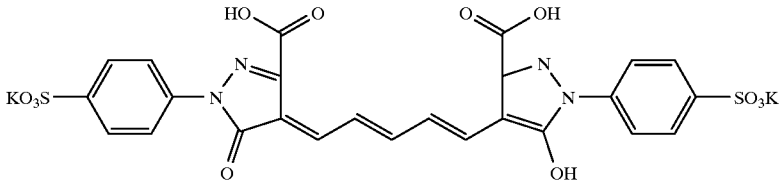

Evaluation of photographic properties

A photographic material sample was exposed by means of a 633-nm He-Ne laser sensitometer and heated at 120° C. for 20 seconds for heat development to produce an image which was measured for maximum density (Dmax) and gradient (γ) by means of a densitometer. Note that γ is the gradient of a straight line connecting points of density 0.3 and 3.0 on a characteristic curve. The pepper fog count was determined by observing the image through a 25× magnifier and counting black spots within a circle of 3 mm in diameter. The pepper fog count was determined both at 120° C. for 20 seconds and at 120° C. for 30 seconds.

The results are shown in Table 11.

TABLE 11

| Sample No. | Compound | Dmax | γ | Pepper fog count 120° C. × 20 sec. | Pepper fog count 120° C. × 30 sec. |
|---|---|---|---|---|---|
| 1 | — | 4.29 | 13.5 | 5 | 43 |
| 2 | II-4 | 4.29 | 13.3 | 4 | 31 |
| 3 | II-8 | 4.15 | 12.8 | 2 | 18 |
| 4 | II-10 | 4.25 | 13.0 | 3 | 15 |
| 5 | II-11 | 4.28 | 13.5 | 4 | 30 |
| 6 | II-12 | 4.19 | 12.7 | 4 | 32 |

TABLE 11-continued

| Sample No. | Compound | Dmax | γ | Pepper fog count 120° C. × 20 sec. | Pepper fog count 120° C. × 30 sec. |
|---|---|---|---|---|---|
| 7 | II-14 | 4.25 | 13.2 | 1 | 8 |
| 8 | II-16 | 4.20 | 13.0 | 3 | 22 |
| 9 | III-3 | 4.29 | 13.5 | 4 | 28 |
| 10 | III-11 | 4.15 | 11.9 | 3 | 29 |
| 11 | III-16 | 4.07 | 11.3 | 3 | 25 |
| 12 | III-20 | 4.11 | 12.2 | 3 | 30 |
| 13 | III-24 | 4.05 | 11.5 | 2 | 20 |
| 14 | IV-1 | 4.29 | 13.8 | 3 | 21 |
| 15 | IV-22 | 4.25 | 13.5 | 3 | 20 |
| 16 | V-1 | 4.21 | 13.0 | 2 | 16 |
| 17 | V-2 | 4.24 | 13.3 | 3 | 24 |
| 18 | V-11 | 4.27 | 13.4 | 3 | 21 |

It is evident that the occurrence of pepper fog is suppressed using a compound of formula (II) within the scope of the invention.

Example 2

Preparation of silver halide grains

In 700 ml of water were dissolved 22 grams of phthalated gelatin and 30 mg of potassium bromide. The solution was adjusted to pH 5.0 at a temperature of 35° C. To the solution, 159 ml of an aqueous solution containing 18.6 grams of silver nitrate and an aqueous solution containing potassium bromide and potassium iodide in a molar ratio of 92:8 were added over 10 minutes by a controlled double jet method while maintaining the solution at pAg 7.7. Then, 476 ml of an aqueous solution containing 55.4 grams of silver nitrate and an aqueous solution containing $1.2\times10^{-5}$ mol/liter of dipotassium hexachloroiridate, an amount (corresponding to $1\times10^{-5}$ mol per mol of silver halide completed) of tetrapotassium iron hexacyanide, and 1 mol/liter of potassium bromide were added over 30 minutes by a controlled double jet method while maintaining the solution at pAg 7.7. The pH of the solution was lowered to cause flocculation and sedimentation for desalting. Phenoxyethanol, 0.1 gram, was added to the solution, which was adjusted to pH 5.9 and pAg 8.2. There were obtained silver iodobromide grains in the form of cubic grains having an iodine content of 8 mol % in the core and 2 mol % on the average, a mean grain size of 0.05 μm, a coefficient of variation of projected area of 8%, and a (100) plane ratio of 88%.

The thus obtained silver halide grains were heated at 60° C., to which 85 μmol of sodium thiosulfate, 11 μmol of 2,3,4,5,6-pentafluorophenyldiphenylphosphine selenide, 15 μmol of tellurium compound (1-a) shown below, $4.0\times10^{-6}$ mol of chloroauric acid, and $3.0\times10^{-4}$ mol of thiocyanic acid were added per mol of silver. The solution was ripened for 120 minutes and quenched to 30° C., obtaining a silver halide emulsion.

tellurium compound (1-a)

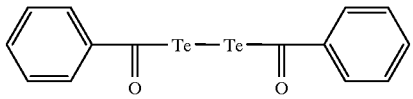

Preparation of photosensitive emulsion A containing organic acid silver salt emulsion A mixture of 1.3 grams of stearic acid, 0.5 gram of arachidonic acid, 8.5 grams of behenic acid, and 300 ml of distilled water was stirred at 90° C. for 15 minutes. With vigorous stirring, 31.1 ml of 1N NaOH aqueous solution was added to the solution, which was cooled to 30° C. after 15 minutes. 7 ml of 1N phosphoric acid aqueous solution was added to the solution, and with more vigorous stirring, 0.012 gram of N-bromosuccinimide was added to the solution and the above-prepared silver halide emulsion was added in such an amount as to give 2.5 mmol of silver halide. Further, 25 ml of 1N silver nitrate aqueous solution was added over 2 minutes and stirring was continued for 90 minutes. The solids were separated by suction filtration and washed with water until the water filtrate reached a conductivity of 30 μS/cm. To the solids, 37 grams of a butyl acetate solution containing 1.2% by weight of polyvinyl acetate was added and agitated. Agitation was stopped whereupon an oil layer separated from an aqueous layer. The aqueous layer was removed together with salts contained therein. To the oil layer, 20 grams of a 2-butanone solution containing 2.5% by weight of polyvinyl butyral (Denka Butyral #3000-K by Denki Kagaku Kogyo K.K.) was added and agitated. Further, 0.1 mmol of pyridinium perbromide and $1.8\times10^{-4}$ mol of calcium bromide dihydrate were added together with 0.7 gram of methanol. 40 grams of 2-butanone and 7.8 grams of polyvinyl butyral (PVB B-76 by Monsanto Co.) were added to the mixture, which was dispersed by a homogenizer. There was obtained an organic acid silver salt emulsion of needle grains having a mean particle size of 0.04 μm, a mean major diameter of 1 μm, and a coefficient of variation of 30%.

Preparation of organic acid silver salt emulsion B

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept stirred at 35° C., 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a solution containing 1.2% by weight of polyvinyl acetate in butyl acetate was added to the aqueous mixture. The mixture was allowed to stand for 10 minutes, separating into two layers. After the aqueous layer was removed, the remaining gel was washed twice with water. There was obtained a gel-like mixture of silver behenate, silver stearate, and silver bromide, which was dispersed in 1,800 grams of a 2.6% isopropyl alcohol solution of polyvinyl butyral (Denka Butyral #3000-K by Denki Kagaku Kogyo K.K.). The dispersion was further dispersed in 600 grams of polyvinyl butyral (Denka Butyral #4000-2 by Denki Kagaku Kogyo K.K.) and 300 grams of isopropyl alcohol, obtaining an organic acid silver salt emulsion of needle grains having a mean minor diameter of 0.05 μm, a mean major diameter of 1.2 μm, and a coefficient of variation of 25%.

Preparation of emulsion layer coating solution

Various chemicals were added to the above-prepared organic acid silver salt emulsion A as follows. It is noted that the amounts of chemicals added are expressed per mol of silver. With stirring at 25° C., 10 mg of sodium phenylthiosulfonate, 70 mg of dye (a), 2 grams of 2-mercapto-5-methylbenzimidazole, 21.5 grams of 4-chlorobenzophenone-2-carboxylic acid, 0.0064 mol of a compound of the general formula (1), (2) or (3) as shown in Table 12, 580 grams of 2-butanone, and 220 grams of dimethylformamide were added to the emulsion, which was allowed to stand for 3 hours. With stirring, 8 grams of 5-tribromomethylsulfonyl-2-methylthiadiazole, 6 grams of 2-tribromomethylsulfonylbenzothiazole, 5.2 grams of 4,6-ditrichloromethyl-2-phenyltriazine, 2 grams of disulfide compound (a), 0.35 mol of reducing agent (shown in Table 12), 5 grams of tetrachlorophthalic acid, 0.008 mol of a hydrazine derivative (shown in Table 12), 1.1 grams of Megafax F-176P (fluorinated surfactant by Dai-Nihon Ink Chemical Industry K.K.), 590 grams of 2-butanone and 10 grams of methyl isobutyl ketone were then added.

Emulsion surface protecting layer coating solution

A coating solution was prepared by dissolving 75 grams of CAB 171-15S (cellulose acetate butyrate by Eastman Chemical K.K.), 5.7 grams of 4-methylphthalic acid, 1.5 grams of tetrachlorophthalic anhydride, 15 grams of phthalazine, 0.3 grams of Megafax F-176P, 2 grams of Sildex H31 (spherical silica by Dokai Chemical K.K., mean particle size 3 μm), and 7.5 grams of Sumidur N3500 (polyisocyanate by Sumitomo-Bayern Urethane K.K.) in 3,070 grams of 2-butanone and 30 grams of ethyl acetate.

Preparation of back-coated support

Onto a polyethylene terephthalate film (of 100 μm thick) having a moisture-proof undercoat of vinylidene chloride on either surface, a solution of the composition shown below was applied and dried at 50° C. for 10 minutes to form a back layer of 15 μm thick.

Preparation of back layer coating solution

A coating solution was prepared by dissolving 60 grams of a 10% isopropyl alcohol solution of polyvinyl butyral (Denka Butyral #4000-2 by Denki Kagaku Kogyo K.K.), 10 grams of isopropyl alcohol, 8 grams of a 8% ethyl acetate solution of 3-isocyanatomethyl-3,5,5-trimethylcyclohexyl isocyanate (Wako Junyaku K.K.), and 0.2 gram of a dyestuff (D-1) in 10 grams of methanol and 20 grams of acetone so as to provide an absorbance of 0.8 at the exposure wavelength.

An emulsion layer coating solution was applied onto the surface of the support opposite to the back layer so as to provide a coverage of 1.8 g/m$^2$ of silver. A protective layer coating solution was then applied onto the emulsion layer to give a dry thickness of 2 $\mu$m.

Dye (a), disulfide compound (a), and dyestuff (D-1) are shown below.

Dye (a)

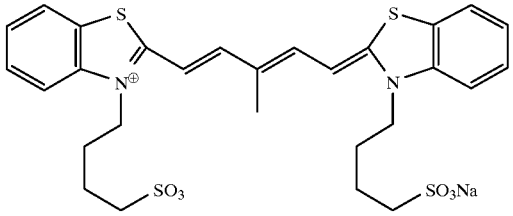

Disulfide compound (a)

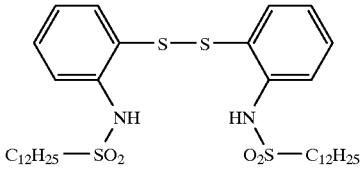

-continued

Dyestuff (D-1)

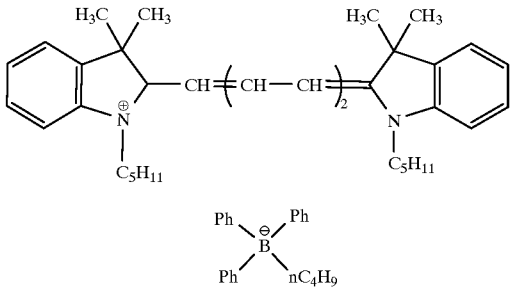

Exposure and development (1) A sample as prepared above was exposed to xenon flash light for a light emission time of $10^{-6}$ second through an interference filter having a peak at 633 nm and a step wedge. (2) Another sample was similarly exposed to light through an interference filter having a peak at 633 nm, a step wedge, and a 50% tint screen. Thereafter the samples were heated for development at 110° C. for 20 seconds, 30 seconds and 40 seconds.

Photographic tests

The thus obtained image was measured for density and a percent dot area.

Sample (1) was measured for gamma (G0330) upon 30-second development and Dmin upon 40-second development. Note that G0330 is the gradient of a straight line connecting points of density 0.3 and 3.0 on a characteristic curve.

Sample (2) was evaluated for image enlargement (ΔD50). Note that ΔD50 is the difference in percent dot area between 20-second development and 30-second development of the step which gave a percent dot area of 50% upon 20-second development.

The results are shown in Table 12.

TABLE 12

| Sample No. | Hydrazine derivative | Reducing agent | Compound of formula (1), (2), (3) | Compound of formula (mol/mol of Ag) | properties G0330 | Dmin | ΔD50 |
|---|---|---|---|---|---|---|---|
| 101* | I-1 | R-I-6 | — | — | 12 | 0.25 | 33 |
| 102 | I-1 | R-I-6 | 1-1 | 0.006 | 12 | 0.18 | 26 |
| 103 | I-1 | R-I-6 | 1-1 | 0.012 | 11 | 0.10 | 18 |
| 104 | I-1 | R-I-6 | 1-1 | 0.018 | 10 | 0.08 | 12 |
| 105* | I-1 | R-I-6 | comp.-A | 0.012 | 11 | 0.22 | 30 |
| 106* | I-1 | R-I-6 | comp.-B | 0.012 | 11 | 0.21 | 29 |
| 107* | I-1 | R-I-6 | comp.-C | 0.012 | 13 | 0.24 | 32 |
| 108* | I-1 | R-I-6 | comp.-D | 0.012 | 12 | 0.19 | 29 |
| 109* | I-1 | R-I-6 | comp.-E | 0.016 | 13 | 0.20 | 28 |
| 110* | I-65 | R-I-6 | — | — | 13 | 0.22 | 30 |
| 111 | I-65 | R-I-6 | 1-1 | 0.012 | 11 | 0.07 | 14 |
| 112* | I-58 | R-I-6 | — | — | 13 | 0.24 | 32 |
| 113 | I-58 | R-I-6 | 1-1 | 0.012 | 12 | 0.09 | 12 |
| 114* | I-96 | R-I-6 | — | — | 11 | 0.26 | 35 |
| 115 | I-96 | R-I-6 | 1-1 | 0.012 | 10 | 0.09 | 15 |
| 116* | I-97 | R-I-6 | — | — | 13 | 0.27 | 32 |
| 117 | I-97 | R-I-6 | 1-1 | 0.012 | 12 | 0.10 | 16 |
| 118* | I-109 | R-I-6 | — | — | 11 | 0.28 | 28 |
| 119 | I-109 | R-I-6 | 1-1 | 0.012 | 10 | 0.10 | 14 |
| 120* | I-65 | R-I-42 | — | — | 15 | 0.23 | 30 |

TABLE 12-continued

| Sample No. | Hydrazine derivative | Reducing agent | Compound of formula (1), (2), (3) | (mol/mol of Ag) | properties G0330 | Dmin | ΔD50 |
|---|---|---|---|---|---|---|---|
| 121 | I-65 | R-I-42 | 1-1 | 0.012 | 13 | 0.10 | 15 |
| 122 | I-65 | R-I-42 | 1-11 | 0.012 | 12 | 0.10 | 13 |
| 123 | J-65 | R-I-42 | 3-6 | 0.012 | 13 | 0.12 | 14 |
| 124 | I-65 | R-I-42 | 3-26 | 0.012 | 13 | 0.13 | 14 |
| 125 | I-65 | R-I-42 | 3-30 | 0.012 | 12 | 0.10 | 15 |
| 126* | I-65 | R-II-10 | — | — | 14 | 0.28 | 35 |
| 127 | I-65 | R-II-10 | 1-1 | 0.012 | 12 | 0.10 | 19 |
| 128 | 1-65 | R-II-10 | 3-2 | 0.012 | 12 | 0.09 | 15 |
| 129 | I-65 | R-II-10 | 3-27 | 0.012 | 13 | 0.12 | 16 |
| 130 | I-65 | R-II-10 | 3-51 | 0.012 | 12 | 0.10 | 13 |

*comparison

Note that in several samples, comparative compounds as shown below were used instead of the compounds of formulae (1), (2) and (3).

comp. -A

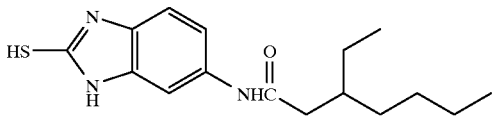

comp. -B

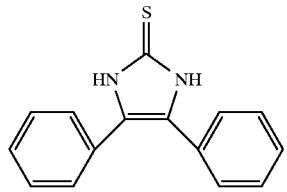

comp. -C

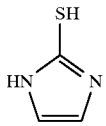

comp. -D

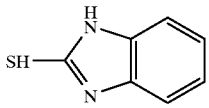

comp. -E

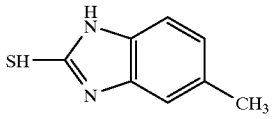

It is evident from Table 12 that control sample Nos. 101, 110, 112, 114, 116, 118, 120, and 126 which do not contain compounds of formulae (1), (2) and (3) show high Dmin and greater image enlargement. Comparative sample Nos. 105 to 109 containing comparative compounds show less fog inhibitory effect and greater image enlargement. In contrast, samples within the scope of the invention show satisfactory photographic properties of low Dmin and low image enlargement at no sacrifice of high contrast.

Example 3

The procedure of Example 2 was repeated except that organic acid silver salt emulsion B was used instead of organic acid silver salt emulsion A. Equivalent results were obtained.

Similar results were obtained when hydrazine compounds I-32, I-80, I-82, I-87, I-88, I-92, I-95, I-96, I-100, I-102, I-104, I-107, and I-110, reducing agents R-I-3, R-I-11, R-I-37, R-II-9, and R-III-1, and compounds 1-10, 1-13, 3-10, 3-26, and 3-46 as the compound of formula (1), (2) or (3) were used.

It is thus evident that the invention provides a fully dry basis photothermographic photosensitive material capable of forming stable super-high contrast images having low fog density and a minimized change of image enlargement with a variation of developing time and thus suitable for the manufacture of printing plates.

There has been described a photothermographic material comprising a photosensitive silver halide, an organic silver salt, a reducing agent, and an ultrahigh contrast promoting agent. In the first embodiment wherein a compound of formula (II) is contained, the material is capable of forming images having high contrast and high Dmax while minimizing pepper fog. In the second embodiment wherein a compound of formula (1) or (2) is contained, the material is capable of forming stable super-high contrast images experiencing a minimized change of properties, typically image enlargement with a variation of developing conditions and thus suitable for the manufacture of printing plates.

Although some preferred embodiments have been described, many modifications and variations may be made thereto in the light of the above teachings. It is therefore to be understood that within the scope of the appended claims, the invention may be practiced otherwise than as specifically described.

We claim:

1. A photothermographic photosensitive material comprising at least one silver halide photosensitive layer on a support, said photosensitive material containing an organic silver salt, a reducing agent, an ultrahigh contrast promoting agent, and at least one member selected from compounds of the formulae (1) and (2) in said photosensitive layer or a layer adjacent thereto,

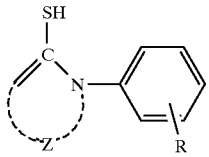

formula (1)

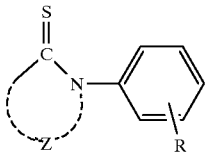

formula (2)

wherein Z is a group of atoms necessary to complete a 5- or 6-membered hetero-aromatic ring containing at least two nitrogen atoms, and R is selected from the group consisting of hydrogen, alkyl, aralkyl, alkoxy, alkyl- or aryl-substituted amino, amide, sulfonamide, ureido, urethane, aryloxy, sulfamoyl, carbamoyl, aryl, alkylthio, arylthio, hydroxy, halogen, cyano, carboxy or salt thereof, sulfo or salt thereof, and phosphoric acid amide.

2. The photothermographic material of claim 1 wherein said ultrahigh contrast promoting agent is a hydrazine derivative.

3. The photothermographic photosensitive material according to claim 2, wherein said hydrazine derivative is present in an amount of $1.0\times10^{-6}$ to $1.0\times10^{-1}$ mol per mol of total silver in said organic silver salt and said silver halide combined.

4. The photothermographic photosensitive material according to claim 3, wherein said hydrazine derivative is present in an amount of $1.0\times10^{-5}$ to $5.0\times10^{-2}$ mol per mol of total silver in said organic silver salt and said silver halide combined.

5. The photothermographic photosensitive material according to claim 2, wherein said hydrazine derivative is a compound according to the following formula

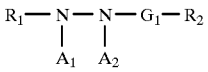

wherein $R_1$ is an aliphatic or aromatic group;

$R_2$ is a hydrogen atom, an alkyl group, an aryl group, an unsaturated heterocyclic group, an alkoxy group, an aryl alkoxy group, an amino group or a hydrazino group;

$G_1$ is a group represented by —CO—, —$SO_2$—, —SO—,

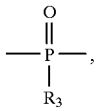

—CO—CO—, a thiocarbonyl or an imino methylene group;

$A_1$ and $A_2$ are both hydrogen atoms, or one of $A_1$ and $A_2$ is a hydrogen atom and the other is a substituted or unsubstituted alkylsulfonyl group, substituted or unsubstituted arylsulfonyl group or substituted or unsubstituted acyl group;

$R_3$ is a hydrogen atom, an alkyl group, an aryl group, an unsaturated heterocyclic group, an alkoxy group, an aryl alkoxy group, an amino group or a hydrazino group.

6. The photothermographic photosensitive material according to claim 5, wherein $R_1$ is an aliphatic group having 1 to 30 carbon atoms.

7. The photothermographic photosensitive material according to claim 6, wherein said aliphatic group is a normal, branched or cyclic alkyl group having 1 to 20 carbon atoms.

8. The photothermographic photosensitive material according to claim 5, wherein $R_1$ is an aromatic group selected from the group consisting of a monocyclic aryl group, a dicylic aryl group and an unsaturated heterocyclic group.

9. The photothermographic photosensitive material according to claim 8, wherein $R_1$ is an aryl group.

10. The photothermographic photosensitive material according to claim 5, wherein $R_2$ is an alkyl group having 1 to 4 carbon atoms.

11. The photothermographic photosensitive material according to claim 5, wherein $R_2$ is an aryl group selected from a monocyclic or dicylic aryl group.

12. The photothermographic photosensitive material according to claim 5, wherein $R_2$ is an alkoxy group having 1 to 8 carbon atoms.

13. The photothermographic photosensitive material according to claim 5, wherein $G_1$ is a —CO— or a —CO—CO— group.

14. The photothermographic photosensitive material according to claim 5, wherein $G_1$ is a —CO— group, and $R_2$ is a hydrogen atom, an alkyl group, an aralkyl group, an aryl group or a group represented by: —$C_2F_2COOM$, wherein M is a hydrogen atom or an alkali metal atom.

15. The photothermographic photosensitive material according to claim 5, wherein $G_1$ is a —$SO_2$— group, and $R_2$ is an alkyl group, an aralkyl group, an aryl group or a substituted amino group.

16. The photothermographic photosensitive material according to claim 5, wherein $G_1$ is a —CO—CO— group, and $R_2$ is an alkoxy group, an aryloxy group or an amino group.

17. The photothermographic photosensitive material according to claim 5, wherein $A_1$ and $A_2$ are both hydrogen atoms.

18. The photothermographic photosensitive material according to claim 5, wherein the group of $R_1$ and $R_2$ are substituted.

19. The photothermographic photosensitive material according to claim 18, wherein at least one of $R_1$ and $R_2$ is substituted with a nitro or nitrosyl group.

20. A photothermographic photosensitive material comprising at least one silver halide photosensitive layer on a support, said photosensitive material containing an organic silver salt, a reducing agent, an ultrahigh contrast promoting agent, and at least one compound of formula (2) in said photosensitive layer or a layer adjacent thereto formula (2)

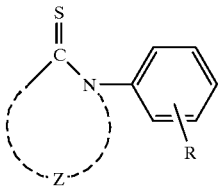

wherein Z is a group of atoms necessary to complete a 5- or 6-membered hetero-aromatic ring containing at least two nitrogen atoms, and R is selected from the group consisting of hydrogen, alkyl, aralkyl, alkoxy, alkyl- or aryl-substituted amino, amide, sulfonamide, ureido, urethane, aryloxy, sulfamoyl, carbamoyl, aryl, alkylthio, arylthio, hydroxy, halogen, cyano, carboxy or salt thereof, sulfo or salt thereof, and phosphoric acid amide.

* * * * *